US005787391A

United States Patent [19]

Moriya et al.

[11] Patent Number: 5,787,391

[45] Date of Patent: Jul. 28, 1998

[54] SPEECH CODING BY CODE-EDITED LINEAR PREDICTION

[75] Inventors: Takehiro Moriya; Akitoshi Kataoka, both of Tokorozawa; Kazunori Mano, Musashino; Satoshi Miki, Tokorozawa; Hitoshi Omuro, Higashimurayama; Shinji Hayashi, Iruma, all of Japan

[73] Assignee: Nippon Telegraph and Telephone Corporation, Tokyo, Japan

[21] Appl. No.: 658,303

[22] Filed: Jun. 5, 1996

Related U.S. Application Data

[63] Continuation of Ser. No. 82,103, Jun. 28, 1993, abandoned.

[30] Foreign Application Priority Data

| | | | |
|---|---|---|---|
| Jun. 29, 1992 | [JP] | Japan | 4-170895 |
| Oct. 2, 1992 | [JP] | Japan | 4-265194 |
| Oct. 2, 1992 | [JP] | Japan | 4-265195 |
| Mar. 29, 1993 | [JP] | Japan | 5-070534 |

[51] Int. Cl.[6] ..... G10L 3/02

[52] U.S. Cl. ..... 704/225; 704/201; 704/219; 704/220; 704/221; 704/224; 704/225; 704/230

[58] Field of Search ..... 395/2.09, 2.1, 395/2.14–2.18, 2.28–2.32, 2.35–2.37, 2.39

[56] References Cited

U.S. PATENT DOCUMENTS

| | | | |
|---|---|---|---|
| 4,860,355 | 8/1989 | Copperi | 395/2.22 |
| 4,975,956 | 12/1990 | Liu et al. | 395/2.28 |
| 4,991,214 | 2/1991 | Freeman et al. | 395/2.32 |
| 5,010,574 | 4/1991 | Wang | 395/2.31 |
| 5,230,037 | 7/1993 | Giustiniani et al. | 395/2 |
| 5,305,332 | 4/1994 | Ozawa | 395/2.32 |

(List continued on next page.)

FOREIGN PATENT DOCUMENTS 0 296 763 A1 12/1988 European Pat. Off. .

OTHER PUBLICATIONS

J.–H. Chen, "High–Quality 16 kb/s Speech Coding with a One–Way Delay Less Than 2 ms," Acoustics, Speech & Signal Processing Conference: ICASSP '90, pp. 453–456 (1990).

J.–H. Chen et al., "LD–CELP: A High Quality 16 kb/s Speech Coder with Low Delay," IEEE Global Telecommunications Conf.: GLOBECOM '90, pp. 528–532 (1990).

(List continued on next page.)

*Primary Examiner*—Allen R. MacDonald
*Assistant Examiner*—Michael N. Opsasnick
*Attorney, Agent, or Firm*—Finnegan, Henderson, Farabow, Garrett & Dunner, L.L.P.

[57] ABSTRACT

In a speech coding method of the present invention, initially, a plurality of samples of speech data are analyzed by a linear prediction analysis and thereby prediction coefficients are calculated. Then, the prediction coefficients are quantized, and the quantized prediction coefficients are set in a synthesis filter. Moreover, a pitch period vector is selected from an adaptive codebook in which a plurality of pitch period vectors are stored, and the selected pitch period vector is multiplied by a first gain which is obtained, at the same time, with a second gain. In addition, a noise waveform vector is selected from a random codebook in which a plurality of the noise waveform vectors are stored, and is multiplied by a predicted gain and the second gain. Then, the speech vector is synthesized by exciting the synthesis filter with the pitch period vector multiplied by the first gain, and with the noise waveform vector multiplied by the predicted gain and the second gain. Consequently, speech data comprising a plurality of samples are coded as a unit of a frame operation. Furthermore, the predicted gain multiplied by the noise waveform vector which is selected in a subsequent frame operation, is predicted based on the current noise waveform vector which is multiplied by the predicted gain and the second gain at the current frame operation, and also the previous waveform vector which is multiplied by the predicted gain and the second gain in the previous frame operation.

40 Claims, 29 Drawing Sheets

U.S. PATENT DOCUMENTS

| | | | |
|---|---|---|---|
| 5,321,793 | 6/1994 | Drogo de Iacovo et al. | 395/2.29 |
| 5,377,301 | 12/1994 | Rosenberg et al. | 395/2.31 |
| 5,396,576 | 3/1995 | Miki et al. | 395/2.31 |
| 5,426,460 | 6/1995 | Erving et al. | 395/2.79 |
| 5,432,883 | 7/1995 | Yoshihara | 395/2.28 |

OTHER PUBLICATIONS

E.M. Warrington et al., "A Case Study on Digital Communication Systems," in. N.B. Jones et al., ed., Digital Signal Processing: Principles, Devices, and Applications, 1990, pp. 335–337.

Kuo et al., "Low Bit-Rate Quantization of LSP Parameters Using Two-Dimensional Differential Coding," ICASSP-92, Mar. 23–26, 1992, v. 1, pp. 97–100.

Xydeas et al., "A Long History Quantization Approach to Scalar and Vector Quantization of LSP Coefficients," ICASSP-93, Apr. 27–30, 1993, v. 2, pp. 1–4.

Hagen et al., "Low Bit-Rate Spectral Coding in CELP, A New LSP-Method," ICASSP-90, Apr. 3–6, 1990, v. 1, pp. 189–219.

Ozawa et al., "4kb/s Improved CELP Coder with Efficient Vector Quantization," ICASSP-91, May 14–17, 1991, v. 1, pp. 213–216.

SPEECH CODING BY CODE-EDITED LINEAR PREDICTION

This application is a continuation of application Ser. No. 08/082,103, filed Jun. 28, 1993, now abandoned.

BACKGROUND OF THE INVENTION

1. Field of the Invention

The present invention relates to a speech coding method, and an apparatus for the same, for performing high efficiency speech coding for use in digital cellular telephone systems. More concretely, the present invention relates to a parameter coding method, and an apparatus for the same, for encoding various types of parameters such as spectral envelope information and power information, which are to be used in the aforementioned speech coding method and apparatus for the same; the present invention further relates to a multistage vector quantization method, and an apparatus for the same, for performing multistage vector quantization for use in the aforementioned speech coding process and apparatus for the same.

2. Background Art

Recently, within such technological fields as digital cellular transmission and speech storage service, with the objective of effectively utilizing electric wave and storage media, various high efficiency coding methods are in use. Among these various coding methods, code-excited linear prediction coding (CELP), vector sum excited linear prediction coding (VSELP), and multi-pulse coding represent high efficiency coding methods which code speech at a coding speed of approximately 8 kb/s.

FIG. 15 is a block diagram showing a constructional example of a speech coding apparatus utilizing a conventional CELP coding method. The analog speech signal is sampled at a sampling frequency of 8 kHz, and the generated input speech data is inputted from an input terminal 1. In a linear prediction coding (LPC) analyzing portion 2, a plurality of input speech data samples inputted from the input terminal 1 are grouped as one frame in one vector (hereafter referred to as "an input speech vector"), and linear prediction analysis is performed for this input speech vector, and LPC coefficients are then calculated. In an LSP coefficient quantizing portion 4, the LPC coefficients are quantized, and the LPC coefficients of a synthesis filter 3 possessing the transfer function $\{1/A(z)\}$ is then set.

An adaptive codebook 5 is formed in a manner such that a plurality of pitch period vectors, corresponding to pitch periods of the voiced intervals in the speech, are stored. In a gain portion 6, a gain set by a distortion power calculating portion 13 explained hereafter is multiplied by the pitch period vector, which is selected and outputted from the adaptive codebook 5 by the distortion power calculating portion 13 and is then outputted from the gain portion 6.

A plurality of noise waveform vectors (e.g., random vectors) corresponding to the unvoiced intervals in the speech are previously stored in a random codebook 7. In a gain portion 8, the gain set by distortion power calculating portion 13 is multiplied by the noise waveform vector, which is selected and outputted from the random codebook 7 by the distortion power calculating portion 13, and outputted from gain portion 8.

In an adder 9, the output vector of the gain portion 6 and the output vector of the gain portion 8 are added, and the output vector of the adder 9 is then supplied to the synthesis filter 3 as an excitation vector. In synthesis filter 3, the speech vector (hereafter referred to as "the synthetic speech vector") is synthesized based on the set LPC coefficient.

In addition, in a power quantizing portion 10, the power of the input speech vector is first calculated, and this power is then quantized. In this manner, using the quantized power of the input speech vector, the input speech vector and the pitch period vector are normalized. In a subtracter 11, the synthetic speech vector is subtracted from the normalized input speech vector outputted from the power quantizing portion 10, and the distortion data is calculated.

Subsequently, the distortion data is weighted in a perceptual weighting filter 12 according to the coefficients corresponding to the perceptual characteristics of humans. The aforementioned perceptual weighting filter 12 utilizes a masking effect of the perceptual characteristics of humans, and reduces the auditory senses of quantized random noise in the formant region of the speech data.

A distortion power calculating portion 13 calculates the power of the distortion data outputted from the perceptual weighting filter 12, selects the pitch period vector and the noise waveform vector, which will minimize the power of the distortion data, from the adaptive codebook 5 and the random codebook 7, respectively, and sets the gains in each of the gain portions 6 and 8. In this manner, the information (codes) and gains selected according to the LPC coefficients, power of the input speech vector, the pitch period vector and the noise waveform vector, are converted into codes of bit series, outputted, and then transmitted.

FIG. 16 is a block diagram showing a constructional example of a speech coding apparatus utilizing a conventional VSELP coding method. In this FIG. 16, components which correspond to those shown in FIG. 15, will retain the original identifying numeral, and their description will not herein be repeated. As seen from FIG. 16, the construction of this speech coding apparatus utilizing the VSELP coding method is similar overall to that of the aforementioned speech coding apparatus utilizing the CELP coding method. However, instead of multiplying each separately gain with the selected pitch period vector and noise waveform vector respectively, as in the CELP coding method, the VSELP coding method, in order to raise the quantization efficiency, utilizes a vector quantization method which simultaneously determines the gains to be multiplied with the selected pitch period vector and noise waveform vector respectively, and sets them into gain portions **15*a* and 15*b* of a gainer 15**.

The specific details of the (1) CELP coding method, (2) VSELP coding method and (3) the multi-pulse coding method can be found by referencing respectively (1) Schroeder, M. R., et al. (Code-Excited Linear Prediction (CELP): High-quality Speech at Very Low Rates: Proc. ICASSP '85, 25.1.1, pp. 937–940, 1985), (2) Gerson, I. A., et al. (Vector Sum Excited Linear Prediction (VSELP) Speech Coding at 8 kps: Proc. ICASSP '90, S9.3, pp. 461–464, 1990), and (3) Ozawa, et al. (9.6-4.8 kbit/s Multipass Speech Coding Method Using Pitch Information [translated]: Shingakushi (D-II), J72-D-II, 8, pp. 1125–1132, 1989).

In addition, a low-delay code excited linear prediction (LD-CELP) coding method is a high efficiency coding method which encodes speech at a coding speed of 16 kb/s, wherein due to use of a backward prediction method in regard to the LPC coefficients and the power of the input speech vector, transmission of the LPC coefficients codes and power codes of the input speech vector is unnecessary. FIG. 17 is a block diagram showing a constructional example of a speech coding apparatus utilizing the conventional LD-CELP coding method. In this FIG. 17, components which correspond to those shown in FIG. 15, will retain the original identifying numeral, and their description will not herein be repeated.

In a LPC analyzing portion 16, linear prediction analysis is not performed and the LPC coefficients of the synthesis filter 3 are not calculated for the input speech data, inputted from the input terminal 1, which is in the frame currently undergoing quantization. Instead, a high-order linear prediction analysis of the 50th order, including the pitch periodicity of the speech, is performed, and the LPC coefficients of the synthesis filter 3 are calculated and determined for the previously processed output vector of the synthesis filter 3. In this manner, the determined LPC coefficients are set into synthesis filter 3.

Similarly, in this speech coding apparatus, after the calculation of the power of the input speech data in the frame undergoing quantization, in the power quantizing portion 10, the quantization of this power is not performed as in the speech coding apparatus shown in FIG. 15. Instead, in a gain adapting portion 17, linear prediction analysis is performed for the previously processed power of the output vector from the gain portion 8, and the power (in other words, the predicted gain) to be provided to the noise waveform vector selected in the current frame operation, is calculated, determined and then set into the predicted gain portion 18.

Consequently, in the predicted gain portion 18, the predicted gain set by the gain adapting portion 17 is multiplied by the noise waveform vector which is selected and outputted from the random codebook 7 by the distortion power calculating portion 13. Subsequently, the gain set by the distortion power calculating portion 13 is multiplied by the output vector from the predicted gain portion 18 in the gain portion 8, and then outputted. The output vector of the gain portion 8 is then supplied as an excitation vector to the synthesis filter 3, and a synthetic speech vector is synthesized in the synthesis filter 3 based on the set LPC coefficients.

Subsequently, in the subtracter 11, the synthetic speech vector is subtracted from the input speech vector, and the distortion data are calculated. After this distortion data are weighted in the perceptual weighting filter 12 using the ocoefficients corresponding to human perceptual characteristics, the power of the distortion data outputted from the perceptual weighting filter 12 is calculated, the noise waveform vector, which will minimize the power of the distortion data, is selected from the random codebook 7, and the gain is then set in the gain portion 8. In this manner, in the code outputting portion 14, the codes and gains selected according to the noise waveform vectors are converted into codes of bit series, outputted and then transmitted.

As described above, in the conventional LD-CELP coding method, since synthetic speech vectors previously processed by both speech coding and decoding apparatuses may be used commonly, thus transmission of the LPC coefficients and power of the input speech vector is unnecessary.

Further details on the LD-CELP coding method can be found by referencing Chen, J. (High Quality 16 kb/s Speech Coding with a One-Way Delay Less Than 2 ms: Proc. ICASSP '90, 33. S9.1, 1990).

Among the aforementioned conventional speech coding methods, in the CELP speech coding, linear prediction analysis is performed, the LPC coefficients of the synthesis filter 3 are calculated and these LPC coefficients are then quantized only for the input speech data in the current frame undergoing quantization. Therefore, a drawback exists in that in order to obtain, at the transmission receiver, high quality speech which is decoded (hereafter referred to as "the decoded speech"), a large number of bits are necessary for the LPC coefficients quantization.

In addition, the power of the input speech vector is quantized, and the code selected in response to the quantized power of the input speech vector is transmitted as the coding signal, thus in the case where a transmission error of the code occurs in the transmission line, problems exist in that undesired speech is generated in the unvoiced intervals of the decoded speech, and the desired speech is frequently interrupted, thereby creating decoded speech of inferior quality. In addition, quantization of the power of the input speech vector is performed using a limited number of bits, thus in the case where the magnitude of the input speech vector is small, a disadvantage exists in that the quantized noise increases.

Furthermore, the noise waveform vector is represented by one noise waveform vector stored in one random codebook 7, and the code selected in response to this noise waveform vector is transmitted as the coding signal, thus in the case where an transmission error of the code occurs in the transmission line, a completely different noise waveform vector is used in the speech decoding apparatus of the transmission receiver, thereby creating decoded speech of inferior quality.

Moreover, normally the noise waveform vector to be stored in the random codebook uses a speech data base in which a large amount of actual speech data is stored, and performs learning so as to match this actual speech data. However, in the case where the noise waveform vector is represented by one noise waveform vector of one random codebook 7, a large storage capacity is required, and thus the size of the codebook becomes significantly large. Consequently, disadvantages exist in that the aforementioned learning is not performed, and the noise waveform vector is not matched well with the actual speech data.

Additionally, in the aforementioned conventional VSELP coding method, in the case where an transmission error of the code corresponding to the gain to be multiplied by the pitch period vector and the noise waveform vector, set simultaneously in the transmission line, these pitch period vector and noise waveform vector are multiplied by a completely different gain in the speech decoding apparatus of the transmission receiver, thereby creating decoded speech of inferior quality.

Furthermore, in the aforementioned conventional CELP and VSELP coding methods, the pitch period vector and the noise waveform vector which will minimize the power of the distortion data, are selected from the adaptive codebook 5 and the random codebook 7 respectively. However, in order to select the most optimum pitch period vector and noise waveform vector, since the power of the distortion data d, shown in a formula (1) below, in a closed loop formed by means of structural elements 3, 5~9, and 11~13, or structural elements 3, 5, 7, 9, 11~13, and 15, must be calculated in the distortion power calculating portion 13 for all pitch period vectors and noise waveform vectors stored in the adaptive codebook 5 and the random codebook 7 respectively, there exist disadvantages in that enormous computational complexity is required.

$$d=|X-gHV|^2 \quad (1)$$

In the formula (1), the input speech vector whose power is quantized, is represented by X; the pitch period vector or the noise waveform vector selected from the adaptive codebook 5 and the random codebook 7 respectively are represented by $V_j$ (j=1~N; N is the codebook size); the gain set in the gain portions 6 and 8, or in the gain portions 15*a* and 15*b* is represented by g; the impulse response coefficients which are the coefficients of the FIR filter, in the case where the synthesis filter 3 and the perceptual weighting filter 12 are comprised by one FIR filter, is represented by H; and the distortion data are designated by d.

On the other hand, in the aforementioned conventional LD-CELP coding method, when calculating the LPC coefficients of the synthesis filter 3, a backward prediction method in which linear prediction analysis is performed only for the previously processed synthetic speech vector, is used. Thus, when compared with the forward prediction methods used in the aforementioned CELP and VSELP coding methods, the prediction error is large. As a result, at a coding speed of approximately 8 kb/s, sudden increases in the waveform distortion occur, which in turn create the decoded speech of inferior quality.

In the aforementioned conventional high efficiency coding methods, a plurality of samples of each type of parameter from information relating to spectral envelopes, power and the like are gathered as one frame in one vector, coded in each frame, and then transmitted. In addition, in the aforementioned conventional high efficiency coding methods, in order to increase the information compression efficiency, methods for increasing the frame update period, and for quantizing the differences between the current frame and the previous frame, as well as, the predicted values are known.

However, when the frame update period is 40 ms or greater, a problem arises in that the coding distortion increases due to the inability of the system to track changes in the spectral characteristics of the speech waveform, as well as, fluctuations in the power. In addition, when the parameters are destroyed by coding errors, distortions are created over long intervals in the encoded speech.

On the other hand, when the differences between parameters of the present and past frames, as well as the predicted values are quantized, even in the case of short frame update periods, using a time continuity of the parameters, and information compression becomes possible. However, a disadvantage exists in that the effects of the past coding errors continue to propagate over long periods of time.

Furthermore, in the aforementioned speech coders shown in FIGS. 15 and 16, after the LPC coefficients determined in the LPC analyzing portion 2 are converted into the LSP parameters, quantization is performed in the LSP coefficient quantizing portion 4, and the quantized LSP parameters are then converted back into the LPC coefficients. When quantizing these LSP parameters, a vector quantization method is effective in quantizing one bit or less per sample. In this vector quantization method, as shown in FIG. 18, in distortion calculating portion 19, the LSP codevector possessing the least distortion with the LSP parameter vector, to be formed from a plurality of samples of the LSP parameters, is selected from the codebook 20, and its code is transmitted. In this manner, by forming the codebook 20 to conform to the quantization, it is possible to quantize the LSP parameters with small distortion.

However, since both the storage capacity of the codebook 20 and the computational complexity in calculation of the distortion, increase according to the exponential function of the number of quantization bits, it is difficult to achieve quantization of a large number of bits. In this regard, a multistage vector quantization method presents one way in which this problem can be solved. Namely, the codebook 20 is formed from a plurality of codebooks, and in the coding portion in the LSP coefficient quantizing portion 4, the quantization error occurring in the vector quantization of a certain step is used as the input vector in the vector quantization of the next step. In the decoding portion in the LSP coefficient quantizing portion 4, the output vector is then formed by adding a plurality of the LSP codevectors selected from the plurality of the codebooks. In this manner, the vector quantization becomes possible while restricting the storage capacity and computational complexity to realistic ranges. However, in this multistage vector quantization method, a distortion of significant proportion is observed when compared with the ideal onestage vector quantization method.

The reason for the large distortion in this multistage vector quantization method will be explained in the following with reference to FIGS. 19 through 22. Firstly, in order to stably excite the synthesis filter 3 in which the LSP parameter vector is set, the values of the LSP parameters $\omega_1$ through $\omega_p$ forming the LSP parameter vector of dimension p must satisfy the relation given by a formula (2) below.

$$0<\omega_1<\omega_2<\ldots<\omega_p<\pi \quad (2)$$

FIG. 19 shows a case in which second order LSP parameters vector, i.e. p=2, are utilized. The LSP parameters must exist within the stable triangular region A1 shown in FIG. 19 according to the formula (2). In addition, in particular, according to the statistical characteristics of the speech, the expectation of the LSP parameters existing in the inclined region labeled A2 is high.

In the following, the flow of the procedures of the LSP coefficients quantizing portion 4 in the case of performing vector quantization of these LSP parameters will be explained with reference to the flow chart shown in FIG. 20. Furthermore, in order to reduce the storage capacity of the codebook 20, the LSP coding vector is represented as the sum of two vectors. The codebook 20 is thus formed from a first codebook #1 and a second codebook #2. In the coding portion, in step SA1, a 3-bit first codebook #1 similar to the input vector is formed. In this manner, a reconstructed vector V1 shown in FIG. 21, can be obtained. Subsequently, second vector quantization of the quantization error which occurred during quantization in step SA1 is performed. Namely, in step SA2 shown in FIG. 20, the group of the reconstructed vectors V2 existing within the circular region shown in FIG. 22 (i.e. the contents of the second codebook #2) is centrally combined with the reconstructed vector V1, selected through the first vector quantization, thereby forming an output point. As seen from FIG. 22, when two output vectors of codebook #1 and codebook #2 respectively are added, an output point may be formed in a region which did not originally exist. Consequently, in step SA3, a judgment whether the added vector is stable or unstable is made, with unstable vectors being excluded from the process. In step SA4, the distortion of the input vector and the aforementioned reconstructed vector is calculated. Subsequently, in step SA5, a vector is determined which will minimize the aforementioned distortion, and its code is transmitted to the decoding portion in the LSP coefficients quantizing portion 4.

In this manner, in the decoding portion, in step SA6, the codebook #1 is used to determine a first output vector, and in step SA7, a second output vector contained in the codebook #2, is added to this aforementioned first output vector, thereby yielding the final output vector.

Consequently, in the conventional coding processes, as mentioned above there exist problems in that no alternatives exist besides excluding the unstable vector, which leads to wasteful use of information.

SUMMARY OF THE INVENTION

In consideration of the above, it is a first object of the present invention to provide a speech coding method and an apparatus for the same, wherein even in the case where transmission errors occur in the transmission line, high quality speech coding and decoding is possible at a slow coding speed, without being significantly affected by the aforementioned errors. Additionally, it is a second object of the present invention to provide a parameter coding method and an apparatus for the same which, when encoding various types of parameters such as those of spectral envelope information, power information and the like at a slow coding speed, prevents the transmission of coding errors, maintains a comparatively short frame update period, and is able to reduce the quantization distortion by utilizing the time continuity of parameters. Furthermore, it is a third object of the present invention to provide a multistage vector quantization method and an apparatus for the same which is able to suppress rising of the quantization distortion, while keeping the storage capacity of the codebook small.

To satisfy the first object, the present invention provides a speech coding method for coding speech data comprising a plurality of samples as a unit of a frame operation wherein: the plurality of samples of speech data are analyzed by a linear prediction analysis and thereby prediction coefficients are calculated, and quantized; the quantized prediction coefficients are set in a synthesis filter; the synthesized speech vector is synthesized by exciting the synthesis filter with a pitch period vector which is selected from an adaptive codebook in which a plurality of pitch period vectors are stored, and which is multiplied by a first gain, and with a noise waveform vector which is selected from a random codebook in which a plurality of the noise waveform vectors are stored, and which is multiplied by a second gain; and wherein said method comprises choosing said first and second gain at the same time; providing a multiplier of multiplying the selected noise waveform vector by a predicted gain; and predicting said predicted gain which is to be multiplied by the noise waveform vector selected in a subsequent frame operation, and is based on the current noise waveform vector which is multiplied by said predicted gain and said second gain in the current frame operation, and on the previous noise waveform vector which is multiplied by said predicted gain and said second gain in the previous frame operation.

Furthermore, the present invention provides a speech coding apparatus for coding speech data comprising a plurality of samples as a unit of a frame operation wherein: the plurality of samples of speech data are analyzed by a linear prediction analysis and thereby prediction coefficients are calculated and quantized; the quantized prediction coefficients are set in a synthesis filter; the synthetic speech vector is synthesized by exciting the synthesis filter with a pitch period vector which is selected from an adaptive codebook in which a plurality of pitch period vectors are stored, and which is multiplied by a first gain, and with a noise waveform vector which is selected from a random codebook in which a plurality of the noise waveform vectors are stored, and which is multiplied by a second gain; and wherein said apparatus comprises a gain predicting portion for multiplying said selected noise waveform vector by a predicted gain; a gain portion for multiplying said selected pitch period vector and an output vector derived from said gain predicting portion using said first and second gain, respectively, a distortion calculator for respectively selecting said pitch period vector and said noise waveform vector and setting, at the same time, said first and second gain so that a quantization distortion between an input speech vector comprising a plurality of samples of speech data and said synthetic speech vector is minimized; and a gain adaptor for predicting said predicted gain which is to be multiplied by the noise waveform vector selected in the subsequent frame operation, and is based on the current noise waveform vector which is multiplied by said predicted gain and said second gain at the current frame operation, and on the previous noise waveform vector which is multiplied by said predicted gain and said second gain in the previous frame operation.

In accordance with this method and apparatus for the same, even in the case where transmission errors occur in the transmission line, high quality speech coding and decoding is possible at a slow coding speed without being significantly affected by the aforementioned errors.

To satisfy the second object, the present invention provides a parameter coding method of speech for quantizing parameters such as spectral envelope information and power information at a unit of a frame operation comprising a plurality of samples of speech data, wherein said method comprises the steps of, in a coding portion, (a) wherein said parameter is quantized, representing the resultant quantized parameter vector by the weighted mean of a prospective parameter vector selected from a parameter codebook in which a plurality of the prospective parameter vectors are stored in the current frame operation and a part of the prospective parameter vector selected from said parameter codebook in the previous frame operation, (b) selecting said prospective parameter vector from said parameter codebook so that a quantization distortion between said quantized parameter vector and an input parameter vector, is minimized, and (c) transmitting a vector code corresponding to the selected prospective parameter vector; and in a decoding portion, (a) calculating the weighted mean of the prospective parameter vector selected from said parameter codebook in the current frame operation corresponding to the transmitted vector code and the prospective parameter vector in the previous frame operation, and (b) outputting the resultant vector.

Moreover, the present invention provides a parameter coding apparatus of speech for quantizing parameters such as spectral envelope information and power information as a unit of a frame operation comprising a plurality of samples of speech data, wherein said apparatus comprises a coding portion comprising, (a) a parameter codebook for storing a plurality of prediction parameter vectors, and (b) a vector quantization portion for calculating the weighted mean of the prospective parameter vector selected from said parameter codebook in the current frame operation, the part of the prospective parameter vector selected from said parameter codebook in the previous frame operation, using the resultant vector as the resultant quantized parameter vector of the quantization of prediction coefficients, selecting said prospective parameter vector from said parameter codebook so that a quantization distortion between said quantized parameter vector and an input parameter vector is minimized, and transmitting a vector code corresponding to the selected prospective parameter vector; and a decoding portion for calculating the weighted mean of the prospective parameter vector selected from said parameter codebook in the current frame operation corresponding to the transmitted vector code and the prospective parameter vector in the previous frame operation, and outputting the resultant vector.

In accordance with this method and apparatus for the same, the coding portion represents the resultant quantized parameter vector by the weighted mean of the prospective parameter vector selected from the parameter codebook in the current frame operation and the part of the prospective parameter vector selected from the parameter codebook in the previous frame operation. Then the coding portion selects the prospective parameter vector from the parameter codebook so that the quantization distortion between the quantized parameter vector and the input parameter vector is minimized. Furthermore, the coding portion transmits the vector code corresponding to the selected prospective parameter vector. Moreover the decoding portion calculates the weighted mean of the prospective parameter vector selected from the parameter codebook in the current frame operation corresponding to the transmitted vector code, and the prospective parameter vector in the previous frame operation, and outputs the resultant vector.

According to the present invention, since only the code corresponding to one parameter codebook is transmitted to each frame, even if the frame length is shortened, the amount of transmitted information remains small. Additionally, the quantization distortion may be reduced when the continuity with the previous frame is high. As well, even in the case where the coding errors occur, since the prospective parameter vector in the current frame operation is equalized with one in the previous frame operation, the effect of the coding errors is small. Moreover, the effect of coding errors in the current frame operation can only extend up to two frames operation fore. If coding errors can be detected using a redundant code, the parameter with errors is excluded, and by calculating the mean described above, the effect of errors can also be reduced.

To satisfy the third object, the present invention provides a multistage vector quantizing method for selecting the prospective parameter vector from a parameter codebook so that the quantization distortion between the prospective parameter vector and an input parameter vector becomes minimized, a vector code corresponding to the selected prospective parameter vector is transmitted, and wherein said method comprises the steps of, in a coding portion, (a) representing said prospective parameter vector by the sum of subparameter vectors respectively selected from stages of the subparameter codebooks, (b) respectively selecting subparameter vectors from stages of said subparameter codebooks, (c) adding subparameter vectors selected to obtain the prospective parameter vector in the current frame operation, (d) judging whether or not said prospective parameter vector in the current frame operation is stable, (e) converting said prospective parameter vector into a new prospective parameter vector so that said prospective parameter vector in the current frame operation becomes stable using the fixed rule in the case where said prospective parameter vector in the current frame operation is not stable, (f) selecting the prospective parameter vector from said parameter codebook so that said quantization distortion is minimized, and (g) transmitting a vector code corresponding to the selected prospective parameter vector; and in said decoding portion, (a) respectively selecting subparameter vectors corresponding to the transmitted vector code from stages of said subparameter codebooks, (b) adding the selected subparameter vectors to obtain the prospective parameter vector in the current frame operation, (c) judging whether or not said prospective parameter vector in the current frame operation is stable, (d) converting said prospective parameter vector into a new prospective parameter vector so that said prospective parameter vector in the current frame operation becomes stable using the fixed rule in the case where said prospective parameter vector in the current frame operation is not stable, and (e) using the converted prospective parameter vector as final prospective parameter vector in the current frame operation.

Furthermore, the present invention provides a multistage vector quantizing apparatus for selecting the prospective parameter vector from a parameter codebook so that the quantization distortion between the prospective parameter vector and an input parameter vector becomes minimized, and transmitting a vector code corresponding to the selected prospective parameter vector, wherein said apparatus comprises said parameter codebook comprising stages of subparameter codebooks in which subparameter vectors are respectively stored, a coding portion comprising a vector quantization portion for respectively selecting subparameter vectors from stages of said subparameter codebooks, and adding the selected subparameter vectors to obtain the prospective parameter vector in the current frame operation, judging whether or not said prospective parameter vector in the current frame operation is stable, converting said prospective parameter vector into a new prospective parameter vector so that said prospective parameter vector in the current frame operation becomes stable using the fixed rule in the case where said prospective parameter vector in the current frame operation is not stable, selecting the prospective parameter vector from said parameter codebook so that said quantization distortion is minimized, and transmitting a vector code corresponding to the selected prospective parameter vector; and a decoding portion for respectively selecting subparameter vectors corresponding to the transmitted vector code from stages of said subparameter codebooks, adding the selected subparameter vectors to obtain the prospective parameter vector in the current frame operation, judging whether or not said prospective parameter vector in the current frame operation is stable, converting said prospective parameter vector into a new prospective parameter vector so that said prospective parameter vector in the current frame operation becomes stable using the fixed rule in the case where said prospective parameter vector in the current frame operation is not stable, and using the converted prospective parameter vector as a final prospective parameter vector in the current frame operation.

According to this method and apparatus for the same, from the second stage of the multistage vector quantization, the output point is examined to determine whether or not it is the probable output point (determining whether it is stable or unstable). In the case where an output vector in the region which dose not originally exist is detected, this vector is converted into a new output vector in the region which always exist using the fixed rule, and then quantized. In this manner, unselected combinations of codes are eliminated, and the quantization distortion may be reduced.

In addition, according to the present invention, unstable, useless output vectors occurring after the first stage of the multistage vector quantization are converted using the fixed rule, into effective output vectors which may then be used. As a result, advantages such as a greater reduction of the quantization distortion from an equivalent amount of information, as compared with the conventional methods may be obtained.

BRIEF EXPLANATION OF THE DRAWINGS

FIG. 1 (B) is a block diagram showing a part of a construction of a speech coding apparatus according to a preferred embodiment of the present invention.

DETAILED DESCRIPTION OF THE PREFERRED EMBODIMENTS

Figure 1A:
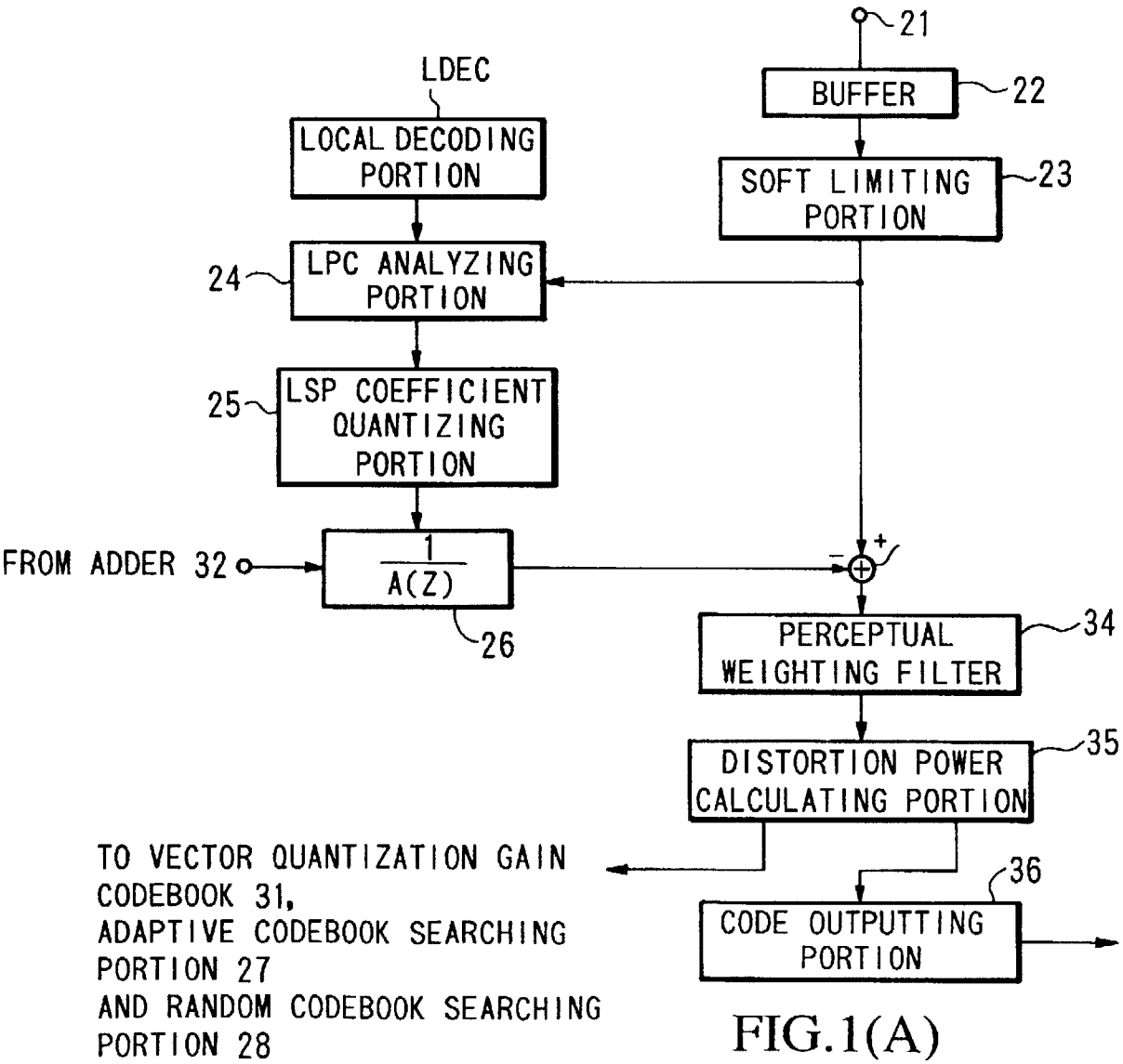
FIG. 1 (A) is a block diagram showing a part of a construction of a speech coding apparatus according to a preferred embodiment of the present invention.
Figure 1B:
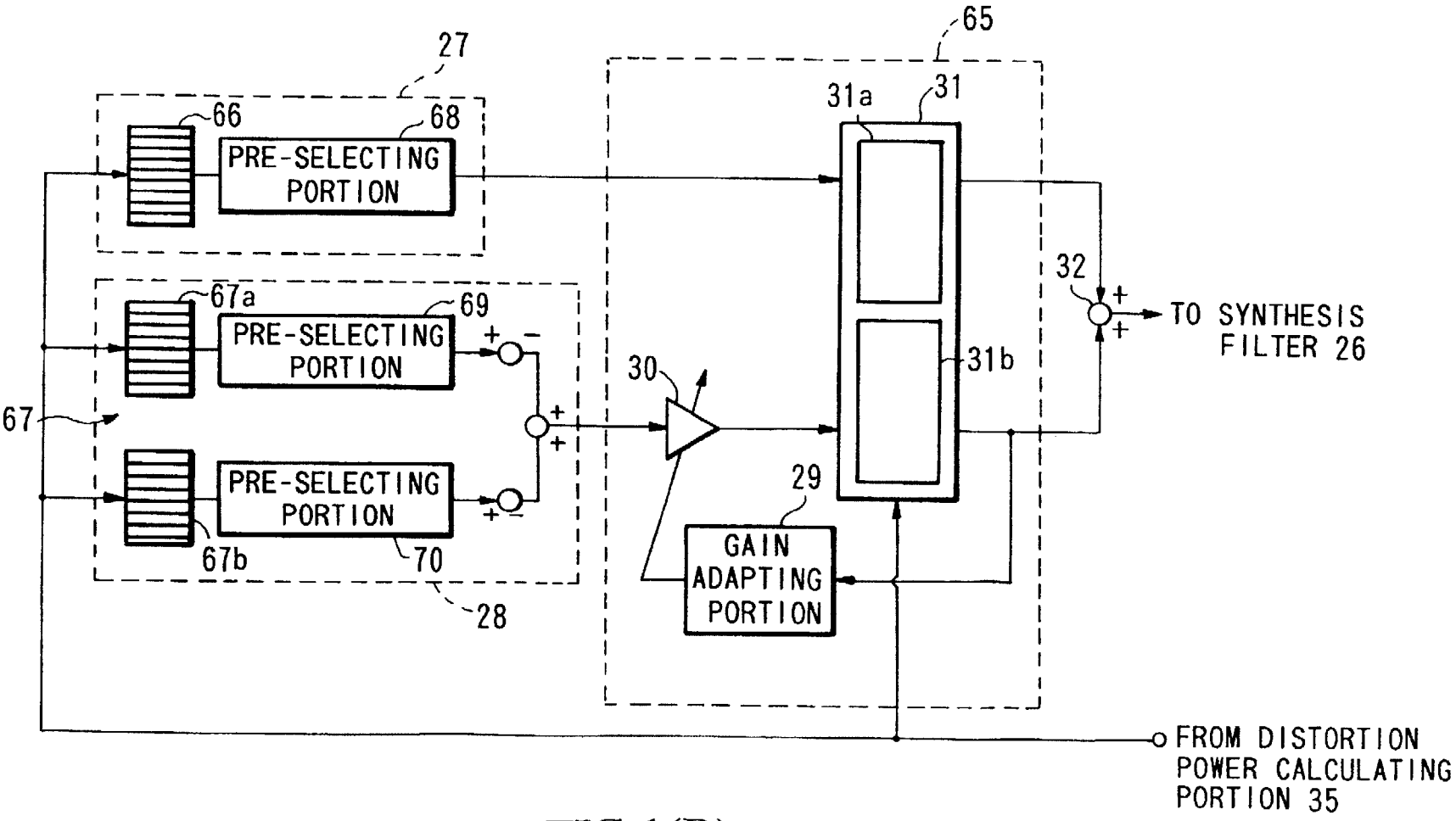

In the following, a detailed description of the preferred embodiments will be given with reference to the figures. FIGS. 1 (A) and (B) are block diagrams showing a construction of a speech coding apparatus according to a preferred embodiment of the present invention. An outline of a speech coding method will now be explained with reference to FIGS. 1(A) and 1(B). The input speech data formed by sampling the analog speech signal at a sampling frequency of 8 kHz is inputted from an input terminal 21. Eighty samples are then obtained as one frame in one vector and stored in a buffer 22 as an input speech vector. The frame is then further divided into two subframes, each comprising a unit of forty samples. All processes following this will be conducted in frame units or subframe units.

In a soft limiting portion 23, the magnitude of the input speech vector outputted from the buffer 22 is checked using a frame unit, and in the case where the absolute value of the magnitude of the input speech vector is greater than a previously set threshold value, compression is performed. Subsequently, in an LPC analyzing portion 24, linear prediction analysis is performed and the LPC coefficients are calculated for the input speech data of the plurality of samples outputted from the soft limiting portion 23. Following this, in an LSP coefficient quantizing portion 25, the LPC coefficients are quantized, and then set into a synthesis filter 26.

A pitch period vector and a noise waveform vector selected by a distortion power calculating portion 35 are outputted from an adaptive codebook searching portion 27 and a random codebook searching portion 28, respectively, and the noise waveform vector is then multiplied by the predicted gain set by to a gain adapting portion 29 in a predicted gain portion 30.

In the gain adapting portion 29, linear prediction analysis is performed based on the power of the output vector from a vector quantization gain codebook 31 in the current frame operation, and the stored power of the output vector of the random codebook component of the vector quantization gain codebook 31 which was used in the previous frame operation. The power (namely the predicted gain) to be multiplied by the noise waveform vector selected in the subsequent frame operation is then calculated, determined and set into the predicted gain portion 30.

Subsequently, the selected pitch period vector and the output vector of the predicted gain portion 30 is determined in the distortion power calculating portion 35, multiplied, in subgain codebooks 31*a* and 31*b* of the vector quantization gain codebook 31, by the gains selected from these subgain codebooks 31*a* and 31*b*, and then outputted. In this manner, the output vectors of the subgain codebooks 31*a* and 31*b* are summed in an adder 32, and the resultant output vector of the adder 32 is supplied as an excitation vector to the synthesis filter 26. The synthetic speech vector is then synthesized in the synthesis filter 26.

Next, in a subtracter 33, the synthetic speech vector is subtracted from the input speech vector, and the distortion data is calculated. After this distortion data is weighted in a perceptual weighting filter 34 according to the coefficients corresponding to human perceptual characteristics, the power of the distortion data outputted from the perceptual weighting filter 34 is calculated in the distortion power calculating portion 35. Following this, the pitch period vector and noise waveform vector, which will minimize the aforementioned power of the distortion data, are selected respectively from the adaptive codebook searching portion 27 and the noise codebook searching portion 28, and the gains of the subgain codebooks 31*a* and 31*b* are then designated. In this manner, in a code outputting portion 36, the respective codes and gains selected according to the LPC coefficients, the pitch period vector and the noise waveform vector are then converted into codes of bit series, and when necessary, error correction codes are added and then transmitted. In addition, the local decoding portion LDEC, in order to prepare for the process of the subsequent frame in the coding apparatus of the present invention, uses the same data as that outputted and transmitted from each structural component shown in FIG. 1 to the decoding apparatus, and synthesizes a speech decoding vector.

In the following, the operations of the LSP coefficient quantizing portion 25 will be explained in greater detail. In the LPC coefficients quantizing portion 25, the LPC coefficients obtained in the LPC analyzing portion 24 are first converted to LSP parameters, quantized, and these quantized LSP parameters are then converted back into the LPC coefficients. The LPC coefficients obtained by means of this series of processes, are thus quantized; LPC coefficients may be converted into LSP parameters using, for example, the Newton-Raphson method. Since a short frame length of 10 ms and a high correlation between each frame, by utilizing these nature, a quantization of the LSP parameters is performed using a vector quantization method. In the present invention, the LSP parameters are represented by a weighted mean vector calculated from a plurality of vectors of past and current frames. In the conventional differential coding and prediction coding methods, the output vectors in the past frame operation are used without variation; however, in the present invention, among the vectors formed through calculation of the weighted mean, only vectors updated in the immediately preceding frame operation are used. Furthermore, in the present invention, among the vectors formed through calculation of the weighted mean, only vectors unaffected by coding errors and vectors in which coding errors have been detected and converted are used. In addition, the present invention is also characterized in that the ratio of the weighted mean is either selected or controlled.

Figure 2:
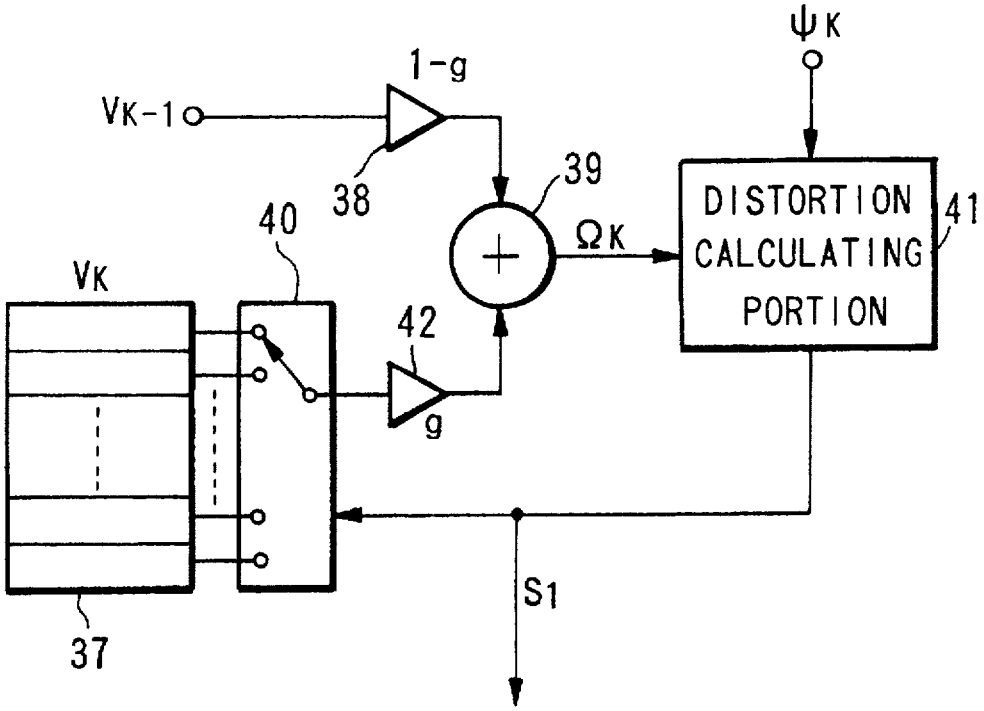
FIG. 2 is a block diagram showing a first construction of a vector quantization portion applied to a parameter coding method according to a preferred embodiment of the present invention.

FIG. 2 shows a first construction of a vector quantizing portion provided in the LPC coefficients quantizing portion 25. An LSP codevector $V_{k-1}$ (k is the frame number), produced from a LSP codebook 37 in the frame operation immediately preceding the current frame operation, is multiplied in a multiplier 38 by a multiplication coefficient (1−g), and then supplied to one input terminal of an adder 39. A mark g represents a constant which is determined by the ratio of the weighted mean.

An LSP codevector $V_k$ produced from the LSP codebook 37 in the current frame operation is supplied to each input terminal of a transfer switch 40. This transfer switch 40 is activated in response to the distortion calculation result by a distortion calculating portion 41. The selected LSP codevector $V_k$ is first multiplied by the multiplication coefficient g in a multiplier 42, and then supplied to the other input terminal of the adder 39. In this manner, the output vectors of the multipliers 38 and 42 are summed in the adder 39, and the quantized LSP parameter vector $\Omega_k$ of the frame number k is then outputted. Specifically, this LSP parameter vector $\Omega_k$ may be expressed by the following formula (3).

$$\Omega_k=(1-g)V_{k-1}+gV_k \tag{3}$$

Figure 23:
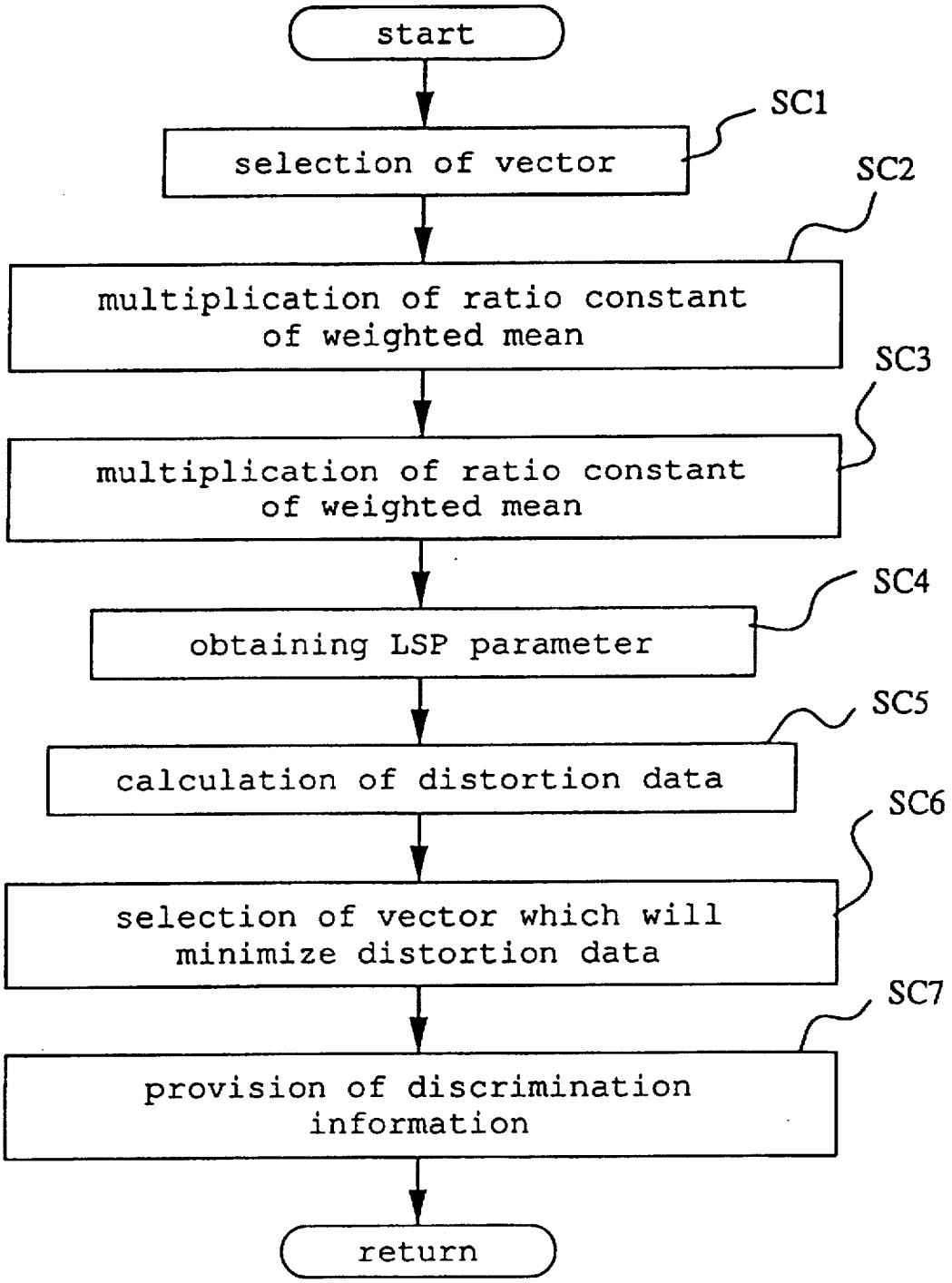
FIGS. 23–27 are flow charts for use in explaining multistage vector quantization methods according to alternative embodiments of the present invention.

Subsequently, in the distortion calculating portion 41, the distortion data between an LSP parameter vector $\Psi_k$ of the frame number k before quantization and the LSP parameter vector $\Omega_k$ of the frame number k following quantization, is calculated, and the transfer switch 40 is activated such that this distortion data is minimized. In this manner, the code for the LSP codevector $V_k$ selected by the distortion calculator 41 is outputted as a code $S_1$. Furthermore, the LSP codevector $V_k$ produced from the LSP codebook 37 in the current frame operation is employed in the subsequent frame operation as an LSP codevector $V_{k-1}$, which is produced from the LSP codebook 37 in the previous frame operation FIG. 23 shows a flowchart where steps SC1–SC7 portray the operation of the vector quantizing portion described above and shown in FIG. 2.

Figure 3A:
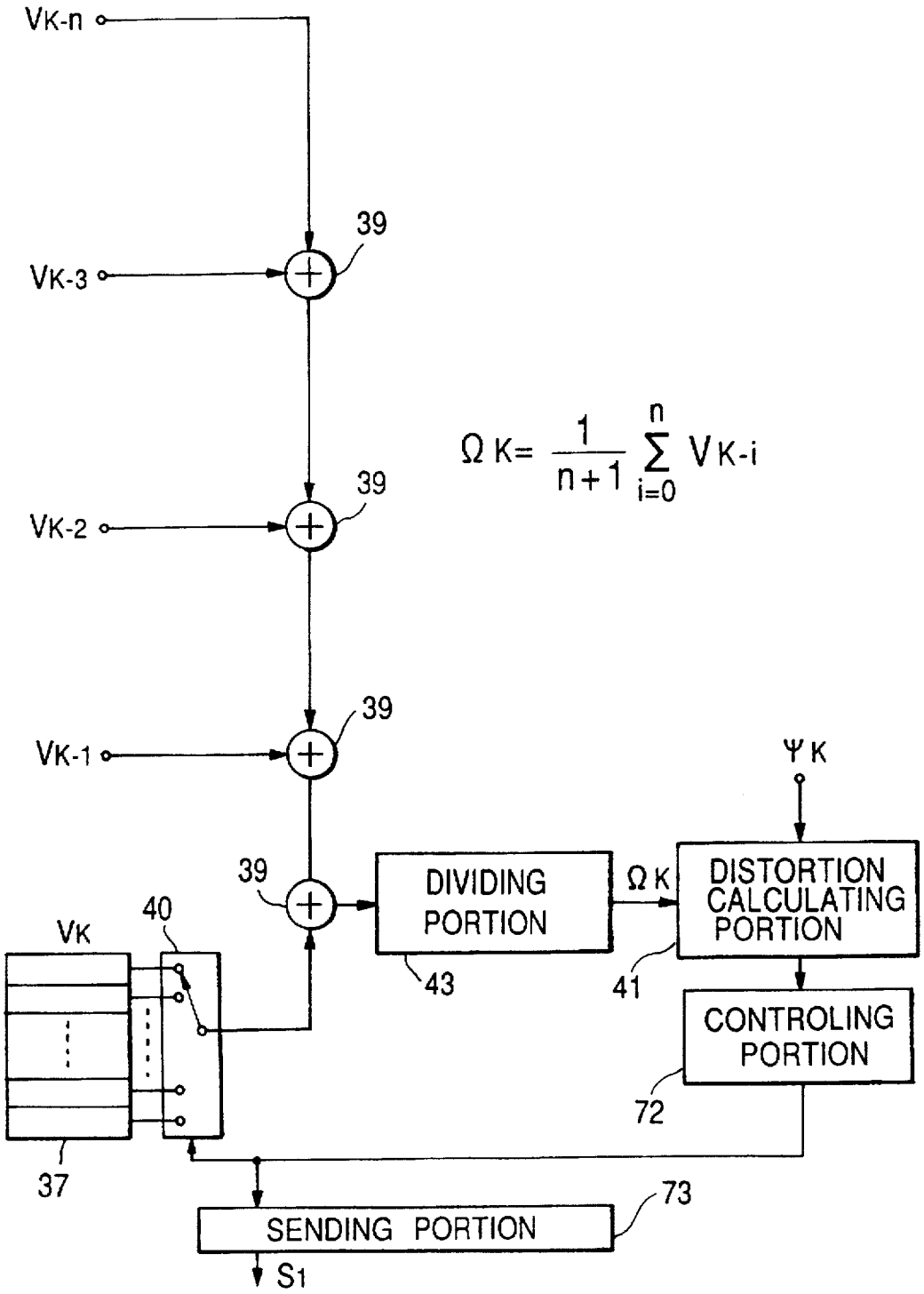
FIG. 3(A) is a block diagram showing a second construction of a vector quantization portion applied to a parameter coding method according to a preferred embodiment of the present invention.
Figure 3B:
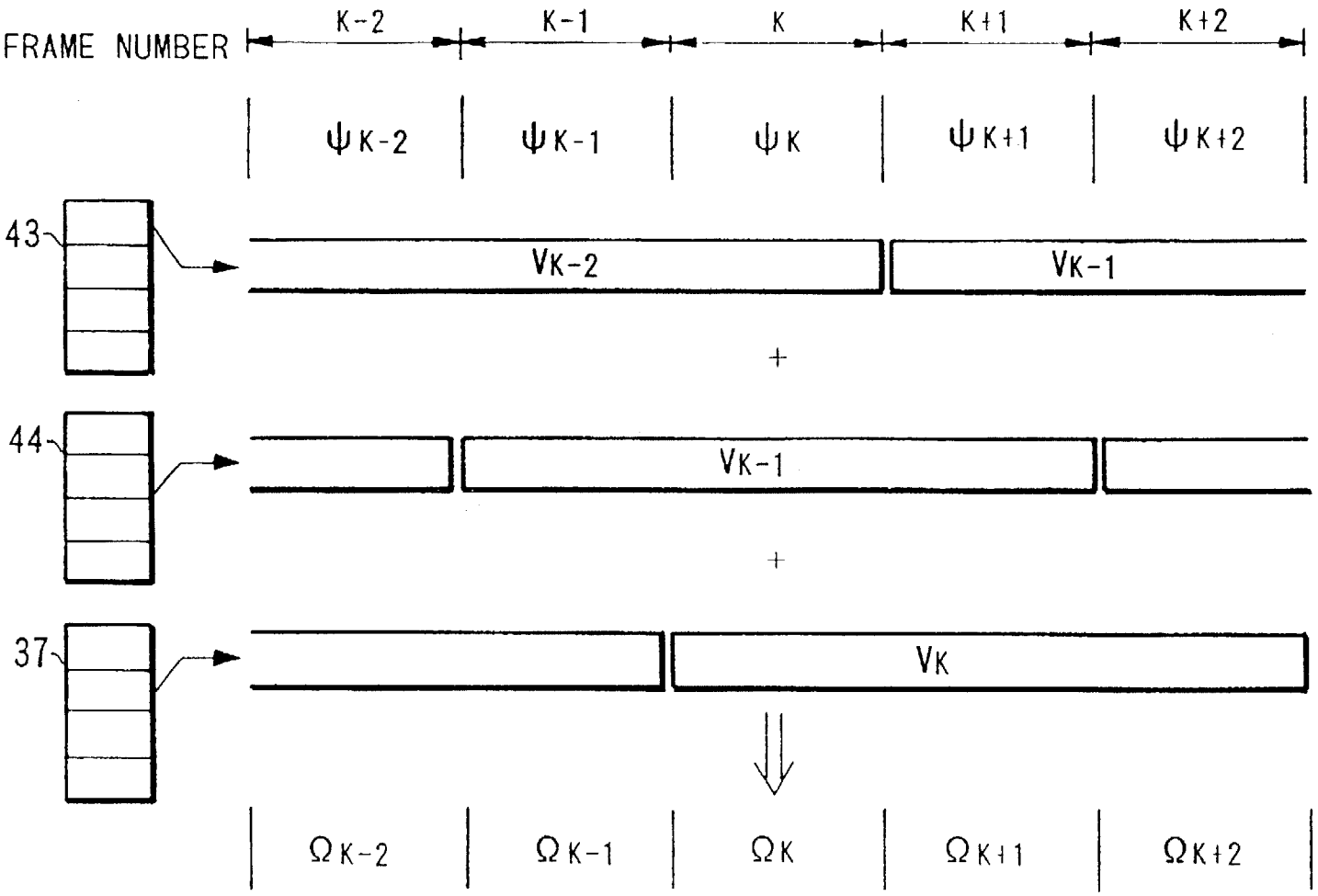
FIG. 3(B) is a reference diagram for use in explaining an example of the operation of the vector quantization portion shown in FIG. 3(A).

In the following, an LSP parameter vector quantization method which used the two LSP codevectors produced respectively from two LSP codebooks in the two frames operation preceding the current frame operation, will now be explained with reference to FIGS. 3A and 3B. FIG. 3(B) shows the case wherein n=2 in FIG. 3(A). In this method, three types of codebooks 37, 43, and 44 are used corresponding to the frame number. The quantized LSP parameter vector $\Omega_k$ may be calculated using a mean of three vectors in the frames in formula (4) below.

$$\Omega_k=\frac{V_{k-2}+V_{k-1}+V_k}{3} \tag{4}$$

Figure 24:
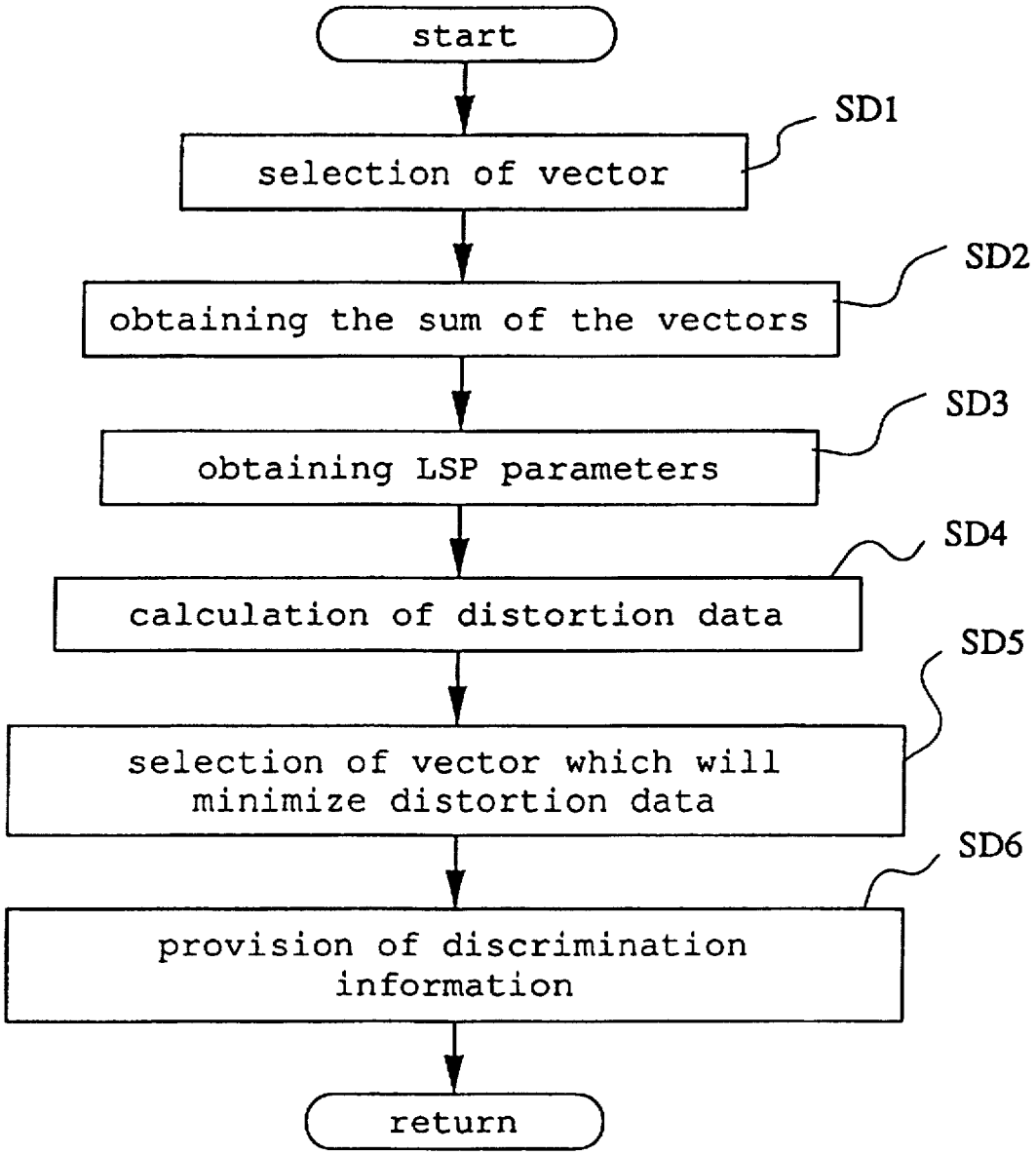

An LSP codevector $V_{k-2}$ represents the LSP codevector produced from the LSP codebook 43 in the two frame operations prior to the current frame operation, while an LSP codevector $V_{k-1}$ represents the LSP codevector produced from the LSP codebook 44 in the frame operation immediately preceding the current frame operation. As the LSP codevector $V_k$ in the operation of the frame k, an LSP codevector, which will minimize the distortion data between the LSP parameter vector $\Psi_k$ of the frame number k before quantization and the LSP parameter vector $\Omega_k$ of the frame number k (the kth frame) following quantization, is selected from the LSP codebook 37. The code corresponding to the selected LSP codevector $V_k$ is then outputted as the code S1. The LSP codevector $V_{k-1}$ may also be used in the subsequent frame operation, and similarly the LSP codevector $V_k$ may be used in the next two frame operations. In addition, although the LSP codevector $V_k$ may be determined at the kth frame operation, if this decision may be delayed, the quantization distortion can be reduced when this decision is delayed in consideration of the LSP parameter vectors $\Omega_{k+1}$ and $\Omega_{k+2}$, appearing in the subsequent frame and two frame operations later. FIG. 24 shows a flowchart where steps SD1–SD6 portray the operation of the LSP parameter vector quantization method described with reference to FIGS. 3A and 3B.

Figure 4A:
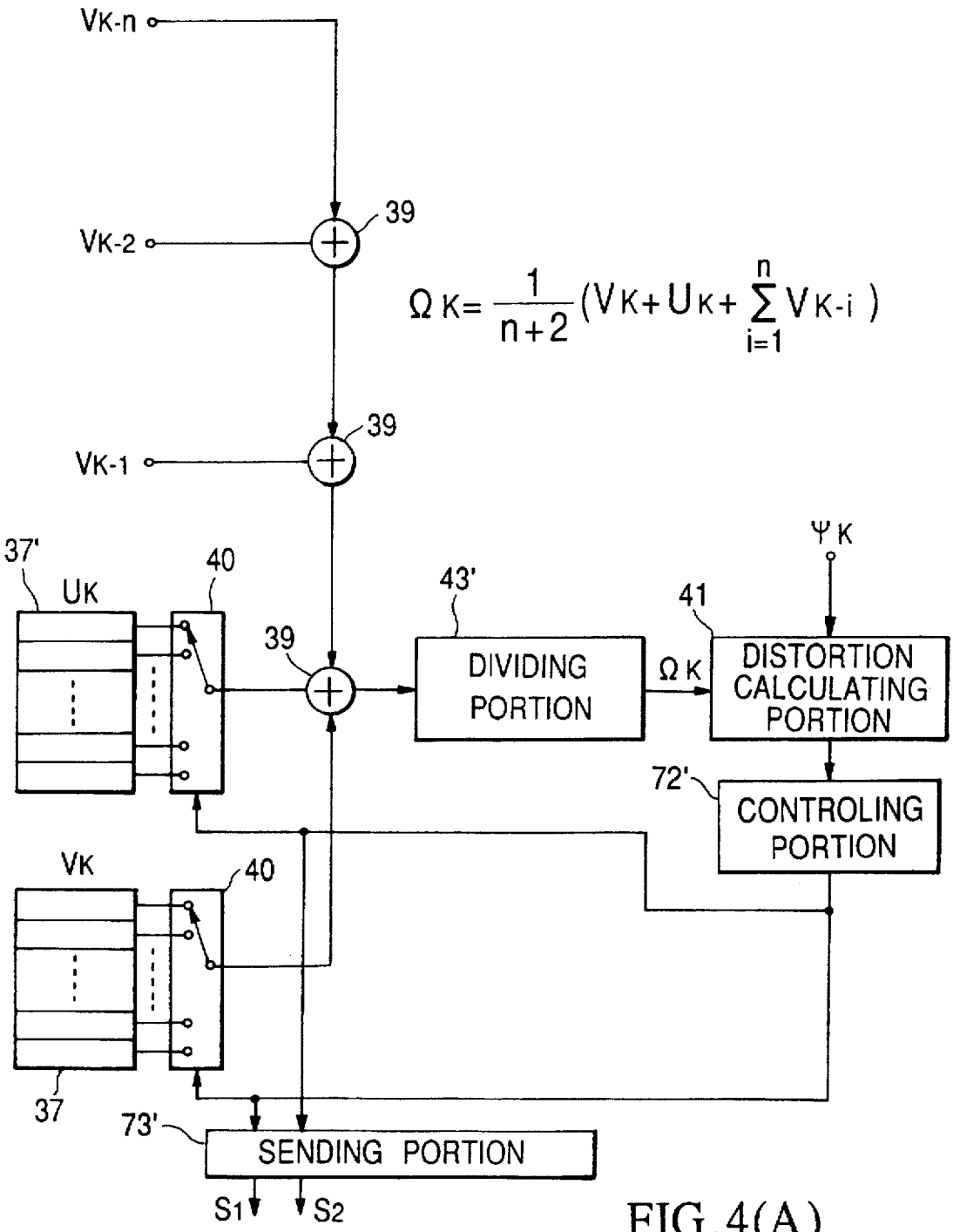
FIG. 4(A) is a block diagram showing a third construction of a vector quantization portion applied to a parameter coding method according to a preferred embodiment of the present invention.
Figure 4B:
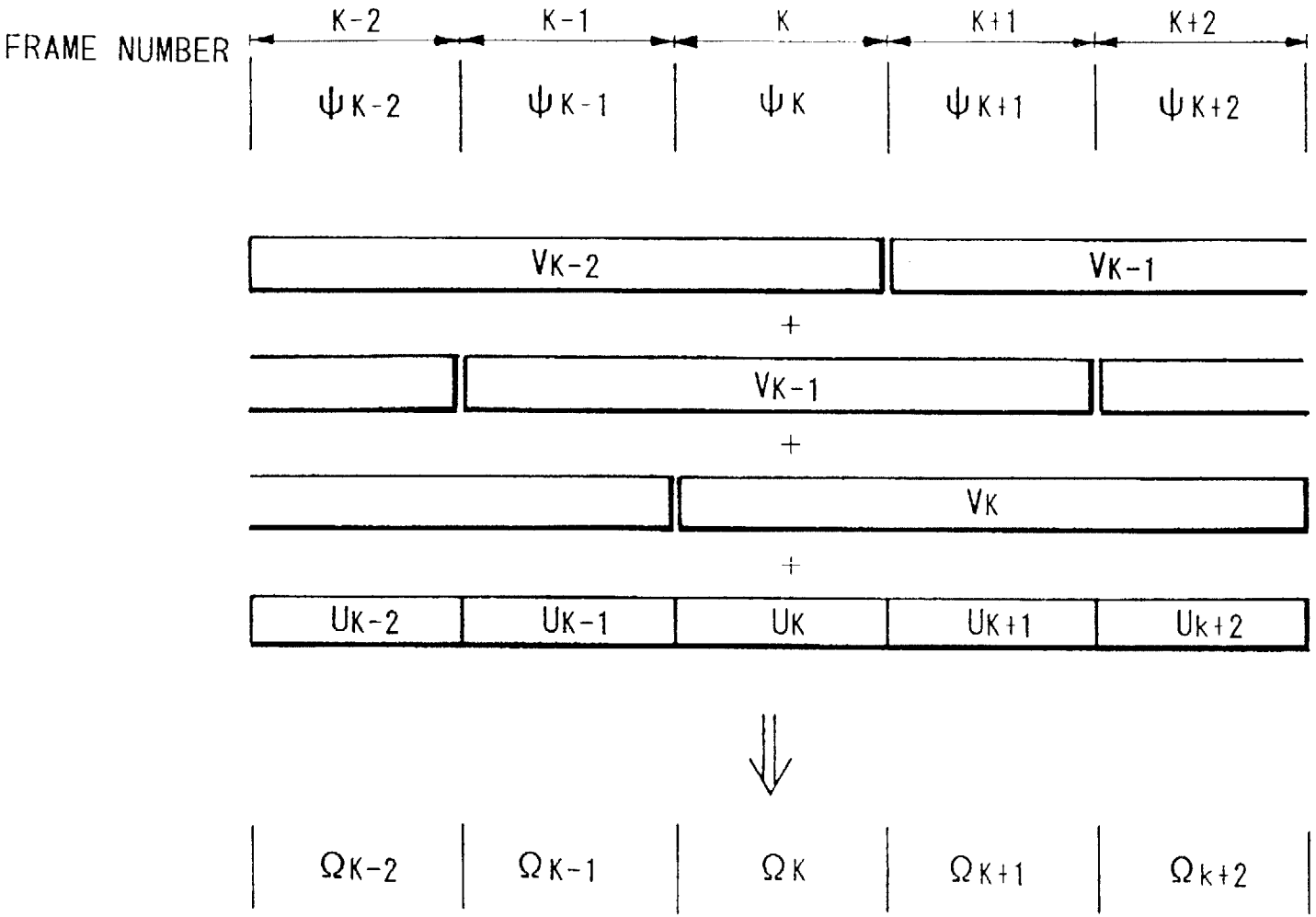
FIG. 4(B) is a reference diagram for use in explaining an example of the operation of the vector quantization portion shown in FIG. 4(A).

Another example of an LSP parameter vector quantization method which uses the two LSP coding vectors produced respectively from two LSP codebooks in the two frame operations preceding the current frame operation, will now be explained with reference to FIGS. 4(A) and 4(B). FIG. 4(B) shows the case wherein n=2 in FIG. 4(A). This vector quantization method is similar to the vector quantization method shown in FIGS. 3(A) and 3(B), however, the quantized LSP parameter vector $\Omega_k$ of the frame number k is expressed using the following formula (5).

$$\Omega_k = \frac{V_{k-2} + V_{k-1} + V_k + U_k}{4} \tag{5}$$

Figure 25:
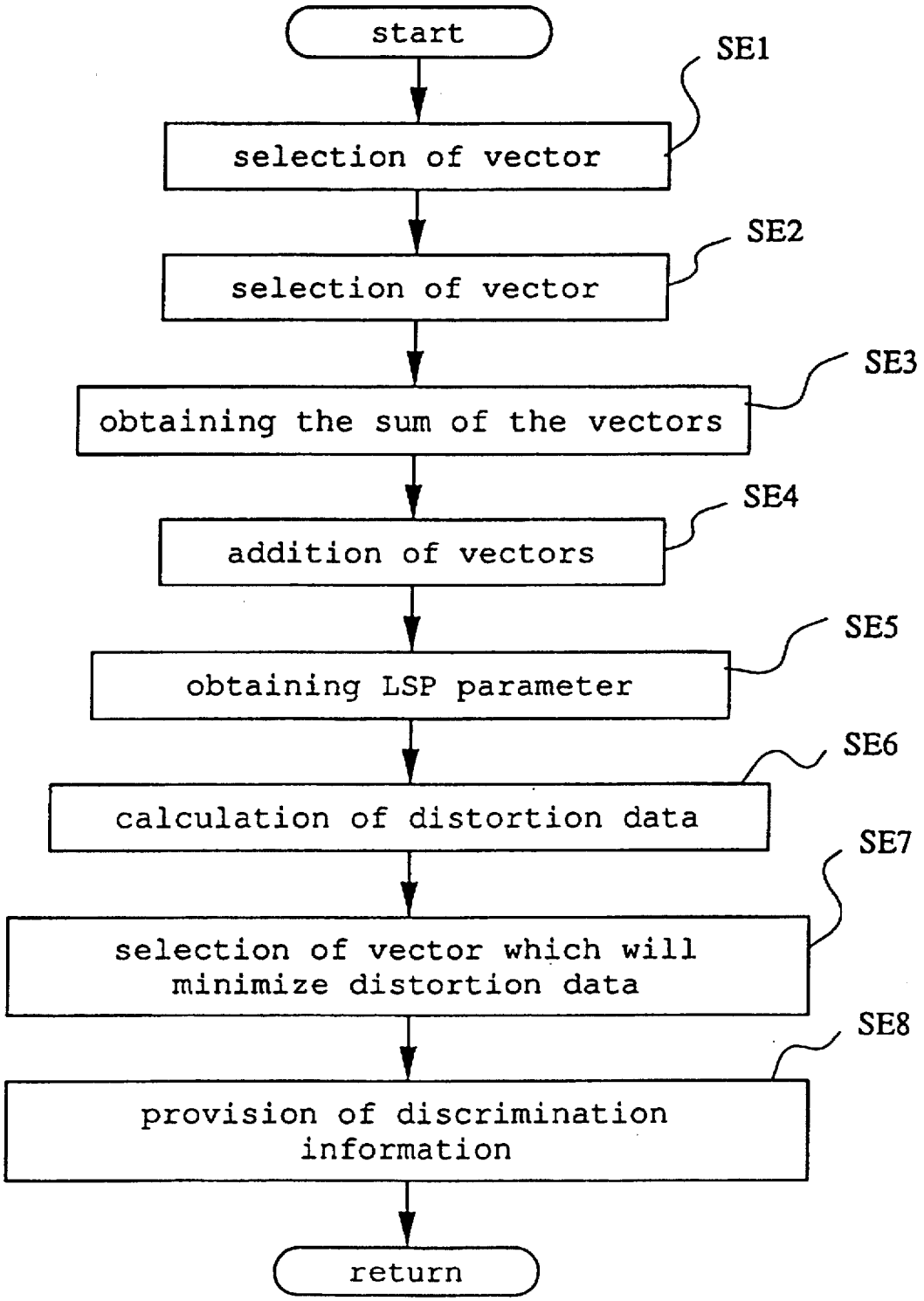

In this case, LSP coding vectors $V_k$ and $U_k$ are determined in the kth frame operation, and their codes are then transmitted. The LSP codevector $U_k$ is the output vector of an additional LSP codebook. FIG. 25 shows a flowchart where steps SE1–SE8 portray the operation of the LSP parameter vector quantization method described with reference to FIG. 4.

Furthermore, in the examples shown in FIGS. 3(A) through 4(B) above, the codebooks 37, 43, and 44 are presented separately; however, it is also possible for these codebooks to be combined into one common codebook as well. Additionally, in the vector quantization methods shown in FIGS. 2 through 4(B) above, the ideal LSP parameter vector $\Psi_k$ is previously provided, and a method is employed which determines the LSP parameter vector $\Omega_k$ quantized using the mean calculated in the parameter dimensions. However, in regard to the LSP parameters, there exists a method for determining the LSP parameters of the current frame by analyzing a plurality of times the distortion data outputted from an inverse filter, in which the LSP parameters determined in a previous frame operation is set. In addition, in the parameter mean calculation method, the mean calculated from the coefficients of the polynomial expressions of the individual synthesis filters becomes the final synthesis filter coefficients. In the case of the methods following the multiple analysis, the product of the terms of the individual polynomial expressions becomes the final synthesis filter polynomial expression.

In the following, a vector quantization method will be explained in which increases in the distortion, in particular from coding errors occurring in the transmission line, can be suppressed. In this vector quantization method, the LSP codevector is selected so that the distortion data between an expected value $\Omega^*_k$ in the local decoding portion LDEC in consideration for a coding error rate, instead of the output vector, the LSP parameter vector $\Omega_k$ in FIG. 2, and the input vector, the LSP parameter vector $\Psi_k$ are minimized. This expected value $\Omega^*_k$ may be estimated using formula (6) below.

$$\Omega_k = (1-m\epsilon)\Omega_k + \Sigma\epsilon\Omega_l \tag{6}$$

In the formula (6), $\epsilon$ represents the coding error rate in the transmission line (a 1 bit error rate), and m represents the transmission bit number per a vector). In addition, in the formula (6), $\Omega_e$ erepresents m types of vectors which are outputted in the case where an error occurs in only one bit of m pieces of the transmission line codes corresponding to the LSP parameter vector $\Omega_k$ and a second term of the righthand side of the equation represents the sum of these m types of vectors $\Omega_e$.

Figure 5:
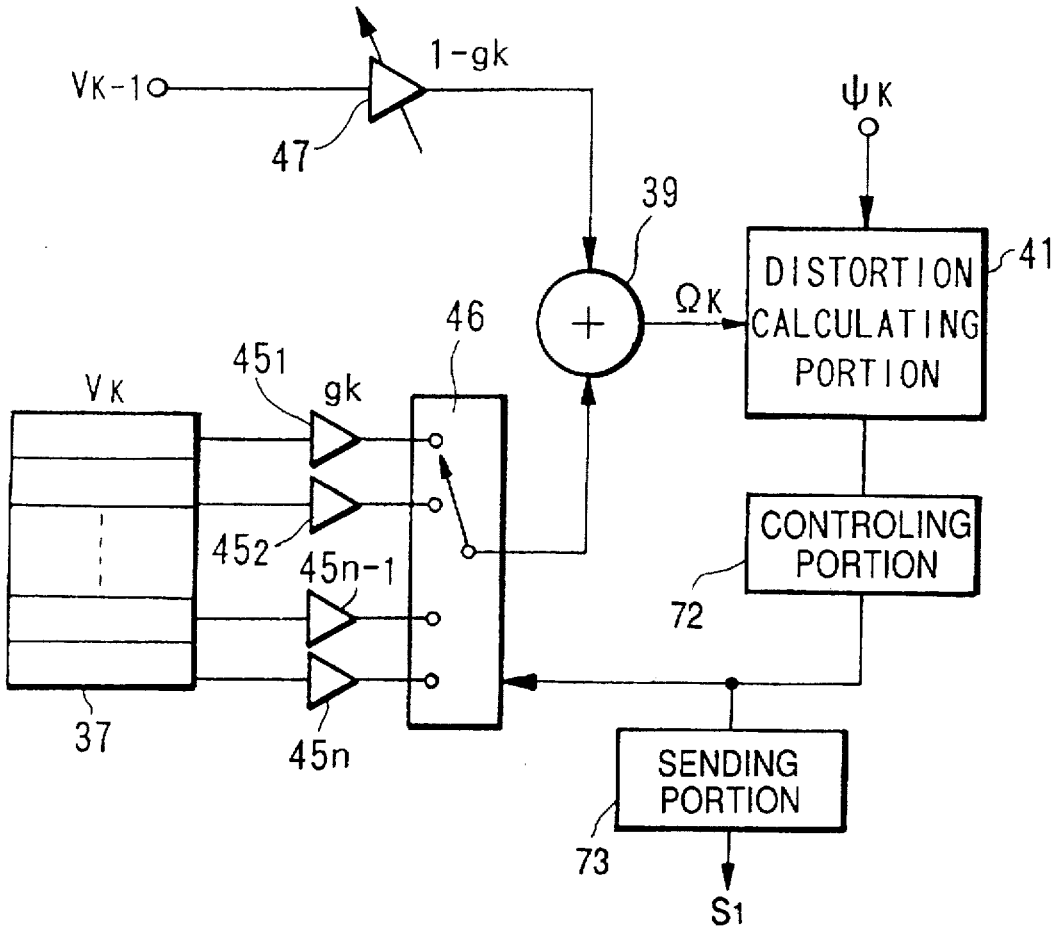
FIG. 5 is a block diagram showing a fourth construction of a vector quantization portion applied to a parameter coding method according to a preferred embodiment of the present invention.
Figure 26:
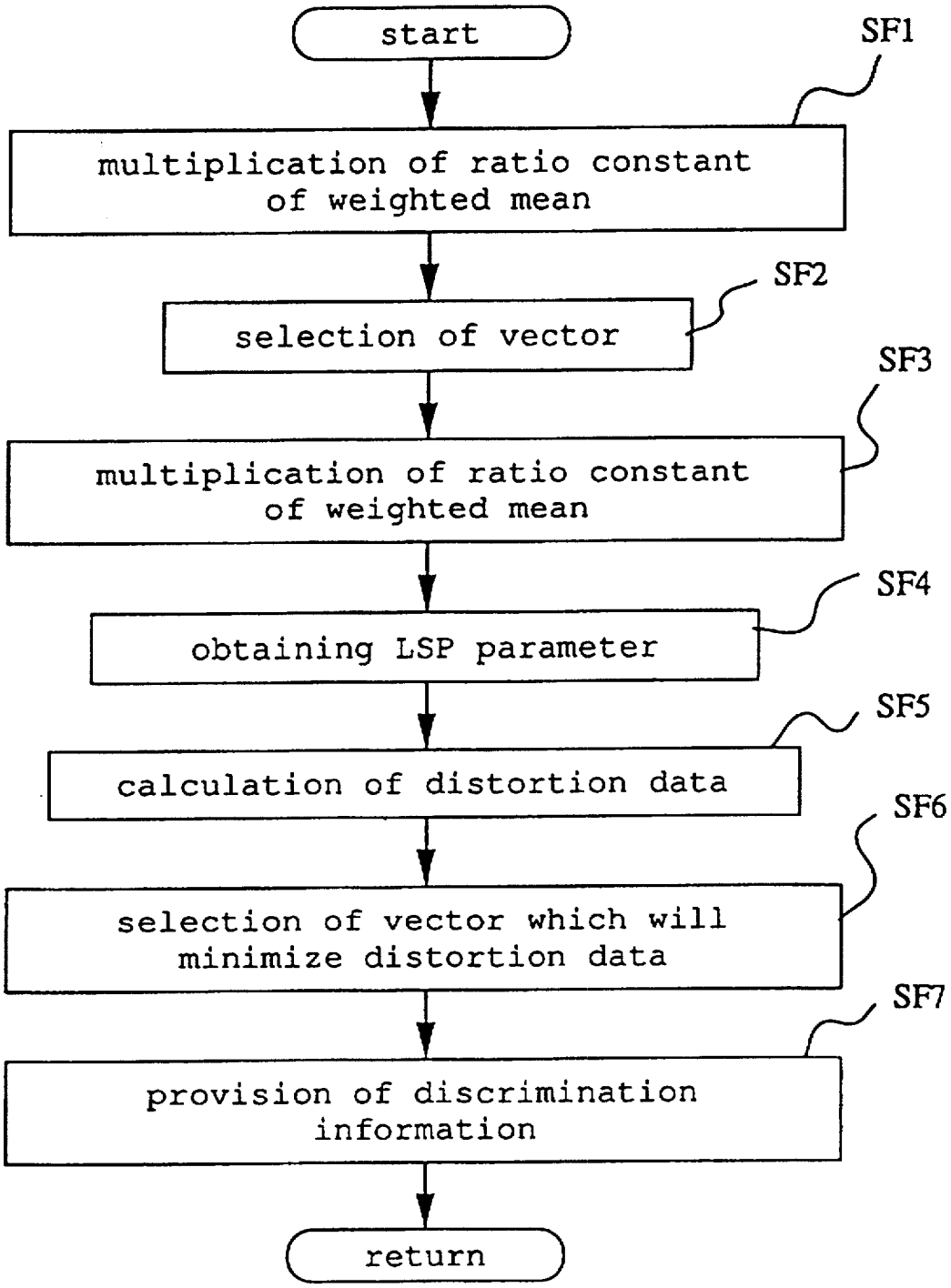

In FIG. 5, a second construction of a vector quantization portion provided in the LPC coefficients quantizing portion 25 is shown. In this FIG. 5, components which correspond to those shown in FIG. 2, will retain the original identifying numeral, and their description will not herein be repeated. In this vector quantization portion, a constant g determined from the ratio of the weighted mean is not fixed, rather a ratio constant $g_k$ is designated according to each LSP code $V_k$ stored in the LSP codebook 37. In FIG. 5, each LSP codevector $V_k$ outputted from the LSP codebook 37 is multiplied by the appropriate multiplication coefficient $g_1$, $g_2$, . . . , $g_{n-1}$, $g_n$ in multipliers $45_1$, $45_2$, $45^{n-1}$, $45^n$, into which each individual ratio constant $g_k$ (k=0, 1, . . . , n) has been set, and then supplied to each input terminal of the transfer switch 46. FIG. 26 shows a flowchart where steps SF1–SF7 portray the operation of the vector quantization portion described above and shown in FIG. 5.

The distortion calculating portion 41 is constructed in a manner such that the LSP codevector $V_k$, which will minimize the distortion data between the quantized LSP parameter vector $\Omega_k$ outputted from the adder 39 and the LSP parameter vector $\Psi_k$ before quantization, are selected by transferring the transfer switch 46, and the corresponding multiplication coefficient $g_k$ are selected. In addition, the aforementioned construction is designed such that the ratio $(1-g_k)$ supplied to the multiplier 47 is interlocked and changed by means of the transfer switch 46.

In this manner, the quantized LSP parameter vector $\Omega_k$ may be expressed using the following formula (7).

$$\Omega_k = (1-g_k)V_{k-1} + g_k V_k \tag{7}$$

In formula (7), the multiplication coefficient $g_k$ is a scalar value corresponding to the LSP codevector $V_k$; however, it is also possible to assemble a plurality of the LSP codevectors as one group, and have this scalar value correspond to each of these types of groups. In addition, it is also possible to proceed in the opposite manner by setting the multiplication coefficient at each component of the LSP codevector. In either case, the LSP codevector $V_{k-1}$ produced from the LSP codebook 37 in the previous frame operation is given, and in order to minimize the distortion data between the quantized LSP parameter vector $\Omega_k$ and the LSP parameter vector $\Psi_k$ before quantization, the most suitable combination of the ratio $g_k$ which is the ratio of the weighted mean between the LSP codevector $V_k$ produced from the LSP codebook 37 in the current frame operation and the LSP codevector $V_{k-1}$ produced from the LSP codebook 44 in the previous frame operation, and the LSP codevector $V_k$, is selected.

Figure 6:
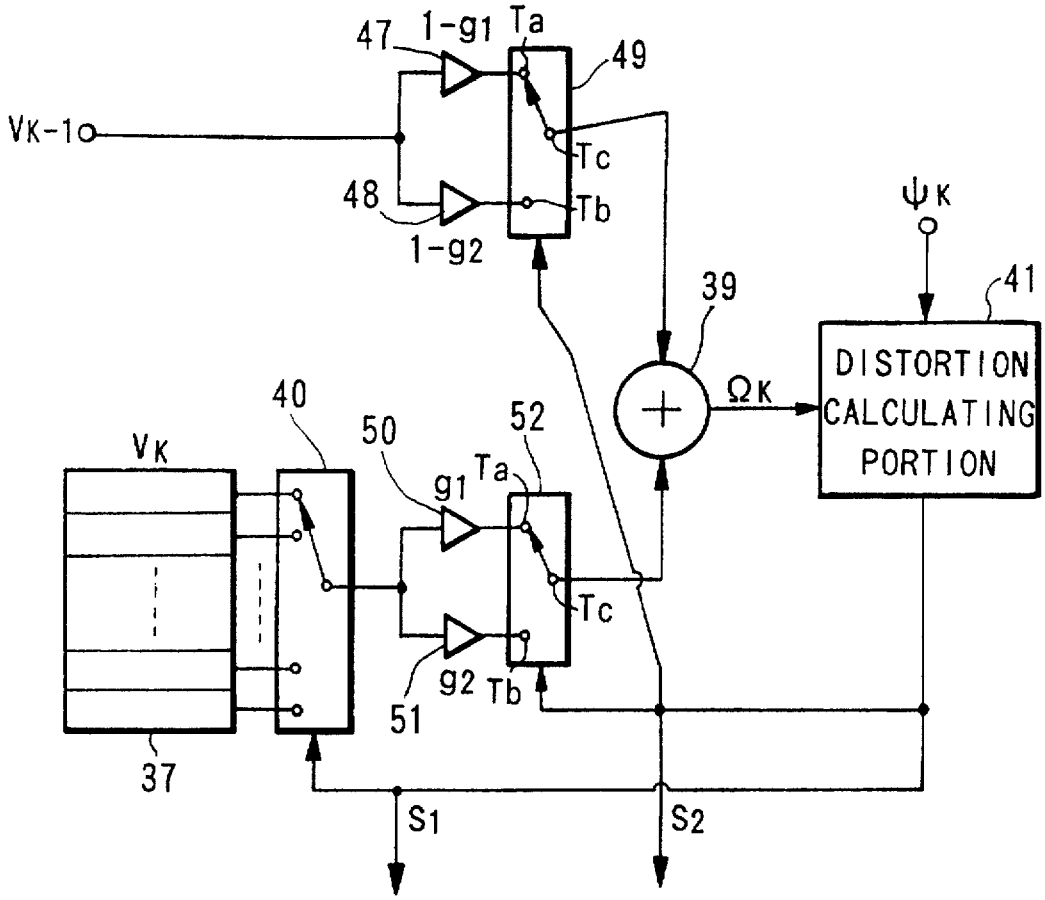
FIG. 6 is a block diagram showing a fifth construction of a vector quantization portion applied to a parameter coding method according to a preferred embodiment of the present invention.

FIG. 6 shows a third construction of a vector quantization portion provided in the LSP coefficient quantizing portion 25. In this FIG. 6, components which correspond to those shown in FIG. 2, will retain the original identifying numeral, and their description will not herein be repeated. The vector quantization portion shown in FIG. 6 is characterized in that the ratio value of a plurality of different types of weighted means is set independently from the LSP codevectors. The LSP codevector $V_{k-1}$ produced from the LSP codebook 37 in the frame operation immediately prior to the current frame operation, is multiplied, in multipliers 47 and 48, by the multiplication coefficients $(1-g_1)$ and $(1-g_2)$ respectively, and then supplied to the input terminals $T_a$ and $T_b$ of a transfer switch 49. The transfer switch 49 is activated in response to the distortion calculation resulting by the distortion calculating portion 41, and the output vector from either multiplier 47 or 48 is selected, and supplied to one input terminal of the adder 39 via a common terminal $T_c$. On the other hand, an LSP codevector $V_k$ produced from the LSP codebook 37 in the current frame operation, is supplied to each input terminal of the transfer switch 40. The transfer switch 40 is activated in the same manner as the transfer switch 49, in response to the distortion calculation result by the distortion calculator 41. In this manner, the selected LSP codevector $V_k$ is multiplied, in multipliers 50 and 51, by multiplication coefficients $g_1$ and $g_2$ respectively, and then supplied to input terminals $T_a$ and $T_b$ of a transfer switch 52. The transfer switch 52 is activated in the same manner as the transfer switches 40 and 49, in response to the distortion calculation result by the distortion calculator 41, and the output vector from either multiplier 50 or 51 is selected, and supplied to one input terminal of the adder 39 via the common terminal $T_c$.

In this manner, the output vectors of the transfer switches 49 and 52 are summed in the adder 39, and the quantized LSP parameter vector $\Omega_k$ of the frame number k is then outputted. Specifically, this LSP parameter vector $\Omega_k$ may be expressed by the following formula (8). In the formula (8), m is 1 or 2.

$$\Omega_k=(1-g_m)V_{k-1}+g_mV_k \tag{8}$$

Subsequently, the distortion data between the LSP parameter vector $\Psi_k$ of the frame number k before quantization and the LSP parameter vector $\Omega_k$ of the frame number k after quantization are calculated in th e distortion calculating portion 41, and the transfer switches 49 and 52 are activated in a manner such that this distortion data is minimized. As a result, as the code S1, the code of the selected LSP codevector $V_k$, and the selection information S2, indicating which the output vectors from each of the multipliers 47 and 48, and 50 and 51 will be used, are outputted from the distortion calculating portion 41.

Figure 7:
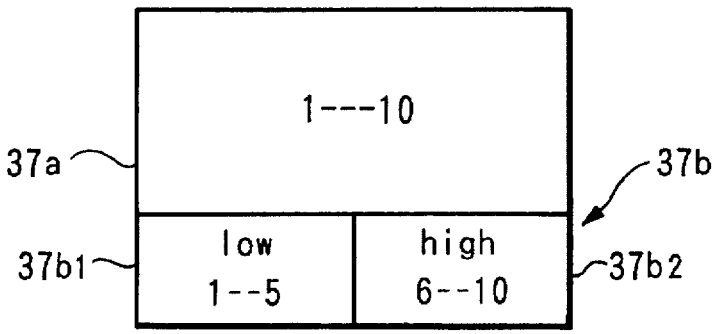
FIG. 7 shows an example of a construction of the LSP codebook 37.

Furthermore, in order to reduce the storage capacity of the LSP codebook 37, the LSP codevector $V_k$ is expressed as the sum of two vectors. For example, as shown in FIG. 7, the LSP codebook 37 is formed from a first stage LSP codebook **37*a*, in which 10 vectors $E_1$ have been stored, and a second stage LSP codebook 37*b*1, which comprises two separate LSP codebooks each storing five vectors, a second stage low order LSP codebook 37*b*1 and a second stage high order LSP codebook 37*b*2**. The LSP codevector $V_k$ may be expressed using the following formulae (9) and (10).

When f<5, $$V_k=E_{1n}+E_{L2f} \tag{9}$$

When f≧5, $$V_k=E_{1n}+E_{H2f} \tag{10}$$

In the formulae (9) and (10), an $E_{1n}$ is an output vector of the first stage LSP codebook **25*a*, and n is 1 through 128. In other words, 128 output vectors $E_1$ are stored in the first stage LSP codebook 25*a*. In addition, an $E_{L2f}$ is an output vector of the second stage low order LSP codebook 37*b*1 and an $E_{H2f}$ is an output vector of the second stage high order LSP codebook 37*b*2**.

The vector quantization method (not shown in the FIGS.) used in this vector quantization portion reduces the effects of coding errors in the case where these errors are detected in the decoding portion. Similar to the vector quantization portion shown in FIG. 2, this method calculates, in the coding portion, the LSP vector $V_k$ which will minimize the distortion data. However, in the case where coding errors are detected or highly probable in either LSP codevector $V_{k-1}$ in the previous frame operation in the decoding portion, or LSP codevector $V_k$ in the current frame operation, only in the decoding portion, this method calculates an output vector by reducing the ratio of the weighted mean of the LSP vectors incorporating the errors.

In this variation, for example, in the case where a transmission line error is detected in the frame operation immediately preceding the current frame operation, information from the previous frame is completely disregarded, and the quantized LSP parameter vector $\Omega_k$ is expressed by the following formula (11).

$$\Omega_k=V_k \tag{11}$$

Alternatively, the LSP parameter vector $\Omega_k$ may be expressed by formula (12) in order to reduce the effects of the transmission line errors from the previous frame.

$$\Omega_k=(1-\sqrt{g_k})V_{k-1}+\sqrt{g_k}\ V_k \tag{12}$$

Figure 8:
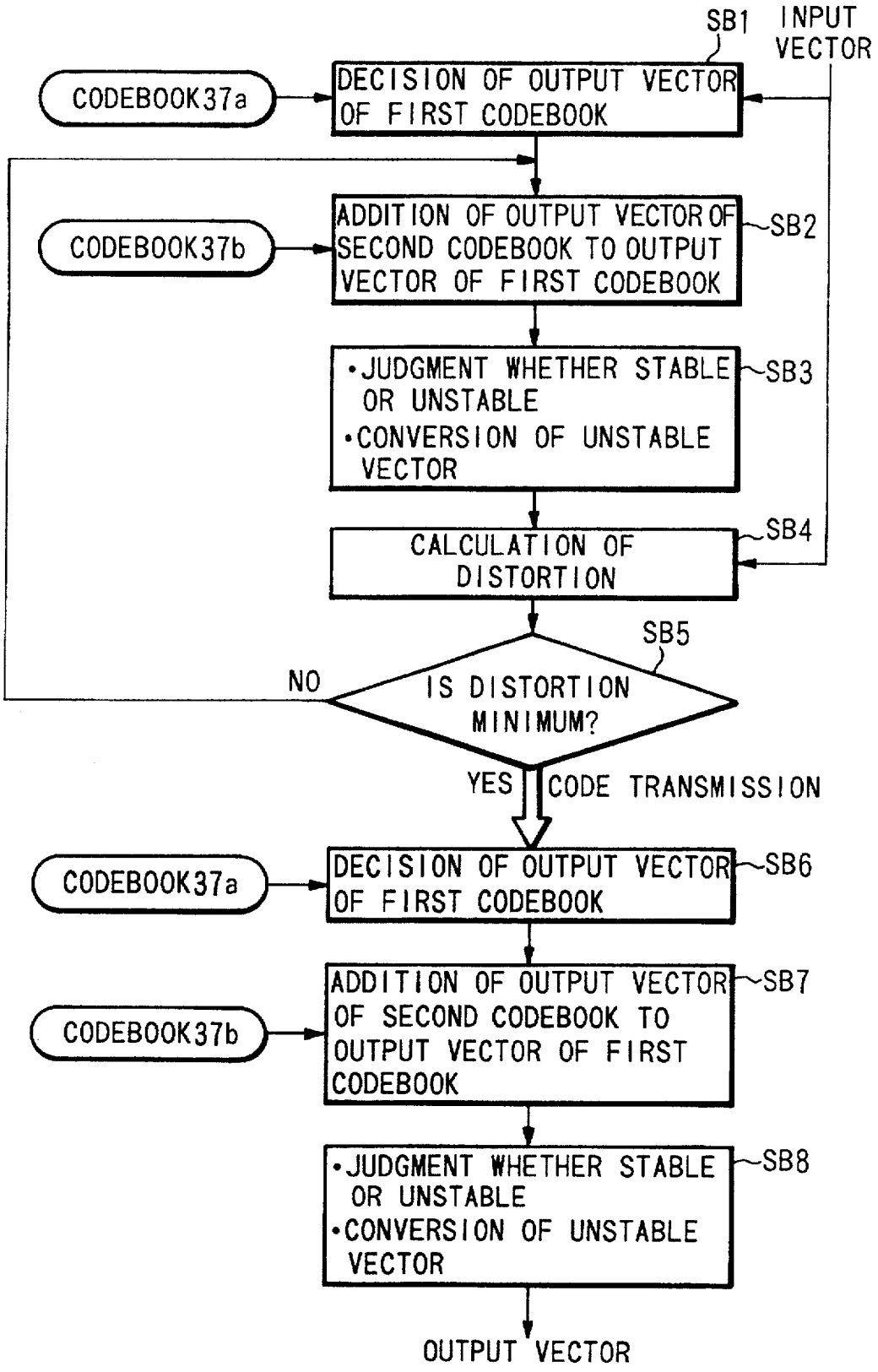
FIG. 8 is a flow chart for use in explaining a multistage vector quantization method according to a preferred embodiment of the present invention.

In the following, the procedures of the vector quantization portion shown in FIG. 6 will be explained with reference to the flow chart shown in FIG. 8. In step SB1, the distortion calculating portion 41 selects a plurality of the output vectors $E_{1n}$ similar to the LSP parameter vector $\Psi_k$ from the first stage LSP codebook **37*a*, by means of appropriately activating the transfer switch 40. In subsequent step SB2, the distortion calculating portion 41 respectively adds to each of the selected high and low order output vectors $E_{1n}$, the output vectors $E_{L2f}$ and $E_{H2f}$ selected respectively from the second stage low order LSP codebook 37*b*1 and the second stage high order LSP codebook 37*b*2 of the second stage codebook 37*b***, and produces the LSP codevector $V_k$. The system then proceeds to step SB3.

In step SB3, the distortion calculating portion 41 judges whether or not the LSP codevector $V_k$ obtained in step SB2 is stable. This judgment is performed in order to stabilize and activate the synthesis filter 26 (see FIG. 1) in which the aforementioned LSP codevector $V_k$ is set. Thus in order to stabilize and activate the synthesis filter 26, the values of the LSP parameters $\omega_1$ through $\omega_p$ forming p number of the LSP codevectors $V_k$ must satisfy the relationship shown in the aforementioned formula (2).

Figure 9:
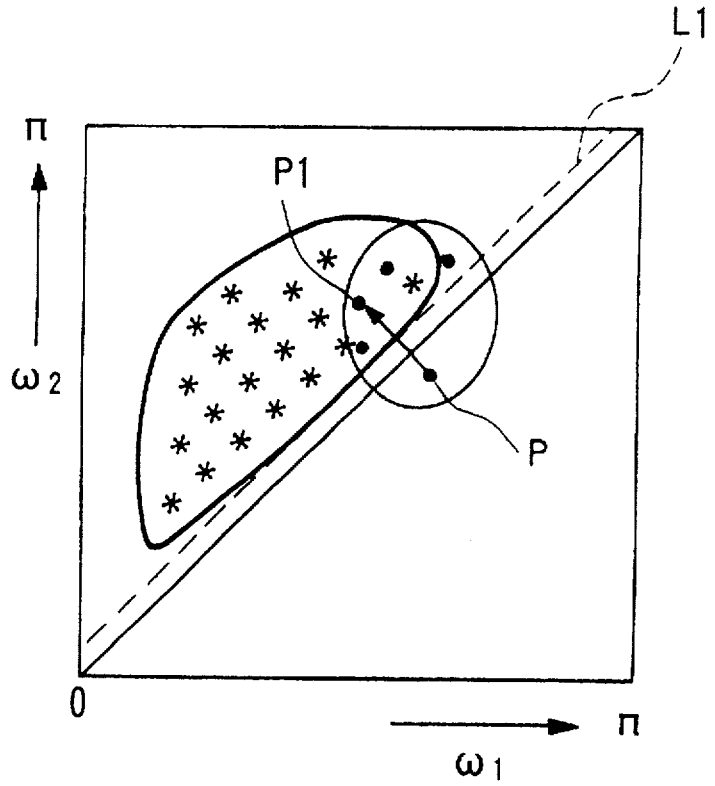
FIG. 9 shows the conversion of a reconstructed vector according to the preferred embodiment shown in FIG. 8.

When an unstable situation exists (see a code P in FIG. 9) because the values of the LSP parameters $\omega_1$ through $\omega_p$ do not satisfy the relationship shown in formula (2), the distortion calculating portion 41 converts the output vector P into a new output vector P1, which is symmetrical in relation to the broken line L1 shown in FIG. 9 in order to achieve a stable situation.

Subsequently, the LSP codevector $V_k$, which is either stable or has been converted so as to stabilize, is multiplied respectively, in the multipliers 50 and 51, by the multiplication coefficients $g_1$ and $g_2$. The output vector of either multiplier 50 or 51 is then supplied to the other input terminal of the adder 39 via the transfer switch 52. On the other hand, the LSP codevector $V_{k-1}$ produced from the LSP codebook 37 in the frame operation immediately prior to the current frame operation, is multiplied, in the multipliers 47 and 48, by the multiplication coefficients $(1-g_1)$ and $(1-g_2)$ respectively, and the output vector of either multiplier 47 or 48 is then supplied to one input terminal of the adder 39 via the transfer switch 49. In this manner, in the adder 39, the weighted mean of the output vectors of the transfer switches 49 and 52 are calculated, and the LSP parameter vector $\Omega_k$ is outputted.

In step SB4, the distortion calculator 41 calculates the distortion data between the LSP parameter vector $\Psi_k$ and the LSP parameter vector $\Omega_k$, and the process moves to step SB5. In step SB5, the distortion calculating portion 41 judge whether or not the distortion data calculated in step SB4 is at a minimum. In the case where this judgment is "NO", the distortion calculating portion 41 activates either transfer switch 49 or 51, returning the process to step SB2. The aforementioned steps SB2 to SB5 are then repeated in regard to the plurality of output vectors $E_{1n}$ selected in step SB1. When the distortion data calculated in step SB4 reaches a minimum, the judgment in step SB5 becomes "YES", and, as a result, the distortion calculating portion 41 determines the LSP codevector $V_k$, outputs this code as the code $S_1$, outputs the selection information $S_2$, and transmits them respectively to the decoding portion in the vector quantization portion. The decoding portion comprises the LSP codebook 37 and the transfer switches 40, 49 and 52 shown in FIG. 6.

Proceeding to step SB6, the decoding portion activates the transfer switch 40 based on the transmitted code $S_1$, and selects the output vector $E_{1n}$ from the first stage codebook 37*a*. The process then moves to step SB7. In step SB7, the decoding portion activates the transfer switch 40 based on the transmitted selection information $S_2$ to respectively select the output vectors $E_{L2f}$ and $E_{H2f}$ from the second stage low order LSP codebook 37*b*1 and the second stage high order LSP codebook 37*b*2 of the second stage codebook 37*b*, adds them to respectively the high and low order of the selected output vectors $E_{1n}$, and thereby produces the LSP codevector $V_k$. The system then proceeds to step SB8. In step SB8, the decoding portion judges whether or not the LSP codevector $V_k$ obtained in step SB7 is stable. When the decoding portion judges that the LSP codevector $V_k$ is unstable, as in step SB3 above, it converts the output vector P into a new output vector P1, which is symmetrical in relation to the broken line L1 shown in FIG. 9 in order to achieve a stable situation. In this manner, the LSP codevector $V_k$, which is either stable or has been converted so as to stabilize, may be used in the subsequent frame operation as the LSP codevector $V_{k-1}$.

Figure 22:
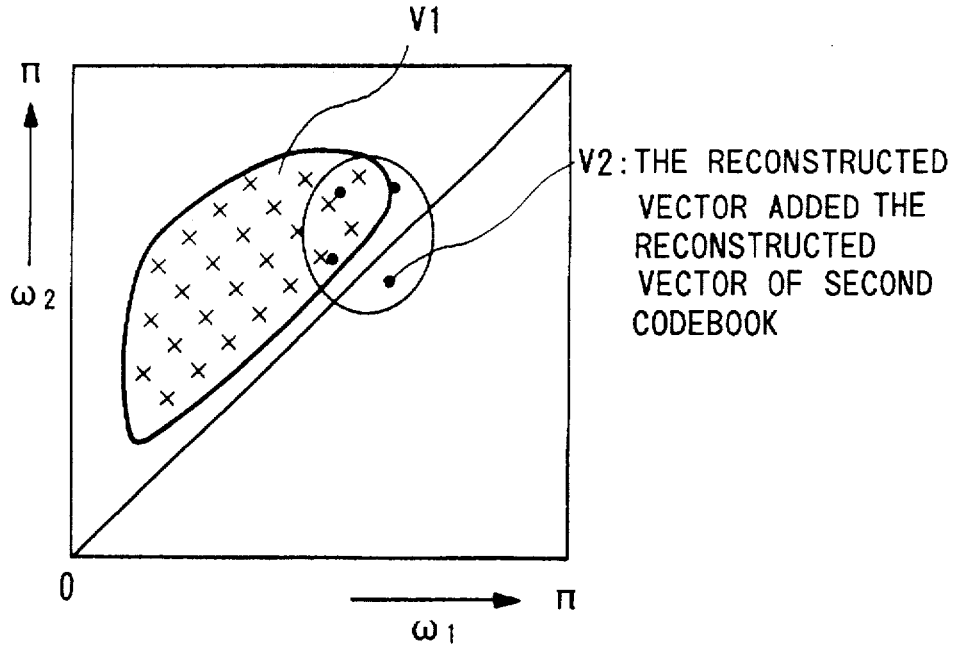
FIG.22 (PRIOR ART)
FIG. 22 shows a vector to which a reconstructed vector of a second stage has been added, in the case where vector quantization of the LSP parameters shown in FIG. 19 is performed.

The multistage vector quantization method shown above in FIG. 6 is characterized in that when the output vectors $E_{L2f}$ and $E_{H2f}$ selected respectively from the second stage low order LSP codebook 37*b*1 and the second stage high order LSP codebook 37*b*2 of the second stage codebook 37*b*, are summed, in the case where an unstable output vector is present, the output position is shifted, and the output vector P is converted into the output vector P1, which is symmetrical in relation to the broken line L1 shown in FIG. 9. In FIG. 22, the diagonal line represents the set of values at which the LSP parameters $\omega_1$ and $\omega_2$ are equal. Thus, changing the output position to one that is symmetrical around broken line L1, which lies parallel to the aforementioned diagonal line, changes the order of the LSP parameter $\omega$, and broadens the interval of adjacent LSP parameters.

In addition, in the aforementioned multistage vector quantization method, it is important to perform necessary conversions before calculating the distortion data, and to carry out these conversions in the exact same order in both the coding and decoding portions. As well, when learning the LSP codebook 37, it is also necessary to perform calculations for the distance and center of gravity taking into account the above conversions.

Furthermore, in the aforementioned multistage vector quantization method, a two-stage example of the LSP codebook 37 is given, however, it also possible to apply a three-stage LSP codebook 37 in which the stable/unstable judgment is performed in the final stage. In addition, it is possible to perform the judgment in every stage following the first stage as well. The first stage is always stable, thus it is unnecessary to perform the above stable/unstable judgment in this stage.

Figure 10:
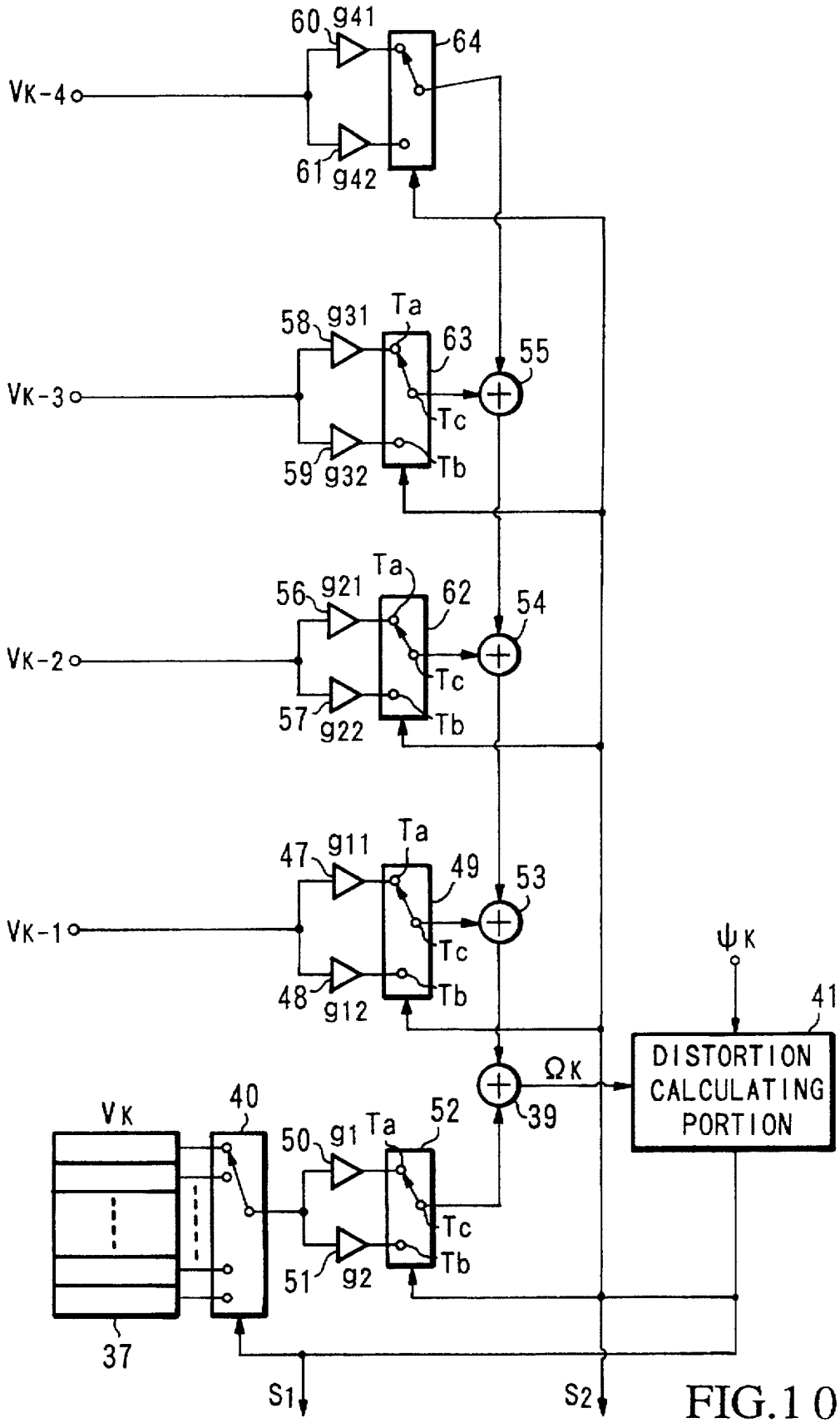
FIG. 10 is a block diagram showing a sixth construction of a vector quantization portion applied to a parameter coding method according to a preferred embodiment of the present invention.

FIG. 10 shows a fourth construction of a vector quantization portion provided in the LSP coefficient quantizing portion 25. In this FIG. 10, components which correspond to those shown in FIG. 6, will retain the original identifying numeral, and their description will not herein be repeated. Adders 53 to 55, multipliers 56 to 61 and transfer switches 62 to 64 comprise the same functions as the adder 39, the multiplier 47 and the transfer switch 49, respectively. The vector quantization portion shown in FIG. 10, calculates the LSP parameter vector $\Omega_k$, expressed in formula (13), using the weighted means of a plurality of the past LSP codevectors $V_{k-4}$ to $V_{k-1}$ and the current LSP codevector $V_k$.

$$\Omega_k = g_{4m}V_{k-4} + g_{3m}V_{k-3} + g_{2m}V_{k-2} + g_{1m}V_{k-1} + g_mV_k \quad (13)$$

In the formula (13), $g_{4m}$ to $g_m$ are the constants of the weighted means, and m is 1 or 2.

Figure 27:
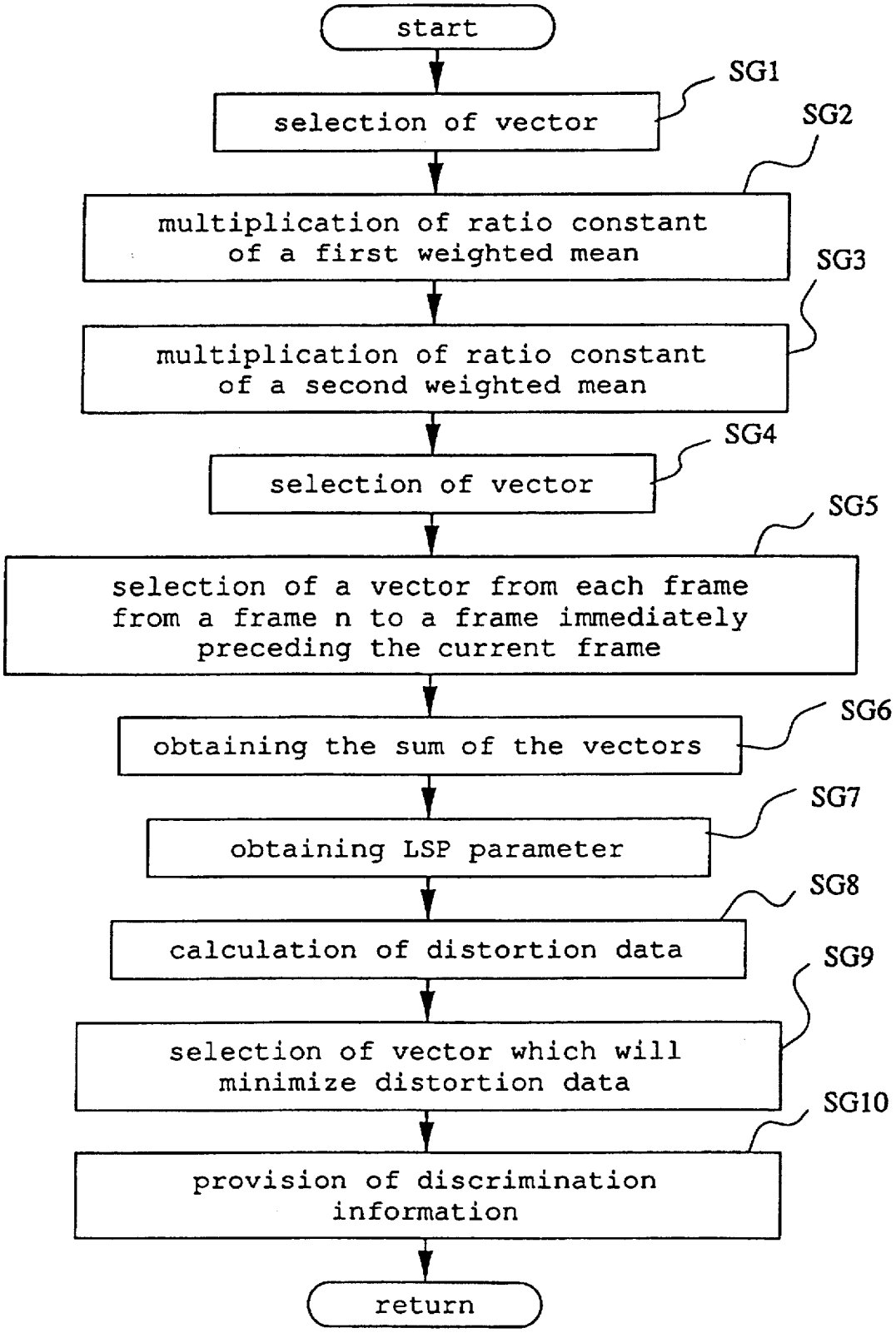

Furthermore, the operations of the vector quantization portion shown in FIG. 10, are similar to the operations of the vector quantization portion shown in FIG. 6, thus the corresponding description will be omitted. Additionally, the vector quantization portion shown in FIG. 10 utilizes the LSP coding vectors extending back four frame operations prior to the current frame operation, however, use of the LSP codevectors from the past frames is not in particular limited. FIG. 27 shows a flowchart where steps SG1–SG10 portray the operation of the vector quantization portion described above and shown in FIG. 10.

Figure 11:
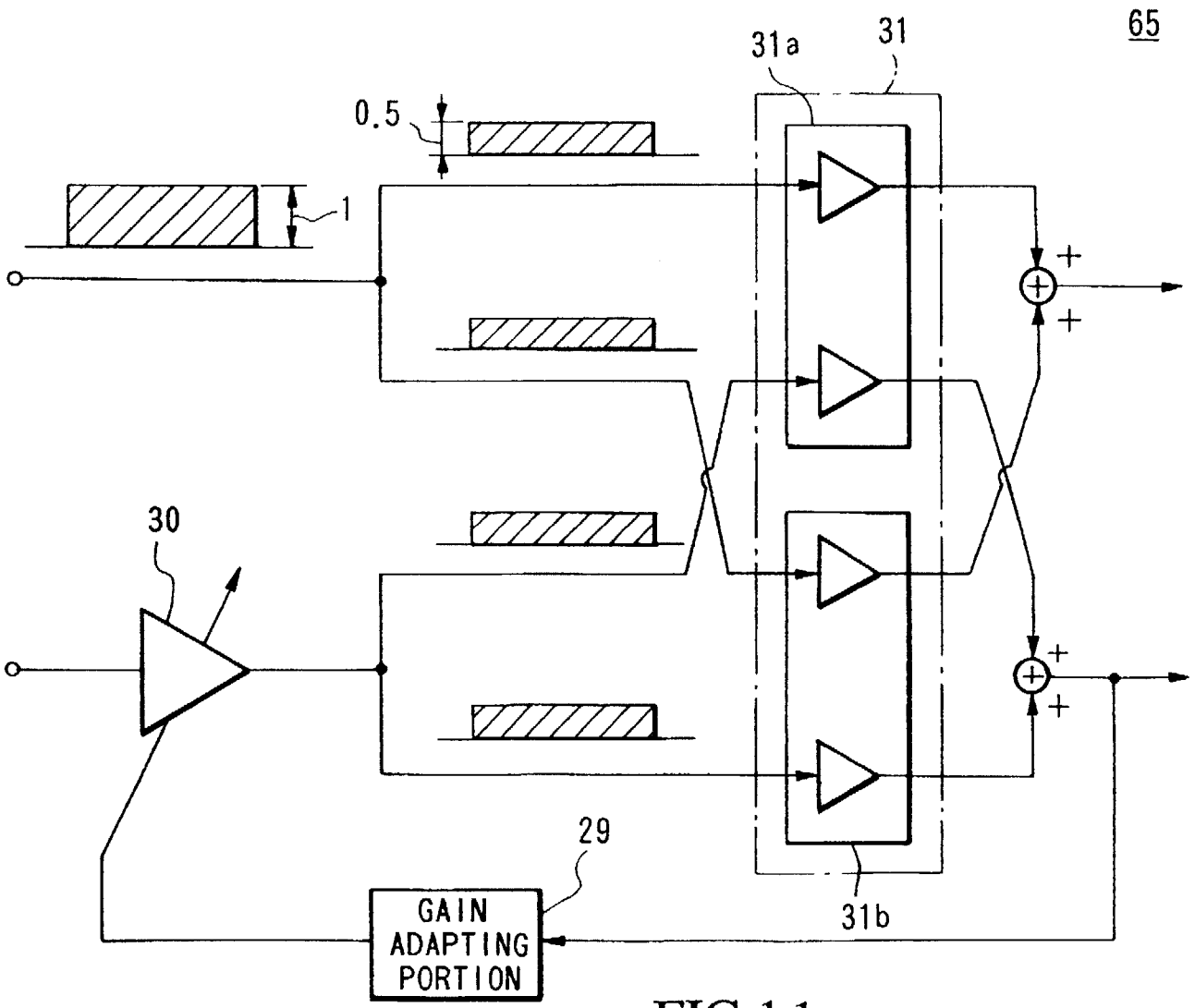
FIG. 11 shows an example of a construction of a vector quantization gain searching portion 65.

Next, a vector quantization gain searching portion 65 comprising the gain adapting portion 29, the predicted gain portion 30, and the vector quantization gain codebook 31, shown in FIG. 1, will be described. FIG. 11 shows a detailed block diagram of the vector quantization gain searching portion 65. In the gain adapting portion 29, the linear prediction analysis is carried out for the power of the output vector from the vector quantization gain codebook 31 at the present operation, and for the power of the output vector of random codebook component from the vector quantization gain codebook 31, which is used in the past operation and is stored in the vector quantization gain codebook 31. Then, in the gain adapting portion 29, the predicted gain by which the noise waveform vector which will be selected at a next frame operation, will multiply, is calculated and decided, and the decided predicted gain is set in the gain adapting portion 30.

Figure 12:
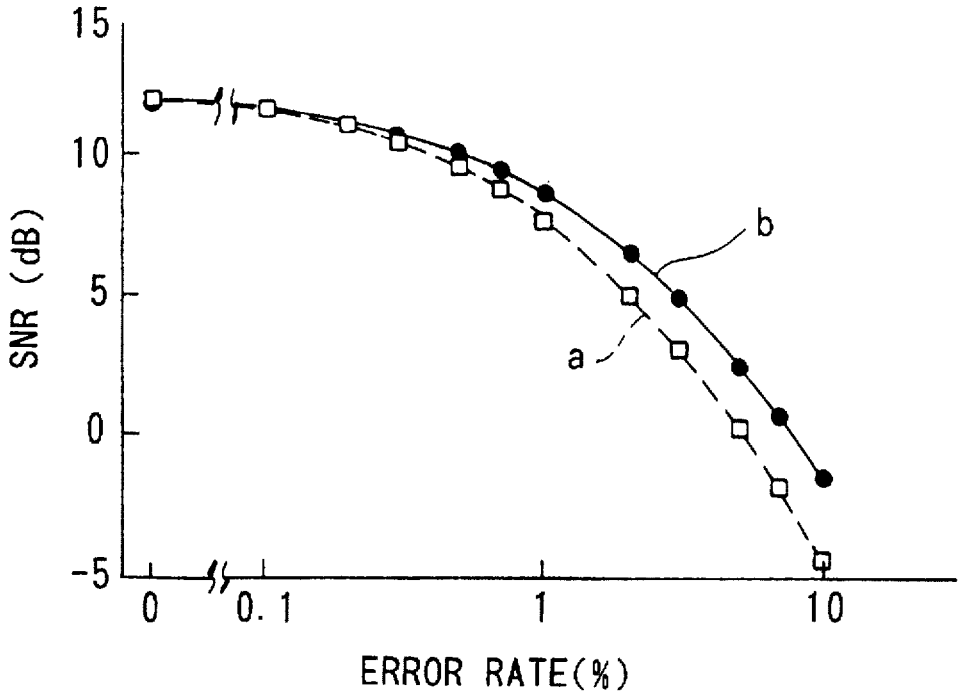
FIG. 12 shows an example of the SN characteristics plotted against the transmission line error percentage in a speech coding apparatus according to the conventional art, and one according to a preferred embodiment of the present invention.
Figure 28:
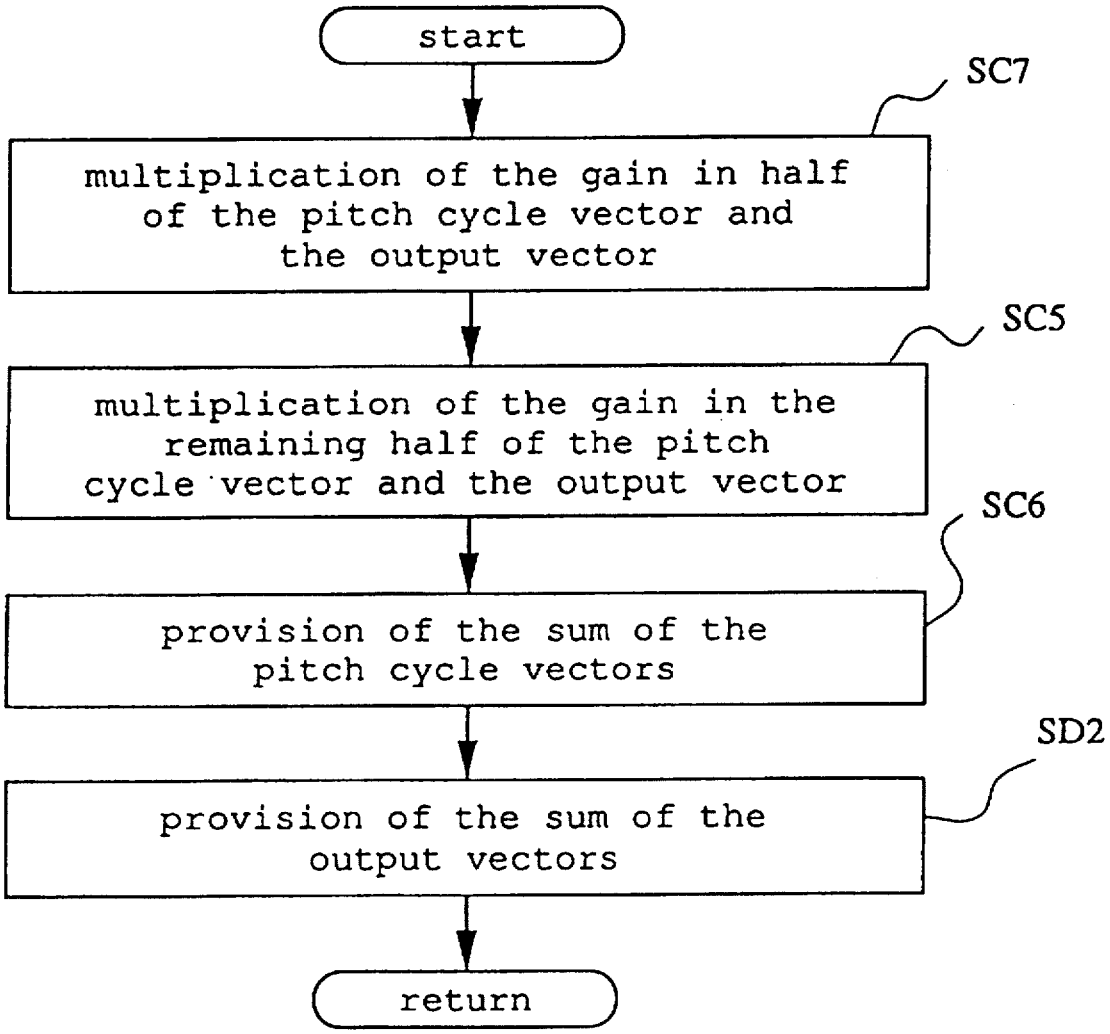
FIG. 28 is a flow chart for use in explaining a vector quantization gain searching method according to a preferred embodiment of the present invention.

In the vector quantization gain codebook 31 is divided into subgain codebooks 31*a* and 31*b* to increase the quantization efficiency by the vector quantization and to decrease the effect on the decoded speech in the case where the error of the gain code is occurred in a transmission line. The pitch period outputted from the adaptive codebook searching portion 27, is supplied to the subgain codebooks 31*a* and 31*b* in block of one-half, respectively, and the half of the output vector from the predicted gain portion 30 is supplied to the subgain codebooks 31*a* and 31*b* in block of one-half, respectively. The gain multiplied by each of the vectors is selected as a block by the distortion power calculating portion 35 shown in FIG. 1 so that the distortion data that is the difference between an input speech vector and a synthesized speech vector, is minimized as a whole. By dividing the vector quantization gain codebook 31 as described above, even if the error of either of the gain codes occurs in the transmission line, it is possible to supplement the error of one gain code with the other gain code. FIG. 28 shows a flowchart where steps SC7, SC5, SC6, and SD2 portray the operation of the vector quantization gain searching portion described above and shown in FIG. 11. Accordingly, it is possible to decrease the effect of the error in the transmission line. FIG. 12 shows an example of signal-to-noise ratio (SNR) characteristics for the transmission error rate in the case of representing the gain by which the pitch period vector and the noise waveform vector is multiplied, respectively, by the output vector from the conventional gain codebook, and the case of representing one by the sum of the output vectors from two subgain codebooks. In FIG. 12, a curve a shows the SNR characteristics according to the conventional gain codebook, and a curve b shows one according to the subgain codebooks of this embodiment of the present invention. As shown in FIG. 12, it is obvious that the technique of the representation of the gain by the sum of output vectors from two subcodebooks has a grater tolerance of transmission errors.

Figure 13:
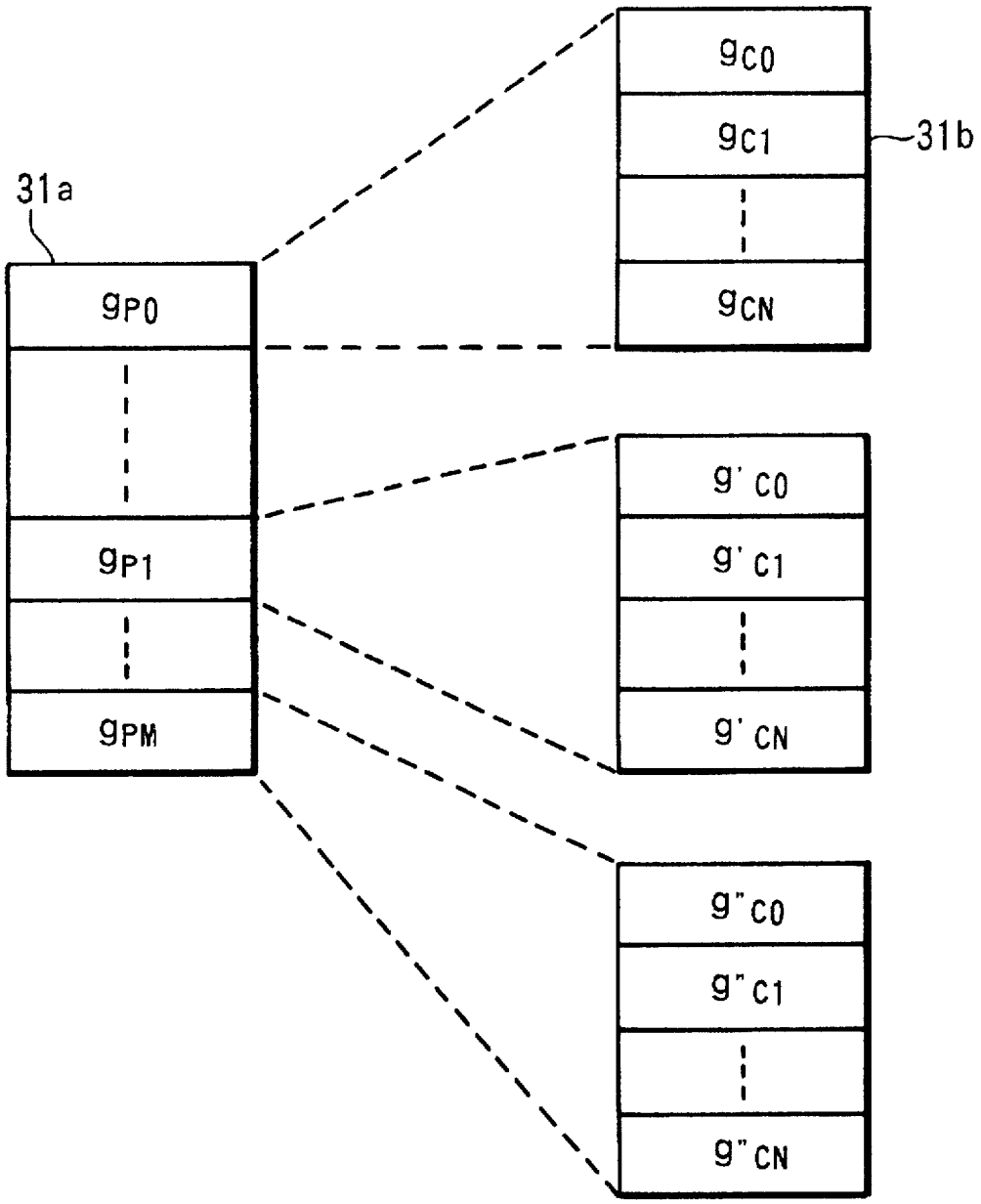
FIG. 13 shows an example of a construction of a vector quantization codebook 31.

As a countermeasure in case of the occurrence of the transmission error of the gain code in the transmission line, the vector quantization gain codebook 31 is composed of the subgain codebooks 31*a* and 31*b* serially connected as shown in FIG. 13. The gain by which the pitch period vector is multiplied is selected from $\{g_{p0}, g_{p1}, \ldots, g_{pM}\}$. On the other hand, the gain by which the output vector of the predicted gain portion 30 is multiplied is selected from $\{g_{c0}, g_{c1}, \ldots, g_{cM}\}$. By the construction of the subgain codebooks 31*a* and 31*b* as described above, even if there is a transmission error of the gain code of the output vector from the predicted gain portion 30 in the transmission line, the gain code of the pitch period vector is not at all affected by the transmission error of the gain code of the output vector from the predicted gain portion 30. In contrast, in the case where a transmission error of the gain code of the pitch period vector occurs in the transmission line, the transmission error of the gain code of the output vector from the predicted gain portion 30 also occurs. However, by appropriately arranging the gain codes of these gains, it is possible to decrease the effect of the transmission error of the gain code in the transmission line.

Next, a pre-selection carried out in the adaptive codebook searching portion 27 and the random codebook searching portion 28, will be described. In the adaptive codebook searching portion 27 and the random codebook searching portion 28, the pitch period vector and the noise waveform vector are respectively selected from among a plurality of the pitch period vectors and a plurality of the noise waveform vectors respectively stored in the adaptive codebook 27 and the random codebook 28 so that the power of the distortion d' represented by the formula (14), is minimized.

$$d'=|X_T-g'HV'_i|^2 \tag{14}$$

In the formula (14), $X_T$ represents a target input speech vector used when the optimum vector is searched in the adaptive codebook searching portion 27 and the random codebook searching portion 28. The target input speech vector $X_T$ is obtained by subtracting a zero input response vector $X_Z$ of the decoded speech vector which is decoded in the previous frame operation and is perceptually weighted in the perceptual weighting filter 34, from the input speech vector $X_W$ perceptually weighted in the perceptual weighting filter 34 as shown in formula (15). The zero input response vector $X_Z$ is the component of the decoded speech vector operated until one frame before the current frame that affects the current frame, and is obtained by inputting a vector comprising a zero sequence into the synthesis filter 26.

$$X_T=X_W-X_Z \tag{15}$$

Furthermore, in the formula (14), $V'_i$ (i=1, 2, . . . , N; N denotes the a codebook size) is the pitch period vector or the noise waveform vector selected from the adaptive codebook 66 or the random codebook 67, and g' is the gain set in the subgain codebook 31*a* or 31*b* of the vector quantization gain codebook 31 shown in FIG. 1. H is the above-mentioned impulse response coefficient, and $HV'_i$ is the synthesis speech vector.

In order to search the optimum pitch period vector or noise waveform vector $V_{opt}$ for the target input speech vector $X_T$, as described above, the calculation of the formula (14) must be carried out with respect to the entirety of the vector $V'_i$. Accordingly, computational complexity increases enormously. Consequently, it is necessary to decrease computational complexity in order to carry out the above-mentioned calculations due to hardware considerations. In particular, since a filtering calculation of the synthesis speech vector $HV'_i$ comprises most of the calculation, a decrease of the filtering time leads to a decrease in the overall computational complexity in each of the searching portions.

Therefore, the pre-selection as described below, is carried out to decrease the filtering time. Initially, the above-mentioned formula (14) can be expanded to the formula as shown in formula (16).

$$d=|X_T|^2-2g'X_T^THV'_i+|g'HV'_i|^2 \tag{16}$$

In the second term of the formula (16), in the case where a correlation value between the target input speech vector $X_T$ and the synthesis speech vector $HV'_i$ is large, the total distortion d' becomes small. Accordingly, the vector $V'_i$ is selected from each of the codebooks based on this correlation value $X_T^THV'_i$. The distortion d' is not calculated for the entire vector $V'_i$ stored in each of codebooks, but only the correlation value is calculated for the entire vector $V'_i$ and the distortion d' is calculated for only the vector $V'_i$ having the large correlation value $X_T^THV'_i$.

In the calculation of the correlation value $X_T^THV'_i$, generally, after the synthesis speech vector HV' is calculated, the correlation calculation between the target input speech vector $X_T$ and the synthesis speech vector HV' is carried out. However, in the calculating method as described above, the N times of the filtering calculation and the N times of preforming the correlation calculation are necessary for the calculation of the synthesis speech vector HV' because the number of the vector $V'_i$ is equal to the codebook size N.

In this embodiment, a backward filtering disclosed in "Fast CELP Coding based on algebraic codes", Proc. ICASSP'87, pp. 1957–1960, J. P. Adoul, et al., is used. In this backward filtering, in the calculation of the correlation value $X_T^THV'_i$, $X_T^TH$ is initially calculated and $(X_T^TH)V'$ is calculated. By using this calculating method, the correlation value $X_T^THV'_i$ is obtained by filtering one time and performing the correlation calculation N times. Then, the arbitrary numbers of the vector $V'_i$ having the large correlation value $X_T^THV'_i$ are selected and the filtering of the synthesis speech vector $HV'_i$ may be calculated only for the selected arbitrary number of the vector $V'_i$. Consequently, it is possible to greatly decrease the computational complexity.

Next, the speech coding apparatus shown in FIG. 1 will be further explained. The adaptive codebook searching portion 27 comprises the adaptive codebook 66 and the pre-selecting portion 68. In the adaptive codebook searching portion 37, the past waveform vector (pitch period vector) which is most suitable for the waveform of the current frame, is searched as a unit of a subframe. Each of the pitch period vectors stored in the adaptive codebook 66, is obtained by passing the decoded speech vector through a reverse filter. The coefficient of the reverse filter is the quantized coefficient, and the output vector from the reverse filter is the residual waveform vector of the decoded speech vector. In the pre-selecting portion 68, the pre-selection of a prospect of the pitch period vector (hereafter referred to as a pitch prospect) to be selected is carried out twice. By performing the pre-selection twice, M pieces (for example, 16 pieces) of the pitch prospects, are finally selected. Next, the optimum pitch prospect among the pitch prospects selected in the pre-selecting portion 68, is decided as the pitch period vector to be outputted. When the optimum gain g' is set as shown a formula (17), the above-mentioned formula (16) can be modified as shown a formula (18).

$$g' = \frac{X_T^T HP_d}{|HP_d|} \tag{17}$$

$$d' = |H_T|^2 - \frac{(X_T^T HP_d)^2}{|HP_d|^2} \tag{18}$$

Then, what the pitch prospect that the smallest distortion d' can be obtained is searched is equal to what the pitch prospect that the second term of the formula (18) is maximized is searched. Accordingly, the second term of the formula (18) is respectively calculated for the M pieces of the pitch prospect selected in the pre-selecting portion 68, and the pitch prospect which the calculating result is maximized, is decided as the pitch period vector HP to be outputted.

The random codebook searching portion 28 comprises a random codebook 67, and pre-selecting portions 69 and 70. In the random codebook searching portion 28, a waveform vector (a noise waveform vector) which is most suitable for the waveform of the current frame, is searched for among a plurality of the noise waveform vectors stored in the random codebook 67 as a unit of a subframe. The random codebook 67 comprises subcodebooks **67*a* and 67*b*. In the subcodebooks 67*a* and 67*b***, a plurality of excitation vectors are stored, respectively. The noise waveform vector $C_d$ is represented by the sum of two excitation vectors as shown in formula (19).

$$C_d = \theta_1 \cdot C_{sub1p} \theta_2 C_{sub2q} \tag{19}$$

In the formula (19), $C_{sub1p}$ and $C_{sub2q}$ are the excitation vectors stored in the subcodebooks **67*a* and 67*b***, respectively, and $\theta_1$ and $\theta_2$ are the positive or negative of the excitation vectors $C_{sub1p}$ and $C_{sub2q}$, d=1~128, p=1~128, q=1~128.

As described above, by representing one noise waveform vector $C_d$ by two excitation vectors $C_{sub1p}$ and $C_{sub2q}$, and by transmitting the codes corresponding to two excitation vectors $C_{sub1p}$ and $C_{sub2q}$ as a code of bit series, even if the error of either of these codes occurs in the transmission line, it is possible to decrease the effect by the error in the transmission line by using the other code.

Furthermore, in this embodiment, the excitation vectors $C_{sub1p}$ and $C_{sub2q}$ is represented by 7 bits, and the signs $\theta_1$ and $\theta_2$ is represented by 1 bit. If the noise waveform vector $C_d$ is represented by a single vector as in the conventional art, the excitation vectors $C_{sub1p}$ and $C_{sub2q}$ will be represented by 15 bits, and the signs $\theta_1$ and $\theta_2$ will be represented by 1 bit. Accordingly, because a large amount of memory is required for the random codebook, the codebook size is too large. However, as this embodiment, since the noise waveform vector $C_d$ is represented by the sum of the two excitation vectors $C_{sub1p}$ and $C_{sub2q}$, the codebook size of the random codebook 67 can be greatly decreased compared with that of the conventional art. Consequently, it is able to learn and obtain the noise waveform vectors $C_d$ to be stored in the random codebook 67 by using a speech data base in which a plurality of actual speech vectors are stored so that the noise waveform vectors $C_d$ match the actual speech vectors.

In the pre-selecting portions 69 and 70, in order to select the noise waveform vector $C_d$ which is most suitable to the target input speech vector $X_T$, the excitation vectors $C_{sub1p}$ and $C_{sub2q}$ are respectively pre-selected from the subcodebooks **67*a* and 67*b***. In other words, the correlation value between the excitation vectors $C_{sub1p}$ and $C_{sub2q}$ and the target input speech vector $X_T$ are respectively calculated and the pre-selection of a prospect of the noise waveform vector $C_d$ (hereafter referred to as a random prospect) to be selected, is carried out. The noise waveform vector is searched for by orthogonalizing each of the random prospects against the searched pitch period vector HP to increase quantization efficiency. The orthogonalized noise waveform vector $[HC_d]$ against the pitch period vector HP is represented by formula (20).

$$(HC_d) = HC_d - \frac{(HC_d)^T HP}{|HP|^2} HP \tag{20}$$

Next, the correction value $X_T^T$ $[HC_d]$ between this orthogonalized noise waveform vector $[HC_d]$ and the target input speech vector $X_T^T$ is represented by formula (21).

$$X_T^T(HC_d) = X_T^T HC_d - \frac{(HC_d)^T HP}{|HP|^2} X_T^T HP \tag{21}$$

Next, the pre-selection of the random prospect is carried out using the correlation value $X_T^T$ $[HC_d]$. In the formula (21), the numerator term $(HC_d)^T HP$ of the second term is equivalent to $(HP)^T HC_d$. Accordingly, the above-mentioned backward filtering is applied to the first term $X_T^T HC_d$ of the formula (21) and $(HP)^T HC_d$. Since the noise waveform vector $C_d$ is the sum of the excitation vectors $C_{sub1p}$ and $C_{sub2q}$, the correlation value $X_T^T$ $[HC_d]$ is represented by formula (22).

$$X_T^T[HC_d] = X_T^T[HC_{sub1p}] + X_T^T[HC_{sub2q}] \tag{22}$$

Accordingly, the calculation shown by the formula (22) is carried out respectively for the excitation vectors $C_{sub1p}$ and $C_{sub2q}$ and the M pieces of the calculated correlation values whose value is large among these are respectively selected. Next, the random prospects comprising the most suitable combination are respectively chosen as a noise waveform vector to be outputted among each of the M pieces of the excitation vectors $C_{sub1p}$ and $C_{sub2q}$ selected in the pre-selecting portion 69 and 70. In the same way as the above-mentioned technique of choosing the optimum prospect of the pitch period prospect, the combination of the excitation vectors $C_{sub1p}$ and $C_{sub2q}$ which the second term of the formula (23) representing the distortion d" calculated using the target input speech vector $X_T$ and the random prospect, is searched for.

$$d'' = |X_T|^2 - \frac{(X_T^T(HC_d))^2}{|(HC_d)|^2} \tag{23}$$

Since the M pieces of the excitation vectors $C_{sub1p}$ and $C_{sub2q}$ are respectively selected from each of the subcodebooks **67*a* and 67*b*** by using the above-mentioned pre-selection, the calculation shown by the formula (23) may be carried out $M^2$ times on the whole.

As described above, in this embodiment, the M pieces of the excitation vectors $C_{sub1p}$ and $C_{sub2q}$ are respectively pre-selected in the pre-selecting portions 69 and 70 and the optimum combination is selected among the M pieces of the pre-selected excitation vectors $C_{sub1p}$ and $C_{sub2q}$, it is possible to further increase tolerance to the transmission error. As mentioned before, because one noise waveform vector $C_d$ is represented by the two excitation vectors $C_{sub1p}$ and $C_{sub2q}$, even if the error of either of the codes respectively corresponding to the excitation vectors $C_{sub1p}$ and $C_{sub2q}$ occurs in the transmission line, it is possible to compensate for the transmission error of one code with the other code. In addition, the excitation vectors $C_{sub1p}$ and $C_{sub2q}$ having the high correlation with the target input speech vector are pre-selected by the pre-selection and then the optimum combination of the excitation vectors $C_{sub1p}$ and $C_{sub2q}$ is chosen as the noise waveform vector to be outputted, the noise waveform vector in which the transmission error has not occurred has a high correlation with the target input speech vector $X_T^T$. Consequently, in comparison with not carrying out the pre-selection, it is possible to decrease the effects of the transmission errors.

Figure 14:
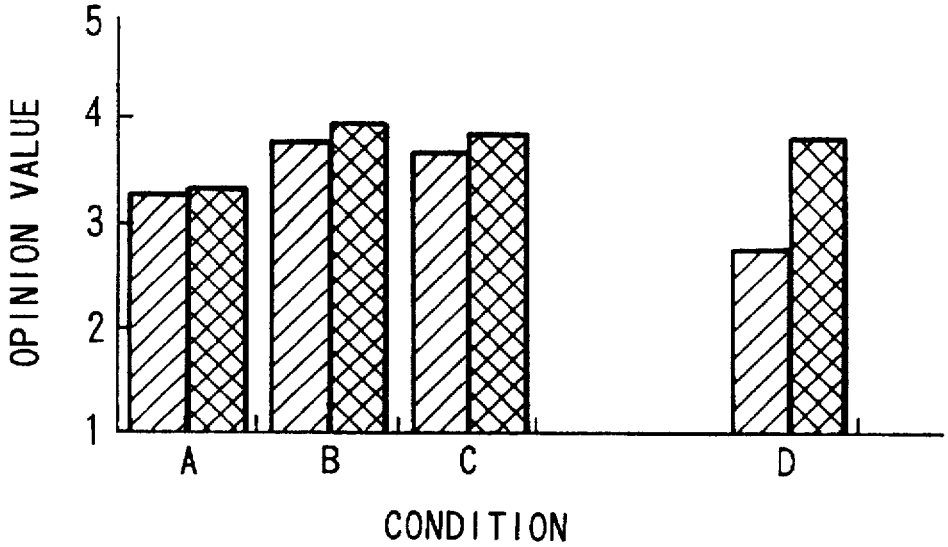
FIG. 14 shows an example of opinion values of decoded speech plotted against various evaluation conditions in a speech coding apparatus according to a preferred embodiment of the present invention.
Figure 15:
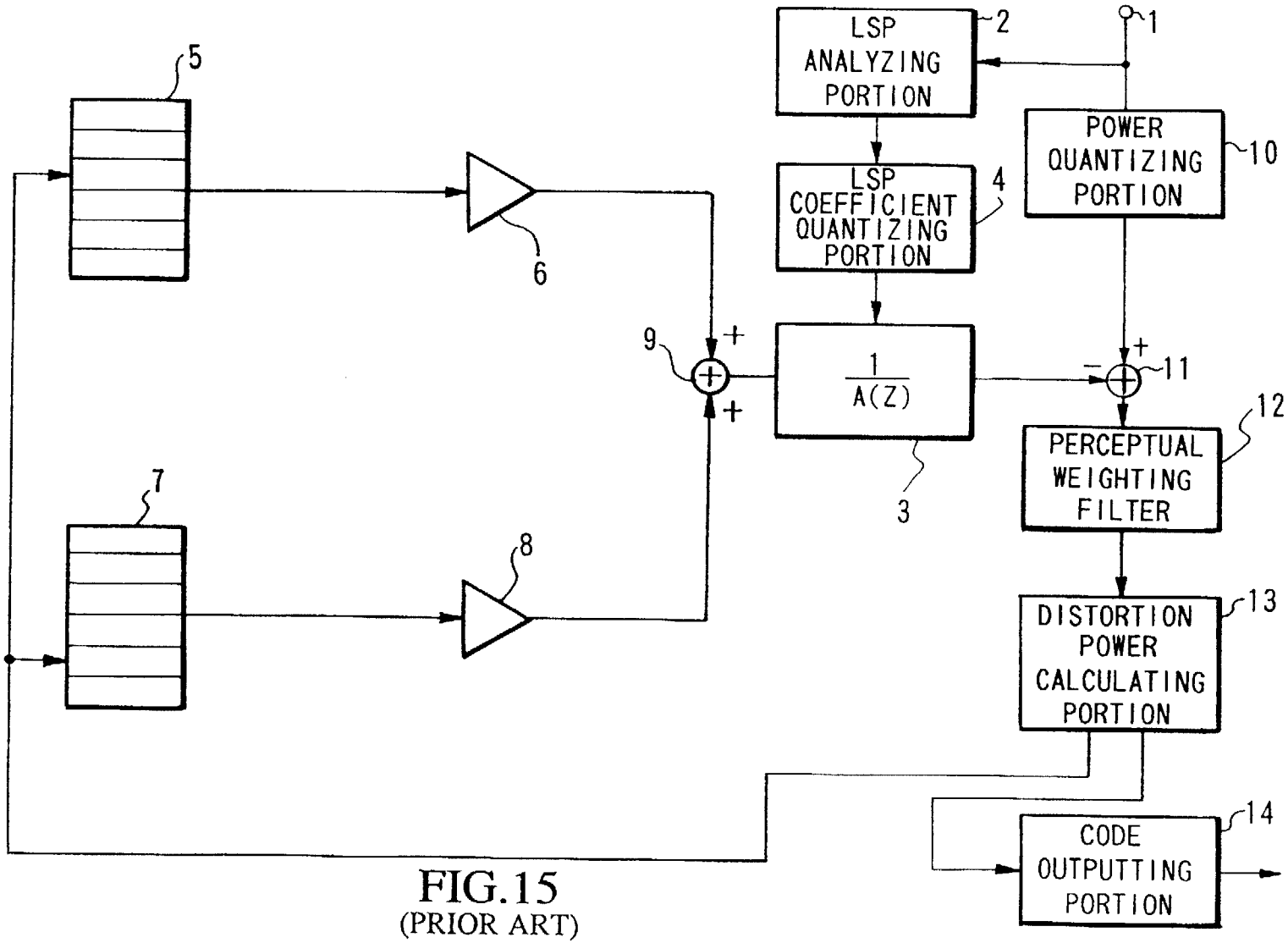
FIG.15 (PRIOR ART)
FIG. 15 is a block diagram showing a constructional example of a speech coding apparatus utilizing a conventional CELP coding method.
Figure 16:
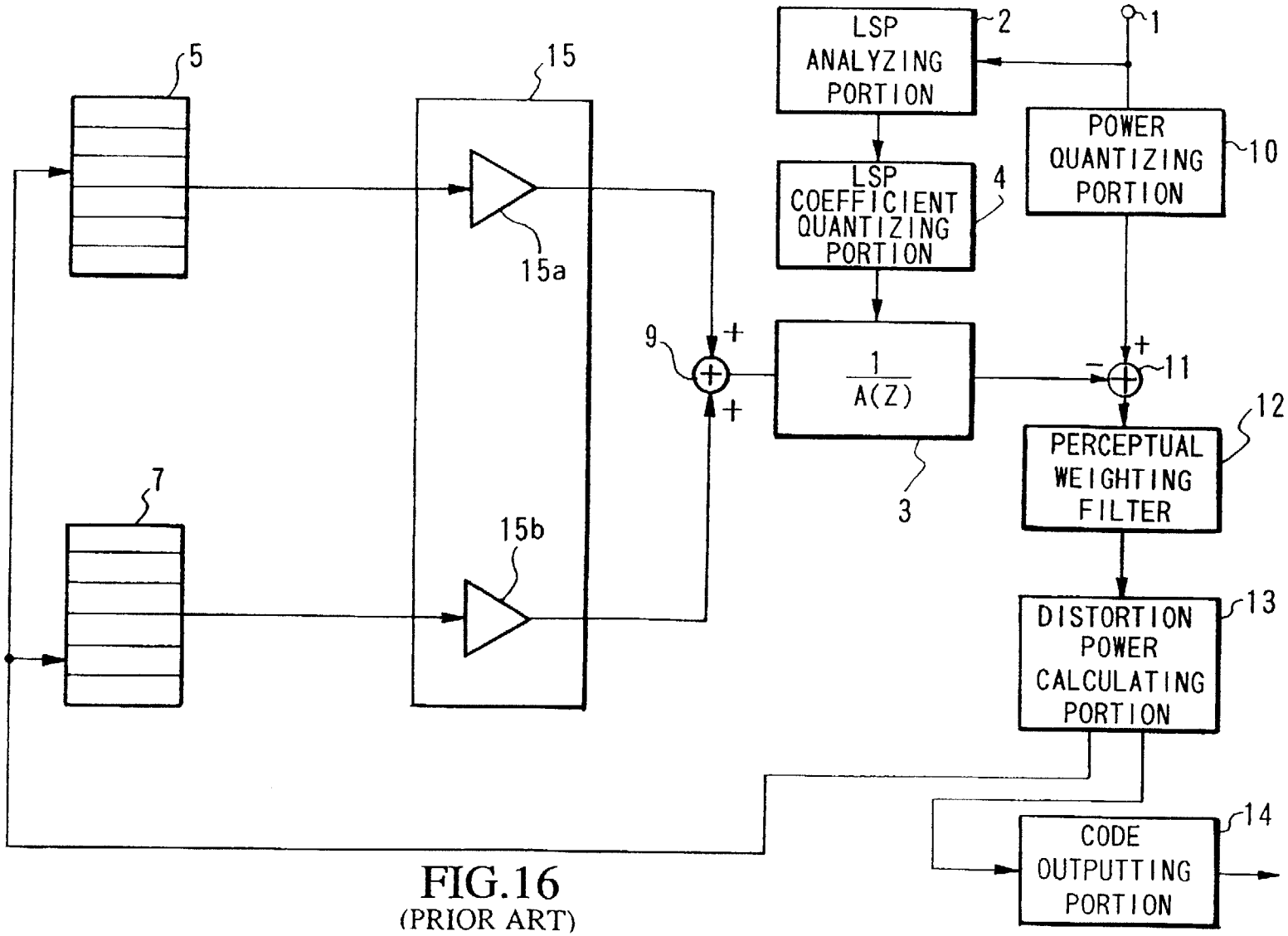
FIG.16 (PRIOR ART)
FIG. 16 is a block diagram showing a constructional example of a speech coding apparatus utilizing the a conventional VSELP coding method.
Figure 17:
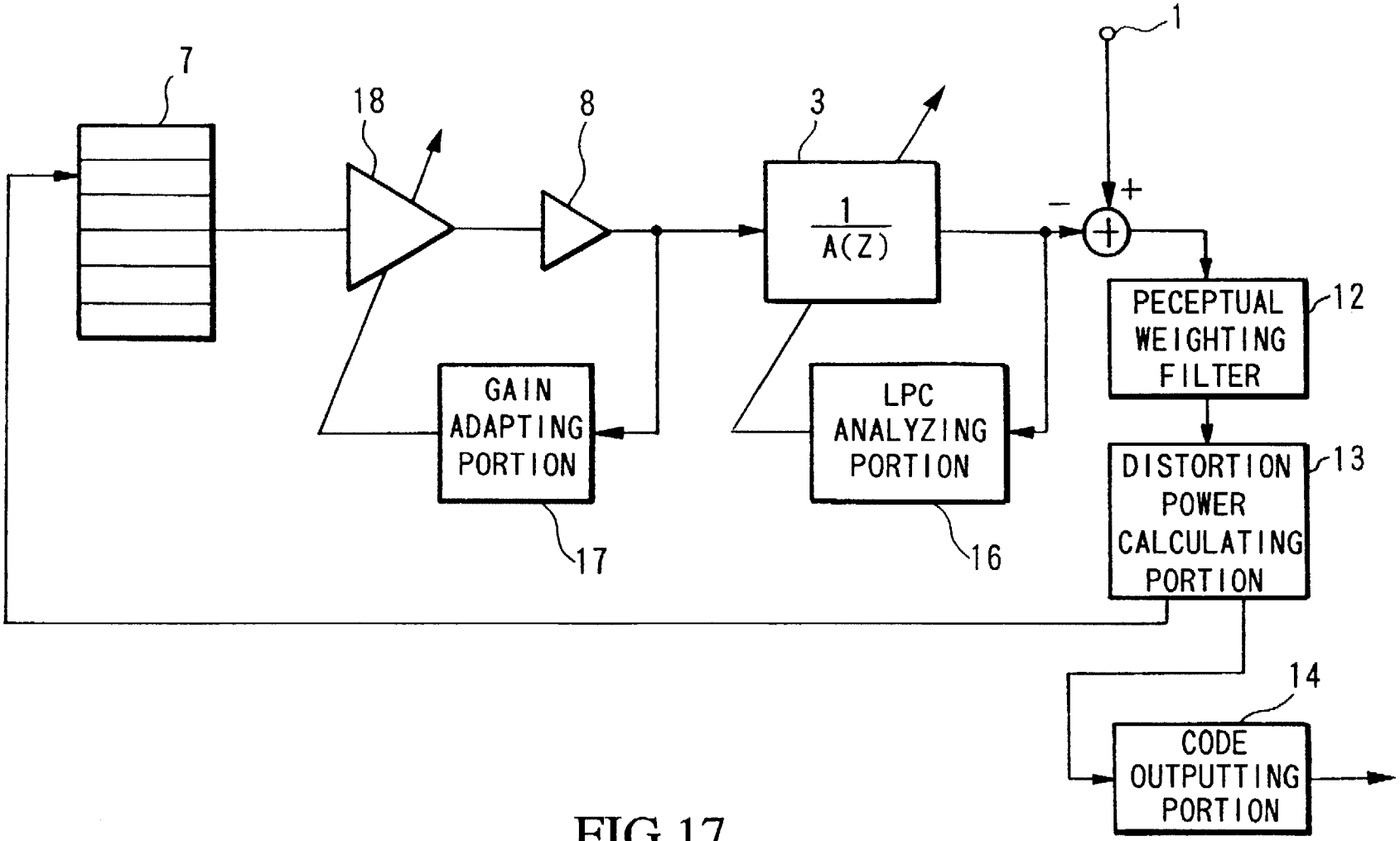
FIG.17 (PRIOR ART)
FIG. 17 is a block diagram showing a constructional example of a speech coding apparatus utilizing a conventional LD-CELP coding method.
Figure 18:
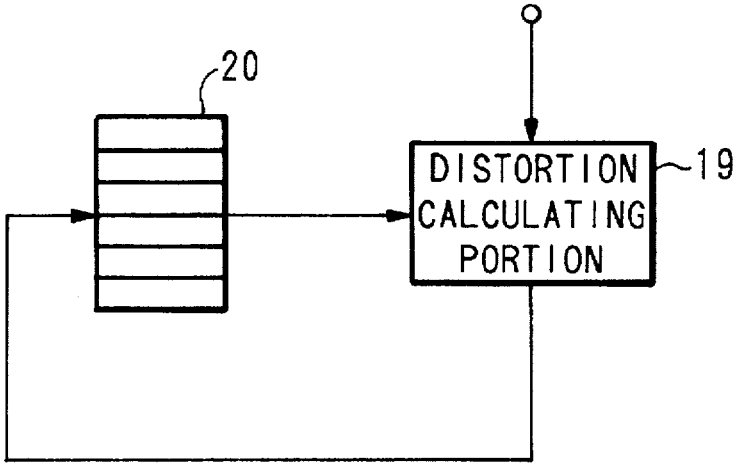
FIG.18 (PRIOR ART)
FIG. 18 is a block diagram showing a constructional example of a conventional vector quantization portion.
Figure 19:
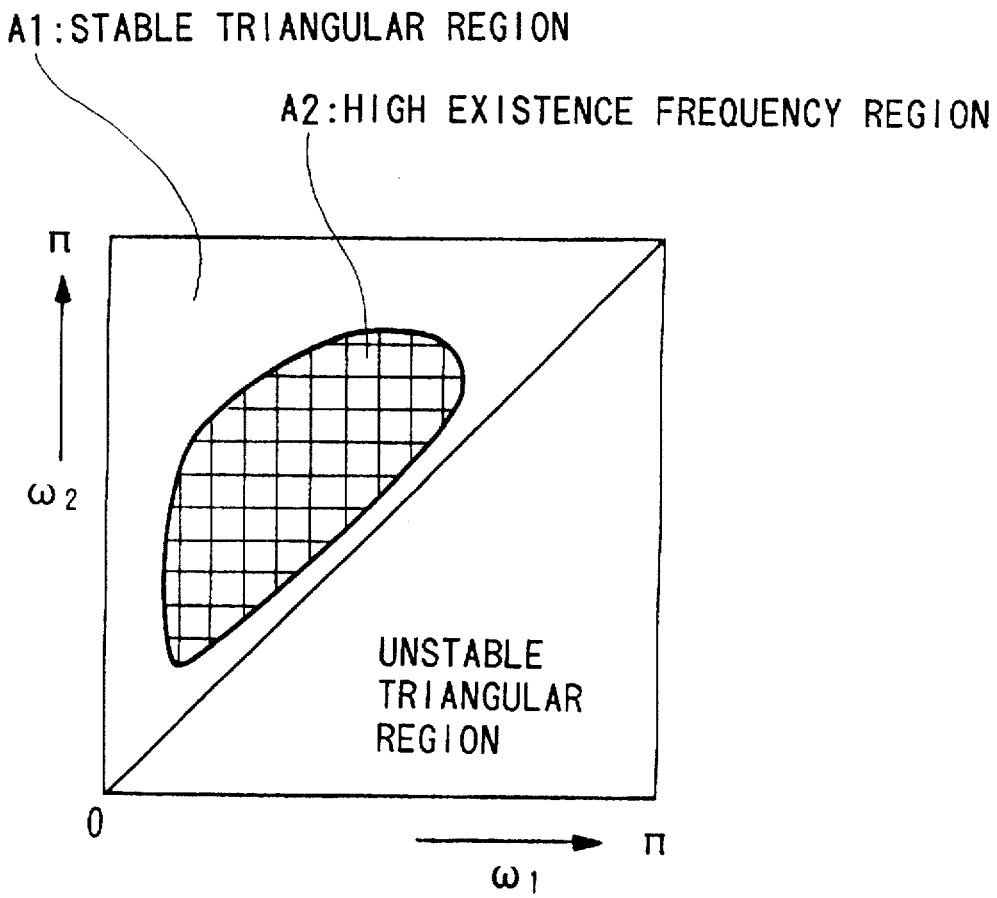
FIG.19 (PRIOR ART)
FIG. 19 shows the existence region of a two-dimensional LSP parameter according to a conventional multistage vector quantization method.
Figure 20:
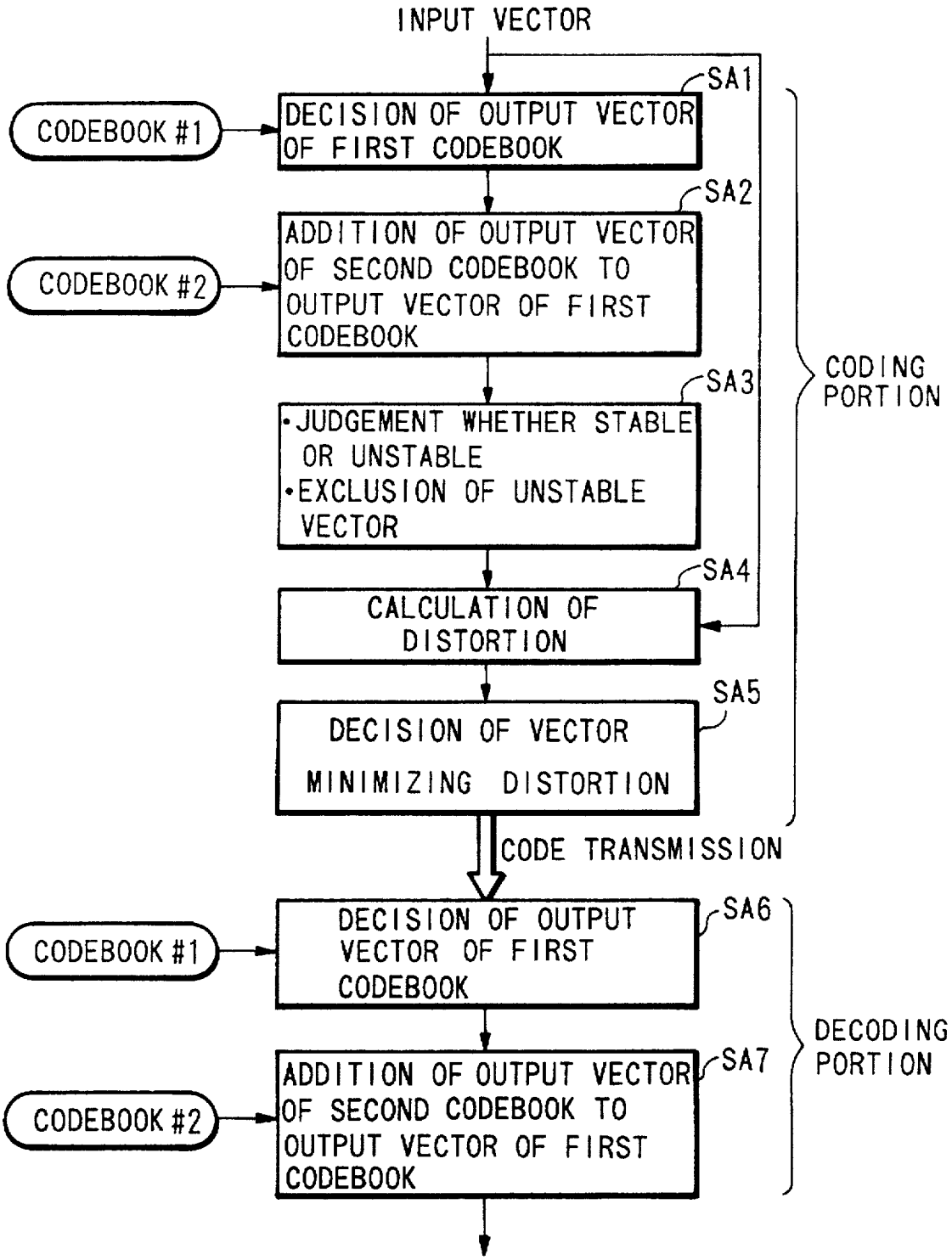
FIG.20 (PRIOR ART)
FIG. 20 is a flow chart for use in explaining a conventional multistage vector quantization method.
Figure 21:
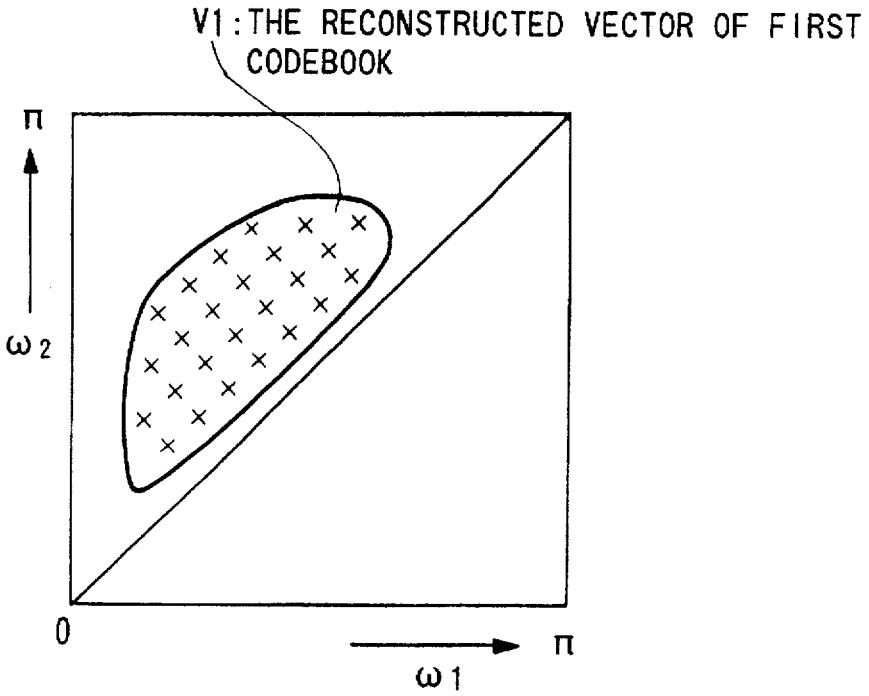
FIG.21 (PRIOR ART)
FIG. 21 shows a reconstructed vector of a first stage, in the case where vector quantization of the LSP parameters shown in FIG. 19 is performed.

FIG. 14 shows a result in which the speech quality of the decoded speech was estimated by an opinion test in the case where the speech data are respectively coded and transmitted by the speech coding apparatus according to the conventional art and the present invention and are decoded by the speech decoding apparatus. In FIG. 14, the speech quality of the decoded speech is depicted when the level of an input speech data in the speech coding apparatus is respectively set at 3 stages (A: large level, B: medium level, C: small level) in the case where transmission error has not occurred and the speech quality (see the mark D) of the decoded speech in the case where a random error ratio is 0.1%. In FIG. 14, oblique lined blocks show the result according to the conventional adaptive differential pulse coding modulation (ADPCM) method, crosshatched blocks show the result according to this embodiment of the present invention. According to FIG. 14, it is obvious that the speech quality of the decoded speech which is equal to one according to the ADPCM method is obtained regardless of the level of the input speech data in the case where transmission error has not occurred, and the speech quality of the decoded speech is better than one according to the ADPCM method in the case where transmission error has occurred. Consequently, the speech coding apparatus according to this embodiment is robust with respect to transmission errors.

As described above, according to the above-mentioned embodiment, it is possible to realize the coding and decoding of speech at 8 kb/s, speech coding with high speech quality of the decoded speech, which is equal to one of the decoded speech according to 32 kb/s ADPCM which is an international standard. Furthermore, according to this embodiment, even if a bit error were to occur in the transmission line, it is possible to obtain high quality decoded speech without the effect of the bit error.

The embodiment of the present invention has to this point been explained in detail with reference to the figures; however, the concrete construction of the present invention is not limited to this embodiment. The present invention includes modifications and the like which fall within the present invention as claimed.

What is claimed is:

1. A method for coding speech data in units of frames comprising the steps of:

forming a vector from speech signals comprising a plurality of samples as a unit of frame operation;

storing said vector as a speech input vector;

sequentially checking, one frame at a time, an amplitude of each speech input vector, and compressing said amplitude when the absolute value of said amplitude exceeds a predetermined value;

conducting linear prediction analysis and calculating a linear prediction coefficient (LPC) for each checked speech input vector;

converting each calculated LPC coefficient into a line spectrum pair (LSP) parameter;

quantizing said LSP parameter using a vector quantizing process, the quantized LSP parameter being expressed by a weighted mean vector of a plurality of vectors from a current frame operation and at least one previous frame operation, wherein said quantizing step comprises the steps of:

selecting one vector from among a plurality of stored vectors in a storing means;

multiplying a ratio constant (g) of a weighted mean by said selected one vector and outputting a fourth product;

multiplying a ratio constant (1−g ) of the weighted mean by a vector selected during processing of the frame immediately preceding the current frame operation and outputting a fifth product;

obtaining said quantized LSP parameter by adding the fourth product to the fifth product;

calculating the distortion data between an LSP parameter before quantization and said quantized LSP parameter; and selecting another vector which will minimize the distortion data at the time of selecting the one vector;

converting said quantized LSP parameter into a quantized LPC coefficient;

synthesizing a synthetic speech vector based on an external driving vector and said quantized LPC coefficient;

selecting a first pitch period vector from among a plurality of pitch period vectors;

selecting a first noise waveform vector from among a plurality of noise waveform vectors;

calculating a prediction gain for the first noise waveform vector;

multiplying said prediction gain by said first noise waveform vector and outputting a first product;

multiplying a gain selected from among a plurality of gains by said first pitch period vector and outputting a second product;

multiplying said selected gain by said first product and outputting a third product;

adding the second and third products, and supplying the sum as said driving vector;

calculating distortion data by subtracting said synthetic speech vector from said checked speech input vector;

weighting said calculated distortion data;

calculating a distortion power of said distortion data with regard to the weighted distortion data;

selecting a second pitch period vector that will provide a minimum distortion power from among the plurality of pitch period vectors;

selecting a second noise waveform vector that will provide a minimum distortion power from among the plurality of noise waveform vectors; and encoding the second pitch period vector and second noise waveform vector into bit series, adding as necessary error correctional coding, wherein the step of encoding encodes the selected another vector.

2. A method for coding speech data in units of frames comprising the steps of:

forming a vector from speech signals comprising a plurality of samples as a unit of frame operation;

storing said vector as a speech input vector;

sequentially checking, one frame at a time, an amplitude of each speech input vector, and compressing said amplitude when the absolute value of said amplitude exceeds a predetermined value;

conducting linear prediction analysis and calculating a linear prediction coefficient (LPC) for each checked speech input vector;

converting each calculated LPC coefficient into a line spectrum pair (LSP) parameter;

quantizing said LSP parameter using a vector quantizing process, the quantized LSP parameter being expressed by a weighted mean vector of a plurality of vectors from a current frame operation and at least one previous frame operation, wherein said quantizing step comprises the steps of:

selecting one vector from among a plurality of stored vectors in a storing means;

obtaining the sum of vectors selected in the current frame operation and in n previous frame operations;

obtaining said quantized LSP parameter by means of dividing the sum of vectors by n+1;

calculating the distortion data between an LSP parameter before quantization and said quantized LSP parameter; and selecting another vector which will minimize the distortion data at the time of selecting the one vector;

converting said quantized LSP parameter into a quantized LPC coefficient;

synthesizing a synthetic speech vector based on an external driving vector and said quantized LPC coefficient;

selecting a first pitch period vector from among a plurality of pitch period vectors;

selecting a first noise waveform vector from among a plurality of noise waveform vectors;

calculating a prediction gain for the first noise waveform vector;

multiplying said prediction gain by said first noise waveform vector and outputting a first product;

multiplying a gain selected from among a plurality of gains by said first pitch period vector and outputting a second product;

multiplying said selected gain by said first product and outputting a third product;

adding the second and third products, and supplying the sum as said driving vector;

calculating distortion data by subtracting said synthetic speech vector from said checked speech input vector;

weighting said calculated distortion data;

calculating a distortion power of said distortion data with regard to the weighted distortion data;

selecting a second pitch period vector that will provide a minimum distortion power from among the plurality of pitch period vectors;

selecting a second noise waveform vector that will provide a minimum distortion power from among the plurality of noise waveform vectors; and encoding the second pitch period vector and second noise waveform vector into bit series, adding as necessary error correctional coding, wherein the step of encoding encodes the selected another vector.

3. A method for coding speech data in units of frames comprising the steps of:

forming a vector from speech signals comprising a plurality of samples as a unit of frame operation;

storing said vector as a speech input vector;

sequentially checking, one frame at a time, an amplitude of each speech input vector, and compressing said amplitude when the absolute value of said amplitude exceeds a predetermined value;

conducting linear prediction analysis and calculating a linear prediction coefficient (LPC) for each checked speech input vector;

converting each calculated LPC coefficient into a line spectrum pair (LSP) parameter;

quantizing said LSP parameter using a vector quantizing process, the quantized LSP parameter being expressed by a weighted mean vector of a plurality of vectors from a current frame operation and at least one previous frame operation, wherein said quantizing step comprises the steps of:

selecting a first vector from among a plurality of vectors in a storing means;

selecting a second vector from among a plurality of vectors stored in a separate vector storing means;

obtaining the sum of vectors selected in current frame operation and n previous frame operations;

obtaining said quantized LSP parameter by dividing the sum of vectors by n+2;

calculating the distortion data between an LSP parameter before quantization and said quantized LSP parameter; and selecting another vector which will minimize the distortion data at a time of selecting the first and second vectors;

converting said quantized LSP parameter into a quantized LPC coefficient;

synthesizing a synthetic speech vector based on an external driving vector and said quantized LPC coefficient;

selecting a first pitch period vector from among a plurality of pitch period vectors;

selecting a first noise waveform vector from among a plurality of noise waveform vectors;

calculating a prediction gain for the first noise waveform vector;

multiplying said prediction gain by said first noise waveform vector and outputting a first product;

multiplying a gain selected from among a plurality of gains by said first pitch period vector and outputting a second product;

multiplying said selected gain by said first product and outputting a third product;

adding the second and third products, and supplying the sum as said driving vector;

calculating distortion data by subtracting said synthetic speech vector from said checked speech input vector;

weighting said calculated distortion data;

calculating a distortion power of said distortion data with regard to the weighted distortion data;

selecting a second pitch period vector that will provide a minimum distortion power from among the plurality of pitch period vectors;

selecting a second noise waveform vector that will provide a minimum distortion power from among the plurality of noise waveform vectors; and encoding the second pitch period vector and second noise waveform vector into bit series, adding as necessary error correctional coding, wherein the step of encoding encodes the first and second vectors.

4. A method for coding speech data in units of frames comprising the steps of:

forming a vector from speech signals comprising a plurality of samples as a unit of frame operation;

storing said vector as a speech input vector;

sequentially checking, one frame at a time, an amplitude of each speech input vector, and compressing said amplitude when the absolute value of said amplitude exceeds a predetermined value;

conducting linear prediction analysis and calculating a linear prediction coefficient (LPC) for each checked speech input vector;

converting each calculated LPC coefficient into a line spectrum pair (LSP) parameter;

quantizing said LSP parameter using a vector quantizing process, the quantized LSP parameter being expressed by a weighted mean vector of a plurality of vectors from a current frame operation and at least one previous frame operation, wherein said quantizing step comprises the steps of:

multiplying a ratio constant (gk) of a weighted mean by a plurality of stored vectors in a storing means;

selecting one vector from among said multiplied vectors in a storing means;

multiplying a ratio constant (1−gk) of the weighted mean by said selected vector during processing of the frame immediately preceding the current frame operation and outputting a fourth product;

obtaining said quantized LSP parameter by adding the selected vector and the fourth product;

calculating the distortion data between an LSP parameter before quantization and said quantized LSP parameter; and selecting another vector which will minimize the distortion data at a time of selecting a vector;

converting said quantized LSP parameter into a quantized LPC coefficient;

synthesizing a synthetic speech vector based on an external driving vector and said quantized LPC coefficient;

selecting a first pitch period vector from among a plurality of pitch period vectors;

selecting a first noise waveform vector from among a plurality of noise waveform vectors;

calculating a prediction gain for the first noise waveform vector;

multiplying said prediction gain by said first noise waveform vector and outputting a first product;

multiplying a gain selected from among a plurality of gains by said first pitch period vector and outputting a second product;

multiplying said selected gain by said first product and outputting a third product;

adding the second and third products, and supplying the sum as said driving vector;

calculating distortion data by subtracting said synthetic speech vector from said checked speech input vector;

weighting said calculated distortion data;

calculating a distortion power of said distortion data with regard to the weighted distortion data;

selecting a second pitch period vector that will provide a minimum distortion power from among the plurality of pitch period vectors;

selecting a second noise waveform vector that will provide a minimum distortion power from among the plurality of noise waveform vectors; and encoding the second pitch period vector and second noise waveform vector into bit series, adding as necessary error correctional coding, wherein the step of encoding encodes the selected another vector.

5. A method for coding speech data in units of frames comprising the steps of:

forming a vector from speech signals comprising a plurality of samples as a unit of frame operation;

storing said vector as a speech input vector;

sequentially checking, one frame at a time, an amplitude of each speech input vector, and compressing said amplitude when the absolute value of said amplitude exceeds a predetermined value;

conducting linear prediction analysis and calculating a linear prediction coefficient (LPC) for each checked speech input vector;

converting each calculated LPC coefficient into a line spectrum pair (LSP) parameter;

quantizing said LSP parameter using a vector quantizing process, the quantized LSP parameter being expressed by a weighted mean vector of a plurality of vectors from a current frame operation and at least one previous frame operation, wherein said quantizing step comprises the steps of:

selecting one vector from among a plurality of vectors in a storing means;

multiplying a ratio constant (g1) of a first weighted mean by said one selected vector and outputting a fourth product;

multiplying a ratio constant (g2) of a second weighted mean by said selected one vector and outputting a fifth product;

selecting either one of the fourth product or the fifth product;

multiplying a ratio constant (1−g2) of a third weighted mean by a product selected during processing of the frame operation immediately preceding the current frame operation and outputting a sixth product;

multiplying a ratio constant (1−g2) of a fourth weighted mean by a product selected during processing of the frame operation immediately preceding the current frame operation and outputting a seventh product;

selecting one of the sixth and seventh products;

obtaining said quantized LSP parameter by means of adding the selected first or second product and the selected third or fourth product;

calculating the distortion data between an LSP parameter before quantization and said quantized LSP parameter; and selecting another vector to minimize the distortion data;

converting said quantized LSP parameter into a quantized LPC coefficient;

synthesizing a synthetic speech vector based on an external driving vector and said quantized LPC coefficient;

selecting a first pitch period vector from among a plurality of pitch period vectors;

selecting a first noise waveform vector from among a plurality of noise waveform vectors;

calculating a prediction gain for the first noise waveform vector;

multiplying said prediction gain by said first noise waveform vector and outputting a first product;

multiplying a gain selected from among a plurality of gains by said first pitch period vector and outputting a second product;

multiplying said selected gain by said first product and outputting a third product;

adding the second and third products, and supplying the sum as said driving vector;

calculating distortion data by subtracting said synthetic speech vector from said checked speech input vector;

weighting said calculated distortion data;

calculating a distortion power of said distortion data with regard to the weighted distortion data;

selecting a second pitch period vector that will provide a minimum distortion power from among the plurality of pitch period vectors;

selecting a second noise waveform vector that will provide a minimum distortion power from among the plurality of noise waveform vectors; and encoding the second pitch period vector and second noise waveform vector into bit series, adding as necessary error correctional coding, wherein said encoding step encodes the selected another vector.

6. A method for coding speech data in units of frames comprising the steps of:

forming a vector from speech signals comprising a plurality of samples as a unit of frame operation;

storing said vector as a speech input vector;

sequentially checking, one frame at a time, an amplitude of each speech input vector, and compressing said amplitude when the absolute value of said amplitude exceeds a predetermined value;

conducting linear prediction analysis and calculating a linear prediction coefficient (LPC) for each checked speech input vector;

converting each calculated LPC coefficient into a line spectrum pair (LSP) parameter;

quantizing said LSP parameter using a vector quantizing process, the quantized LSP parameter being expressed by a weighted mean vector of a plurality of vectors from a current frame operation and at least one previous frame operation, wherein said quantizing step comprises the steps of:

selecting one vector from among a plurality of vectors stored in a storing means;

multiplying a ratio constant (g1) of a first weighted mean by said one vector and outputting a fourth product;

multiplying a ratio constant (g2) of a second weighted mean by said one vector and outputting a fifth product;

selecting either one of the fourth and fifth products;

processing each frame operation from the frame operation immediately preceding the current frame operation to previous frame operations, in which said processing comprises the steps of:

multiplying a first ratio constant of a predetermined weighted mean by one vector selected during processing of a previous frame operation and outputting a sixth product;

multiplying a second ratio constant of a predetermined weighted mean by a vector selected during processing of a previous frame operation and outputting a seventh product;

selecting either the sixth or seventh product;

summing the vectors selected during the processing step;

obtaining said quantized LSP parameter by adding the selected fourth or fifth product and the summed vectors;

calculating the distortion data between an LSP parameter before quantization and said quantized LSP parameter; and selecting another vector to minimize the distortion data;

converting said quantized LSP parameter into a quantized LPC coefficient;

synthesizing a synthetic speech vector based on an external driving vector and said quantized LPC coefficient;

selecting a first pitch period vector from among a plurality of pitch period vectors;

selecting a first noise waveform vector from among a plurality of noise waveform vectors;

calculating a prediction gain for the first noise waveform vector;

multiplying said prediction gain by said first noise waveform vector and outputting a first product;

multiplying a gain selected from among a plurality of gains by said first pitch period vector and outputting a second product;

multiplying said selected gain by said first product and outputting a third product;

adding the second and third products, and supplying the sum as said driving vector;

calculating distortion data by subtracting said synthetic speech vector from said checked speech input vector;

weighting said calculated distortion data;

calculating a distortion power of said distortion data with regard to the weighted distortion data;

selecting a second pitch period vector that will provide a minimum distortion power from among the plurality of pitch period vectors;

selecting a second noise waveform vector that will provide a minimum distortion power from among the plurality of noise waveform vectors; and encoding the second pitch period vector and second noise waveform vector into bit series, adding as necessary error correctional coding, wherein the step of encoding encodes the another vector, first or second product, and summed vectors.

7. A method in accordance with any one of claims 1–6 wherein a ratio constant (g, 1–g, gk, 1–gk, g1, g2, 1–g1, 1–g2) of the weighted mean differs with each vector element by which said ratio constant is multiplied.

8. A method in accordance with claim 7, wherein each vector is expressed by the sum of a plurality of vectors comprising different dimensions.

9. A method in accordance with claim 8, wherein the step of calculating a prediction gain includes the step of calculating the prediction gain by linear prediction analysis and selects a prediction gain based on the power of the first product multiplied by a gain during processing of said second product for the current frame operation, and the power of the first product multiplied by a gain during the processing of said second product for the at least one previous frame operation, and wherein said step of multiplying and outputting a second product comprises the steps of:

multiplying a first gain selected from among a plurality of gains stored in a first predetermined gain storing means by half of the selected first pitch period vector and half of said first product thereby obtaining a third product;

multiplying a second gain selected from among a plurality of gains stored in a second predetermined gain storing means by half of the selected first pitch period vector and half of said first product thereby obtaining a fourth product;

summing the third and fourth product, and outputting the sum as the second product; and summing the first product multiplied by the first gain and the first product multiplied by the second gain and outputting the sum as the third product.

10. A method in accordance with claim 7, wherein said step for selecting said another vector to minimize the distortion data within said quantizing step comprises, with regard to parameters w1, w2, w3, . . . wp-2, wp-1, wp comprising p-dimensional vector (w1, w2, w3, . . . wp-2, wp-1, wp) selected from said vector storing means, adjusting said parameters when the relationship 0<w1<w2<w3< . . . wp-2<wp-1<wp<p is not satisfied, so as to satisfy said relationship.

11. A method in accordance with claim 10, wherein the step of calculating a prediction gain includes the step of calculating the prediction gain by linear prediction analysis and selects a prediction gain based on the power of the first product multiplied by a gain during processing of said second product for the current frame operation, and the power of the first product multiplied by a gain during the processing of said second product for the at least one previous frame operation, and wherein said step of multiplying and outputting a second product comprises the steps of:

multiplying a first gain selected from among a plurality of gains stored in a first predetermined gain storing means by half of the selected first pitch period vector and half of said first product thereby obtaining a third product;

multiplying a second gain selected from among a plurality of gains stored in a second predetermined gain storing means by half of the selected first pitch period vector and half of said first product thereby obtaining a fourth product;

summing the third and fourth product, and outputting the sum as the second product; and summing the first product multiplied by the first gain and the first product multiplied by the second gain and outputting the sum as the third product.

12. A method in accordance with claim 7, wherein said step of calculating a prediction gain includes the step of calculating the prediction gain by linear prediction analysis and based on the power of the first product multiplied by a gain during processing of said second product for the current frame operation, and the power of the first product multiplied by a gain during the processing of said second product for the at least one previous frame operation, and wherein said step of multiplying and outputting a second product comprises the steps of:

multiplying a first gain selected from among a plurality of gains stored in a first predetermined gain storing means by half of the selected first pitch period vector and half of said first product thereby obtaining a third product;

multiplying a second gain selected from among a plurality of gains stored in a second predetermined gain storing means by half of the selected first pitch period vector and half of said first product thereby obtaining a fourth product;

summing the third and fourth product, and outputting the sum as the second product; and summing the first product multiplied by the first gain and the first product multiplied by the second gain and outputting the sum as the third product.

13. A method in accordance with any one of claims 1–6, wherein each vector is expressed by the sum of a plurality of vectors comprising different dimensions.

14. A method in accordance with claim 13, wherein said step for selecting said another vector to minimize the distortion data within said quantizing step comprises, with regard to parameters w1, w2, w3, . . . wp-2, wp-1, wp comprising p-dimensional vector (w1, w2, w3, . . . wp-2, wp-1, wp) selected from said vector storing means, adjusting said parameters when the relationship 0<w1<w2<w3< . . . wp-2<wp-1<wp<p is not satisfied, so as to satisfy said relationship.

15. A method in accordance with claim 14, wherein the step of calculating a prediction gain includes the step of calculating the prediction gain by linear prediction analysis and selects a prediction gain based on the power of the first product multiplied by a gain during processing of said second product for the current frame operation, and the power of the first product multiplied by a gain during the processing of said second product for the at least one previous frame operation, and wherein said step of multiplying and outputting a second product comprises the steps of:

multiplying a first gain selected from among a plurality of gains stored in a first predetermined gain storing means by half of the selected first pitch period vector and half of said first product thereby obtaining a third product;

multiplying a second gain selected from among a plurality of gains stored in a second predetermined gain storing means by half of the selected first pitch period vector and half of said first product thereby obtaining a fourth product;

summing the third and fourth product, and outputting the sum as the second product; and summing the first product multiplied by the first gain and the first product multiplied by the second gain and outputting the sum as the third product.

16. A method in accordance with claim 13, wherein said step of calculating a prediction gain includes the step of calculating the prediction gain by linear prediction analysis and selects a prediction gain based on the power of the first product multiplied by a gain during processing of said second product for the current frame operation, and the power of the first product multiplied by a gain during the processing of said second product for the at least one previous frame operation, and wherein said step of multiplying and outputting a second product comprises the steps of;

multiplying a first gain selected from among a plurality of gains stored in a first predetermined gain storing means by half of the selected first pitch period vector and half of said first product thereby obtaining a third product;

multiplying a second gain selected from among a plurality of gains stored in a second predetermined gain storing means by half of the selected first pitch period vector and half of said first product thereby obtaining a fourth product;

summing the third and fourth product, and outputting the sum as the second product; and summing the first product multiplied by the first gain and the first product multiplied by the second gain and outputting the sum as the third product.

17. A method in accordance with one of claims 1–6, wherein said step for selecting said another vector to minimize the distortion data within said quantizing step comprises, with regard to parameters w1, w2, w3, . . . wp-2, wp-1, wp comprising p-dimensional vector (w1, w2, w3, . . . wp-2, wp-1, wp) selected from said vector storing means, adjusting said parameters when the relationship 0<w1<w2<w3< . . . wp-2<wp-1<wp<p is not satisfied, so as to satisfy said relationship.

18. A method in accordance with claim 17, wherein the step of calculating a prediction gain includes the step of calculating the prediction gain by linear prediction analysis and selects a prediction gain based on the power of the first product multiplied by a gain during processing of said second product for the current frame operation, and the power of the first product multiplied by a gain during the processing of said second product for the at least one previous frame operation, and wherein said step of multiplying and outputting a second product comprises the steps of:

multiplying a first gain selected from among a plurality of gains stored in a first predetermined gain storing means by half of the selected first pitch period vector and half of said first product thereby obtaining a third product;

multiplying a second gain selected from among a plurality of gains stored in a second predetermined gain storing means by half of the selected first pitch period vector and half of said first product thereby obtaining a fourth product;

summing the third and fourth product, and outputting the sum as the second product; and summing the first product multiplied by the first gain and the first product multiplied by the second gain and outputting the sum as the third product.

19. A method in accordance with any one of claims 1–6, wherein said step of calculating a prediction gain includes the step of calculating the prediction gain by linear prediction analysis based on the power of the first product multiplied by a gain during processing of said second product for the current frame operation, and the power of the first product multiplied by a gain during the processing of said second product for the at least one previous frame operation, and wherein said step of multiplying and outputting a second product comprises the steps of:

multiplying a first gain selected from among a plurality of gains stored in a first predetermined gain storing means by half of the selected first pitch period vector and half of said first product thereby obtaining a third product;

multiplying a second gain selected from among a plurality of gains stored in a second predetermined gain storing means by half of the selected first pitch period vector and half of said first product thereby obtaining a fourth product;

summing the third and fourth products, and outputting the sum as the second product; and summing the first product multiplied by the first gain and the first product multiplied by the second gain and outputting the sum as the third product.

20. A speech coding apparatus comprising:

a buffer for forming a vector from speech signals comprising a plurality of samples as a unit of frame operation, and storing said vector as a speech input vector;

amplitude limiting means for sequentially checking, one frame at a time, the amplitude of each speech input vector stored in said buffer, and compressing said amplitude when the absolute value of said amplitude exceeds a predetermined value;

linear prediction coefficient (LPC) analyzing means for conducting linear prediction analysis and calculating an LPC coefficient for each speech input vector outputted by said amplitude limiting means;

LPC parameter converting means for converting each LPC coefficient calculated by said LPC analyzing means into a line spectrum pair (LSP) parameter;

vector quantizing means for quantizing each of said LSP parameters by using a vector quantizing process, wherein said vector quantizing means comprises:

vector storing means for storing a plurality of vectors;

selecting means for selecting one vector from among a plurality of vectors stored in said vector storing means;

first multiplying means for multiplying a ratio constant of a weighted mean by said one vector selected by said selecting means;

second multiplying means for multiplying a ratio constant of the weighted mean by a vector selected by said selecting means during processing of the frame operation immediately preceding the current frame operation;

adding means for obtaining said quantized LSP parameter by adding an output vector of said first multiplying means and an output vector of said second multiplying means;

distortion data calculating means for calculating the distortion data between an LSP parameter before quantization and said quantized LSP parameter;

control means for selecting a vector which will minimize the distortion data at the time of selecting a vector by said selecting means; and supply means for supplying identification information of a vector selected by said selecting means to said code outputting means;

LPC coefficient converting means for converting said quantized LSP parameters into quantized LPC coefficients;

synthesizing means for synthesizing a synthetic speech vector based on a driving vector and said quantized LPC coefficient;

pitch period vector selecting means for storing a plurality of pitch period vectors, and for selecting one pitch period vector from among said plurality of stored pitch period vectors;

noise waveform vector selecting means for storing a plurality of noise waveform vectors, and for selecting one noise waveform vector from among said plurality of stored noise waveform vectors;

gain adapting means for calculating a prediction gain for each noise waveform vector selected by said noise waveform vector selecting means;

prediction gain multiplying means for multiplying said prediction gain calculated by said gain adapting means by said noise waveform vector selected by said noise waveform vector selecting means;

gain multiplying means for storing a plurality of gains, and for respectively multiplying a gain selected from among said plurality of stored gains by said pitch period vector selected by said pitch period vector selecting means and an output vector of said prediction gain multiplying means;

adding means for adding two multiplication results obtained by said gain multiplying means, and supplying the sum to said synthesizing means as said driving vector;

distortion data calculating means for calculating distortion data by subtracting said synthetic speech vector outputted by said synthesizing means from said speech input vector outputted by said amplitude limiting means;

perceptual weighting means for weighting said distortion data obtained by of said distortion data calculating means;

distortion power calculating means for calculating the distortion power of said distortion data with regard to each distortion data weighted by said perceptual weighting means;

control means for selecting a vector to minimize said distortion power when selecting a pitch period vector by said pitch period vector selecting means and when selecting a noise waveform vector by said noise waveform vector selecting means, and selecting a gain by said gain multiplying means; and code output means for encoding data selected by said control means into a bit series, adding as necessary error correctional coding, and then transmitting said encoded bit series;

wherein said LSP parameter quantized by said vector quantizing means is expressed by a weighted mean vector of a plurality of vectors from the current frame operation and previous frame operations.

21. A speech coding apparatus comprising:

a buffer for forming a vector from speech signals comprising a plurality of samples as a unit of frame operation, and storing said vector as a speech input vector;

amplitude limiting means for sequentially checking, one frame at a time, the amplitude of each speech input vector stored in said buffer, and compressing said amplitude when the absolute value of said amplitude exceeds a predetermined value;

linear prediction coefficient (LPC) analyzing means for conducting linear prediction analysis and calculating an LPC coefficient for each speech input vector outputted by said amplitude limiting means;

LPC parameter converting means for converting each LPC coefficient calculated by said LPC analyzing means into a line spectrum pair (LSP) parameter;

vector quantizing means for quantizing each of said LSP parameters by using a vector quantizing process, wherein said vector quantizing means comprises:

vector storing means for storing a plurality of vectors;

selecting means for selecting one vector from among a plurality of vectors stored in said vector storing means;

adding means for summing vectors selected by said selecting means for the current frame operation and for each of n frame operations previous to the current frame operation;

dividing means for calculating said quantized LSP parameter by dividing an output vector of said adding means by n+1;

distortion data calculating means for calculating the distortion data between an LSP parameter before quantization and said quantized LSP parameter;

control means for selecting a vector which will minimize the distortion data calculated by said distortion data calculating means at the time of selecting a vector by said selecting means; and supply means for supplying a vector selected by said selecting means to said code outputting means;

LPC coefficient converting means for converting said quantized LSP parameters into quantized LPC coefficients;

synthesizing means for synthesizing a synthetic speech vector based on a driving vector and said quantized LPC coefficient;

pitch period vector selecting means for storing a plurality of pitch period vectors, and for selecting one pitch period vector from among said plurality of stored pitch period vectors;

noise waveform vector selecting means for storing a plurality of noise waveform vectors, and for selecting one noise waveform vector from among said plurality of stored noise waveform vectors;

gain adapting means for calculating a prediction gain for each noise waveform vector selected by said noise waveform vector selecting means;

prediction gain multiplying means for multiplying said prediction gain calculated by said gain adapting means by said noise waveform vector selected by said noise waveform vector selecting means;

gain multiplying means for storing a plurality of gains, and for respectively multiplying a gain selected from among said plurality of stored gains by said pitch period vector selected by said pitch period vector selecting means and an output vector of said prediction gain multiplying means;

adding means for adding two multiplication results obtained by said gain multiplying means, and supplying the sum to said synthesizing means as said driving vector;

distortion data calculating means for calculating distortion data by subtracting said synthetic speech vector outputted by said synthesizing means from said speech input vector outputted by said amplitude limiting means;

perceptual weighting means for weighting said distortion data obtained by of said distortion data calculating means;

distortion power calculating means for calculating the distortion power of said distortion data with regard to each distortion data weighted by said perceptual weighting means;

control means for selecting a vector to minimize said distortion power when selecting a pitch period vector by said pitch period vector selecting means and when selecting a noise waveform vector by said noise waveform vector selecting means, and selecting a gain by said gain multiplying means; and code output means for encoding data selected by said control means into a bit series, adding as necessary error correctional coding, and then transmitting said encoded bit series;

wherein said LSP parameter quantized by said vector quantizing means is expressed by a weighted mean vector of a plurality of vectors from the current frame operation and previous frame operations.

22. A speech coding apparatus comprising:

a buffer for forming a vector from speech signals comprising a plurality of samples as a unit of frame operation, and storing said vector as a speech input vector;

amplitude limiting means for sequentially checking, one frame at a time, the amplitude of each speech input vector stored in said buffer, and compressing said amplitude when the absolute value of said amplitude exceeds a predetermined value;

linear prediction coefficient (LPC) analyzing means for conducting linear prediction analysis and calculating an LPC coefficient for each speech input vector outputted by said amplitude limiting means;

LPC parameter converting means for converting each LPC coefficient calculated by said LPC analyzing means into a line spectrum pair (LSP) parameter;

vector quantizing means for quantizing each of said LSP parameters by using a vector quantizing process, wherein said vector quantizing means comprises:

first vector storing means for storing a plurality of vectors;

first selecting means for selecting one vector from among a plurality of vectors stored in said first vector storing means;

second vector storing means for storing a plurality of vectors;

second selecting means for selecting one vector from among a plurality of vectors stored in said second vector storing means;

first adding means for summing vectors selected by said first selecting means for the current frame operation and for each of n frame operations previous to the current frame operation for each vector;

second adding means for adding an output vector of said first adding means and said vector selected by said second selecting means;

dividing means for obtaining said quantized LSP parameter by dividing on output vector of said second adding means by n+2;

distortion data calculating means for calculating the distortion data between an LSP parameter before quantization and said quantized LSP parameter;

control means for selecting a vector which will minimize the distortion data calculated by said distortion data calculating means at the time of selecting vectors by said first selecting means and said second selecting means; and supply means for supplying vectors selected by said first selecting means and said second selecting means to said code outputting means;

LPC coefficient converting means for converting said quantized LSP parameters into quantized LPC coefficients;

synthesizing means for synthesizing a synthetic speech vector based on a driving vector and said quantized LPC coefficient;

pitch period vector selecting means for storing a plurality of pitch period vectors, and for selecting one pitch period vector from among said plurality of stored pitch period vectors;

noise waveform vector selecting means for storing a plurality of noise waveform vectors, and for selecting one noise waveform vector from among said plurality of stored noise waveform vectors;

gain adapting means for calculating a prediction gain for each noise waveform vector selected by said noise waveform vector selecting means;

prediction gain multiplying means for multiplying said prediction gain calculated by said gain adapting means by said noise waveform vector selected by said noise waveform vector selecting means;

gain multiplying means for storing a plurality of gains, and for respectively multiplying a gain selected from among said plurality of stored gains by said pitch period vector selected by said pitch period vector selecting means and an output vector of said prediction gain multiplying means;

adding means for adding two multiplication results obtained by said gain multiplying means, and supplying the sum to said synthesizing means as said driving vector;

distortion data calculating means for calculating distortion data by subtracting said synthetic speech vector outputted by said synthesizing means from said speech input vector outputted by said amplitude limiting means;

perceptual weighting means for weighting said distortion data obtained by of said distortion data calculating means;

distortion power calculating means for calculating the distortion power of said distortion data with regard to each distortion data weighted by said perceptual weighting means;

control means for selecting a vector to minimize said distortion power when selecting a pitch period vector by said pitch period vector selecting means and when selecting a noise waveform vector by said noise waveform vector selecting means, and selecting a gain by said gain multiplying means; and code output means for encoding data selected by said control means into a bit series, adding as necessary error correctional coding, and then transmitting said encoded bit series;

wherein said LSP parameter quantized by said vector quantizing means is expressed by a weighted mean vector of a plurality of vectors from the current frame operation and previous frame operations.

23. A speech coding apparatus comprising:

a buffer for forming a vector from speech signals comprising a plurality of samples as a unit of frame operation, and storing said vector as a speech input vector;

amplitude limiting means for sequentially checking, one frame at a time, the amplitude of each speech input vector stored in said buffer, and compressing said amplitude when the absolute value of said amplitude exceeds a predetermined value;

linear prediction coefficient (LPC) analyzing means for conducting linear prediction analysis and calculating an LPC coefficient for each speech input vector outputted by said amplitude limiting means;

LPC parameter converting means for converting each LPC coefficient calculated by said LPC analyzing means into a line spectrum pair (LSP) parameter;

vector quantizing means for quantizing each of said LSP parameters by using a vector quantizing process, wherein said vector quantizing means comprises;

vector storing means for storing a plurality of vectors;

multiplying means for multiplying a ratio constant of the weighted mean by each vector stored in said vector storing means;

selecting means for selecting one vector from among said multiplied vectors;

multiplying means for multiplying a ratio constant of the weighted mean by said vector selected by said selecting means during processing of the frame operation immediately preceding the current frame operation;

adding means for obtaining said quantized LSP parameter by adding an output vector of said selecting means and an output vector of said multiplying means;

distortion data calculating means for calculating the distortion data between an LSP parameter before quantization and said quantized LSP parameter;

control means for selecting a vector which will minimize the distortion data calculated by said distortion data calculating means at the time of selecting a vector by said selecting means; and supply means for supplying a vector selected by said selecting means to said code outputting means;

LPC coefficient converting means for converting said quantized LSP parameters into quantized LPC coefficients;

synthesizing means for synthesizing a synthetic speech vector based on a driving vector and said quantized LPC coefficient;

pitch period vector selecting means for storing a plurality of pitch period vectors, and for selecting one pitch period vector from among said plurality of stored pitch period vectors;

noise waveform vector selecting means for storing a plurality of noise waveform vectors, and for selecting one noise waveform vector from among said plurality of stored noise waveform vectors;

gain adapting means for calculating a prediction gain for each noise waveform vector selected by said noise waveform vector selecting means;

prediction gain multiplying means for multiplying said prediction gain calculated by said gain adapting means by said noise waveform vector selected by said noise waveform vector selecting means;

gain multiplying means for storing a plurality of gains, and for respectively multiplying a gain selected from among said plurality of stored gains by said pitch period vector selected by said pitch period vector selecting means and an output vector of said prediction gain multiplying means;

adding means for adding two multiplication results obtained by said gain multiplying means, and supplying the sum to said synthesizing means as said driving vector;

distortion data calculating means for calculating distortion data by subtracting said synthetic speech vector outputted by said synthesizing means from said speech input vector outputted by said amplitude limiting mean;

perceptual weighting means for weighting said distortion data obtained by of said distortion data calculating means;

distortion power calculating means for calculating the distortion power of said distortion data with regard to each distortion data weighted by said perceptual weighting means;

control means for selecting a vector to minimize said distortion power when selecting a pitch period vector by said pitch period vector selecting means and when selecting a noise waveform vector by said noise waveform vector selecting means, and selecting a gain by said gain multiplying means; and code output means for encoding data selected by said control means into a bit series, adding as necessary error correctional coding, and then transmitting said encoded bit series;

wherein said LSP parameter quantized by said vector quantizing means is expressed by a weighted mean vector of a plurality of vectors from the current frame operation and previous frame operations.

24. A speech coding apparatus comprising:

a buffer for forming a vector from speech signals comprising a plurality of samples as a unit of frame operation, and storing said vector as a speech input vector;

amplitude limiting means for sequentially checking, one frame at a time, the amplitude of each speech input vector stored in said buffer, and compressing said amplitude when the absolute value of said amplitude exceeds a predetermined value;

linear prediction coefficient (LPC) analyzing means for conducting linear prediction analysis and calculating an LPC coefficient for each speech input vector outputted by said amplitude limiting means;

LPC parameter converting means for converting each LPC coefficient calculated by said LPC analyzing means into a line spectrum pair (LSP) parameter;

vector quantizing means for quantizing each of said LSP parameters by using a vector quantizing process, wherein said vector quantizing means comprises;

vector storing means for storing a plurality of vectors;

first selecting means for selecting one vector from among a plurality of vectors stored in said vector storing means;

first multiplying means for multiplying a ratio constant of a first weighted mean by said one vector selected by said first selecting means;

second multiplying means for multiplying a ratio constant of a second weighted mean by said one vector selected by said first selecting means;

second selecting means for selecting one vector from among an output vector of said first multiplying means and an output vector of said second multiplying means;

third multiplying means for multiplying a ratio constant of a third weighted mean by said vector selected by said first selecting means during processing of the frame operation immediately preceding the current frame operation;

fourth multiplying means for multiplying a ratio constant of a fourth weighted mean by said vector selected by said first selecting means during processing of the frame operation immediately preceding the current frame operation;

third selecting means for selecting one vector from among an output vector of said third multiplying means and an output vector of said fourth multiplying means;

adding means for obtaining said quantized LSP parameter by adding an output vector of said second selecting means and an output vector of said third selecting means;

distortion data calculating means for calculating the distortion data between an LSP parameter before quantization and said quantized LSP parameter;

control means for selecting a vector which will minimize the distortion data calculated by said distortion data calculating means at the time of selecting the vectors by said first selecting means, said second selecting means and said third selecting means; and supply means for supplying identification information of the vectors selected by said first selecting means, said second selecting means and said third selecting means to said code outputting means;

LPC coefficient converting means for converting said quantized LSP parameters into quantized LPC coefficients;

synthesizing means for synthesizing a synthetic speech vector based on a driving vector and said quantized LPC coefficient;

pitch period vector selecting means for storing a plurality of pitch period vectors, and for selecting one pitch period vector from among said plurality of stored pitch period vectors;

noise waveform vector selecting means for storing a plurality of noise waveform vectors, and for selecting one noise waveform vector from among said plurality of stored noise waveform vectors;

gain adapting means for calculating a prediction gain for each noise waveform vector selected by said noise waveform vector selecting means;

prediction gain multiplying means for multiplying said prediction gain calculated by said gain adapting means by said noise waveform vector selected by said noise waveform vector selecting means;

gain multiplying means for storing a plurality of gains, and for respectively multiplying a gain selected from among said plurality of stored gains by said pitch period vector selected by said pitch period vector selecting means and an output vector of said prediction gain multiplying means;

adding means for adding two multiplication results obtained by said gain multiplying means, and supplying the sum to said synthesizing means as said driving vector;

distortion data calculating means for calculating distortion data by subtracting said synthetic speech vector outputted by said synthesizing means from said speech input vector outputted by said amplitude limiting means;

perceptual weighting means for weighting said distortion data obtained by of said distortion data calculating means;

distortion power calculating means for calculating the distortion power of said distortion data with regard to each distortion data weighted by said perceptual weighting means;

control means for selecting a vector to minimize said distortion power when selecting a pitch period vector by said pitch period vector selecting means and when selecting a noise waveform vector by said noise waveform vector selecting means, and selecting a gain by said gain multiplying means; and code output means for encoding data selected by said control means into a bit series, adding as necessary error correctional coding, and then transmitting said encoded bit series;

wherein said LSP parameter quantized by said vector quantizing means is expressed by a weighted mean vector of a plurality of vectors from the current frame operation and previous frame operations.

25. A speech coding apparatus comprising:

a buffer for forming a vector from speech signals comprising a plurality of samples as a unit of frame operation, and storing said vector as a speech input vector;

amplitude limiting means for sequentially checking, one frame at a time, the amplitude of each speech input vector stored in said buffer, and compressing said amplitude when the absolute value of said amplitude exceeds a predetermined value;

linear prediction coefficient (LPC) analyzing means for conducting linear prediction analysis and calculating an LPC coefficient for each speech input vector outputted by said amplitude limiting means;

LPC parameter converting means for converting each LPC coefficient calculated by said LPC analyzing means into a line spectrum pair (LSP) parameter;

vector quantizing means for quantizing each of said LSP parameters by using a vector quantizing process, wherein said vector quantizing means comprises:

vector storing means for storing a plurality of vectors;

first selecting means for selecting one vector from among a plurality of vectors stored in said vector storing means;

first multiplying means for multiplying a ratio constant of a first weighted mean by said one vector selected by said first selecting means;

second multiplying means for multiplying a ratio constant of a second weighted mean by said one vector selected by said first selecting means;

second selecting means for selecting one vector from among an output vector of said first multiplying means and an output vector of said second multiplying means;

multistage weighting means processing means for conducting processing of each frame operation from the frame operation immediately preceding the current frame operation to a frame operation n frame operations previous to the current frame operation, said processing means comprising:

multiplying means for multiplying a ratio constant of a predetermined weighted mean by a vector selected by said first selecting means during processing of a previous frame operation;

separate multiplying means for multiplying a ratio constant of the predetermined weighted mean by a vector selected by said first selecting means during processing of a previous frame operation; and selecting means for selecting a vector from among output vectors of said multiplying means;

first adding means for obtaining the sum of n vectors selected by said multistage weighting means;

second adding means for obtaining said quantized LSP parameter by adding an output vector of said second selecting means and an output vector of said first adding means;

distortion data calculating means for calculating the distortion data between an LSP parameter before quantization and said quantized LSP parameter;

control means for selecting a vector which will minimize the distortion data calculated by said distortion data calculating means at the time of selecting a vector by said selecting means; and supply means for supplying a vector selected by said selecting means to said code outputting means;

LPC coefficient converting means for converting said quantized LSP parameters into quantized LPC coefficients;

synthesizing means for synthesizing a synthetic speech vector based on a driving vector and said quantized LPC coefficient;

pitch period vector selecting means for storing a plurality of pitch period vectors, and for selecting one pitch period vector from among said plurality of stored pitch period vectors;

noise waveform vector selecting means for storing a plurality of noise waveform vectors, and for selecting one noise waveform vector from among said plurality of stored noise waveform vectors;

gain adapting means for calculating a prediction gain for each noise waveform vector selected by said noise waveform vector selecting means;

prediction gain multiplying means for multiplying said prediction gain calculated by said gain adapting means by said noise waveform vector selected by said noise waveform vector selecting means;

gain multiplying means for storing a plurality of gains and for respectively multiplying a gain selected from among said plurality of stored gains by said pitch period vector selected by said pitch period vector selecting means and an output vector of said prediction gain multiplying means;

adding means for adding two multiplication results obtained by said gain multiplying means, and supplying the sum to said synthesizing means as said driving vector;

distortion data calculating means for calculating distortion data by subtracting said synthetic speech vector outputted by said synthesizing means from said speech input vector outputted by said amplitude limiting means;

perceptual weighting means for weighting said distortion data obtained by of said distortion data calculating means;

distortion power calculating means for calculating the distortion power of said distortion data with regard to each distortion data weighted by said perceptual weighting means;

control means for selecting a vector to minimize said distortion power when selecting a pitch period vector by said pitch period vector selecting means and when selecting a noise waveform vector by said noise waveform vector selecting means, and selecting a gain by said gain multiplying means; and code output means for encoding data selected by said control means into a bit series, adding as necessary error correctional coding, and then transmitting said encoded bit series;

wherein said LSP parameter quantized by said vector quantizing means is expressed by a weighted mean vector of a plurality of vectors from the current frame operation and previous frame operations.

26. A speech coding apparatus in accordance with one of claims 20–25, wherein said ratio constant (g, 1−g, gk, 1−gk, g1, g2, 1−g1, 1−g2) of the weighted mean differs for each vector by which said ratio constant is multiplied.

27. A speech coding apparatus in accordance with claim 26, wherein each vector stored in said vector storing means is expressed by the sum of a plurality of vectors comprising different dimensions.

28. A speech coding apparatus in accordance with claim 27, wherein said gain adapting means calculates said prediction gain by conducting linear prediction analysis based on the power of an output vector of a prediction gain multiplying means multiplied by a gain during the processing of gain multiplying means for the current frame operation, and the power of an output vector of a prediction gain multiplying means multiplied by a gain during the processing of gain multiplying means for a past frame operation, and wherein said gain multiplying means comprises:

a first subgain multiplying means for multiplying a gain selected from among a plurality of gains stored therein by half of the pitch period vector selected by said pitch period vector selecting means and half of an output vector of said prediction gain multiplying means;

a second subgain multiplying means for multiplying a gain selected from among a plurality of gains stored therein by the remaining half of the pitch period vector selected by said pitch vector selecting means and the remaining half of the output vector of said prediction gain multiplying means;

a first summing means for supplying to said adding means the sum of a pitch period vector multiplied by a gain by said first subgain multiplying means and a pitch period vector multiplied by a gain by said second subgain multiplying means, as a pitch period vector multiplied by a gain by said gain multiplying means; and a second summing means for supplying to said adding means the sum of an output vector of said prediction gain multiplying means multiplied by a gain by said first subgain multiplying means and an output vector of said prediction gain multiplying means multiplied by a gain by said second subgain multiplying means, as an output vector of said prediction gain multiplying means multiplied by a gain by said gain multiplying means.

29. A speech coding apparatus in accordance with claim 26, wherein said control means, with regard to parameters w1, w2, w3, . . . wp-2, wp-1, wp comprising p dimensional vector {w1, w2, w3, . . . wp-2, wp-1, wp} selected from said vector storing means, adjusts said parameters when the relationship $0<w1<w2<w3 \ldots wp-2<wp-1<wp<p$ is not satisfied, so as to satisfy said relationship.

30. A speech coding apparatus in accordance with claim 29, wherein said gain adapting means calculates said prediction gain by conducting linear prediction analysis based on the power of an output vector of a prediction gain multiplying means multiplied by a gain during the processing of gain multiplying means for the current frame operation, and the power of an output vector of a prediction gain multiplying means multiplied by a gain during the processing of gain multiplying means for a past frame operation, and wherein said gain multiplying means comprises:

a first subgain multiplying means for multiplying a gain selected from among a plurality of gains stored therein by half of the pitch period vector selected by said pitch period vector selecting means and half of an output vector of said prediction gain multiplying means;

a second subgain multiplying means for multiplying a gain selected from among a plurality of gains stored therein by the remaining half of the pitch period vector selected by said pitch vector selecting means and the remaining half of the output vector of said prediction gain multiplying means;

a first summing means for supplying to said adding means the sum of a pitch period vector multiplied by a gain by said first subgain multiplying means and a pitch period vector multiplied by a gain by said second subgain multiplying means, as a pitch period vector multiplied by a gain by said gain multiplying means; and a second summing means for supplying to said adding means the sum of an output vector of said prediction gain multiplying means multiplied by a gain by said first subgain multiplying means and an output vector of said prediction gain multiplying means multiplied by a gain by said second subgain multiplying means, as an output vector of said prediction gain multiplying means multiplied by a gain by said gain multiplying means.

31. A speech coding apparatus in accordance with claim 26, wherein said gain adapting means calculates said prediction gain by conducting linear prediction analysis based on the power of an output vector of a prediction gain multiplying means multiplied by a gain during the processing of gain multiplying means for the current frame operation, and the power of an output vector of a prediction gain multiplying means multiplied by a gain during the processing of gain multiplying means for a past frame operation, and wherein said gain multiplying means comprises:

a first subgain multiplying means for multiplying a gain selected from among a plurality of gains stored therein by half of the pitch period vector selected by said pitch period vector selecting means and half of an output vector of said prediction gain multiplying means;

a second subgain multiplying means for multiplying a gain selected from among a plurality of gains stored therein by the remaining half of the pitch period vector selected by said pitch vector selecting means and the remaining half of the output vector of said prediction gain multiplying means;

a first summing means for supplying to said adding means the sum of a pitch period vector multiplied by a gain by said first subgain multiplying means and a pitch period vector multiplied by a gain by said second subgain multiplying means, as a pitch period vector multiplied by a gain by said gain multiplying means; and a second summing means for supplying to said adding means the sum of an output vector of said prediction gain multiplying means multiplied by a gain by said first subgain multiplying means and an output vector of said prediction gain multiplying means multiplied by a gain by said second subgain multiplying means, as an output vector of said prediction gain multiplying means multiplied by a gain by said gain multiplying means.

32. A speech coding apparatus in accordance with one of claims 20–25, wherein each vector stored in said vector storing means is expressed by the sum of a plurality of vectors comprising different dimensions.

33. A speech coding apparatus in accordance with claim 32, wherein said control means, with regard to parameters w1, w2, w3, . . . wp-2, wp-1, wp comprising p dimensional vector {w1, w2, w3, . . . wp-2, wp-1, wp} selected from said vector storing means, adjusts said parameters when the relationship $0<w1<w2<w3 \ldots wp-2<wp-1<wp<p$ is not satisfied, so as to satisfy said relationship.

34. A speech coding apparatus in accordance with claim 33, wherein said gain adapting means calculates said prediction gain by conducting linear prediction analysis based on the power of an output vector of a prediction gain multiplying means multiplied by a gain during the processing of gain multiplying means for the current frame operation, and the power of an output vector of a prediction gain multiplying means multiplied by a gain during the processing of gain multiplying means for a past frame operation, and wherein said gain multiplying means comprises:

a first subgain multiplying means for multiplying a gain selected from among a plurality of gains stored therein by half of the pitch period vector selected by said pitch period vector selecting means and half of an output vector of said prediction gain multiplying means;

a second subgain multiplying means for multiplying a gain selected from among a plurality of gains stored therein by the remaining half of the pitch period vector selected by said pitch vector selecting means and the remaining half of the output vector of said prediction gain multiplying means;

a first summing means for supplying to said adding means the sum of a pitch period vector multiplied by a gain by said first subgain multiplying means and a pitch period vector multiplied by a gain by said second subgain multiplying means, as a pitch period vector multiplied by a gain by said gain multiplying means; and a second summing means for supplying to said adding means the sum of an output vector of said prediction gain multiplying means multiplied by a gain by said first subgain multiplying means and an output vector of said prediction gain multiplying means multiplied by a gain by said second subgain multiplying means, as an output vector of said prediction gain multiplying means multiplied by a gain by said gain multiplying means.

35. A speech coding apparatus in accordance with claim 32, wherein said gain adapting means calculates said prediction gain by conducting linear prediction analysis based on the power of an output vector of a prediction gain multiplying means multiplied by a gain during the processing of gain multiplying means for the current frame operation, and the power of an output vector of a prediction gain multiplying means multiplied by a gain during the processing of gain multiplying means for a past frame operation, and wherein said gain multiplying means comprises:

a first subgain multiplying means for multiplying a gain selected from among a plurality of gains stored therein by half of the pitch period vector selected by said pitch period vector selecting means and half of an output vector of said prediction gain multiplying means;

a second subgain multiplying means for multiplying a gain selected from among a plurality of gains stored therein by the remaining half of the pitch period vector selected by said pitch vector selecting means and the remaining half of the output vector of said prediction gain multiplying means;

a first summing means for supplying to said adding means the sum of a pitch period vector multiplied by a gain by said first subgain multiplying means and a pitch period vector multiplied by a gain by said second subgain multiplying means, as a pitch period vector multiplied by a gain by said gain multiplying means; and a second summing means for supplying to said adding means the sum of an output vector of said prediction gain multiplying means multiplied by a gain by said first subgain multiplying means and an output vector of said prediction gain multiplying means multiplied by a gain by said second subgain multiplying means, as an output vector of said prediction gain multiplying means multiplied by a gain by said gain multiplying means.

36. A speech coding apparatus in accordance with one of claims 20–25, wherein said control means, with regard to parameters w1, w2, w3, . . . wp-2, wp-1, wp comprising p dimensional vector {w1, w2, w3, . . . wp-2, wp-1, wp} selected from said vector storing means, adjusts said parameters when the relationship $0<w1<w2<w3 \ldots wp-2<wp-1<wp<p$ is not satisfied, so as to satisfy said relationship.

37. A speech coding apparatus in accordance with claim 36, wherein said gain adapting means calculates said prediction gain by conducting linear prediction analysis based on the power of an output vector of a prediction gain multiplying means multiplied by a gain during the processing of gain multiplying means for the current frame operation, and the power of an output vector of a prediction gain multiplying means multiplied by a gain during the processing of gain multiplying means for a past frame operation, and wherein said gain multiplying means comprises:

a first subgain multiplying means for multiplying a gain selected from among a plurality of gains stored therein by half of the pitch period vector selected by said pitch period vector selecting means and half of an output vector of said prediction gain multiplying means;

a second subgain multiplying means for multiplying a gain selected from among a plurality of gains stored therein by the remaining half of the pitch period vector selected by said pitch vector selecting means and the remaining half of the output vector of said prediction gain multiplying means;

a first summing means for supplying to said adding means the sum of a pitch period vector multiplied by a gain by said first subgain multiplying means and a pitch period vector multiplied by a gain by said second subgain multiplying means, as a pitch period vector multiplied by a gain by said gain multiplying means; and a second summing means for supplying to said adding means the sum of an output vector of said prediction gain multiplying means multiplied by a gain by said first subgain multiplying means and an output vector of said prediction gain multiplying means multiplied by a gain by said second subgain multiplying means, as an output vector of said prediction gain multiplying means multiplied by a gain by said gain multiplying means.

38. A speech coding apparatus in accordance with one of claims 20–25, wherein said gain adapting means calculates said prediction gain by conducting linear prediction analysis based on a power of an output vector of a prediction gain multiplying means multiplied by a gain during the processing of gain multiplying means for the current frame operation, and the power of an output vector of a prediction gain multiplying means multiplied by a gain during the processing of gain multiplying means for a past frame operation, and wherein said gain multiplying means comprises:

a first subgain multiplying means for multiplying a gain selected from among a plurality of gains stored therein by half of the pitch period vector selected by said pitch period vector selecting means and half of an output vector of said prediction gain multiplying means;

a second subgain multiplying means for multiplying a gain selected from among a plurality of gains stored therein by the remaining half of the pitch period vector selected by said pitch vector selecting means and the remaining half of the output vector of said prediction gain multiplying means;

a first summing means for supplying to said adding means the sum of a pitch period vector multiplied by a gain by said first subgain multiplying means and a pitch period vector multiplied by a gain by said second subgain multiplying means, as a pitch period vector multiplied by a gain by said gain multiplying means; and a second summing means for supplying to said adding means the sum of an output vector of said prediction gain multiplying means multiplied by a gain by said first subgain multiplying means and an output vector of said prediction gain multiplying means multiplied by a gain by said second subgain multiplying means, as an output vector of said prediction gain multiplying means multiplied by a gain by said gain multiplying means.

39. A method for coding speech data in units of frames comprising the steps of:

forming a vector from speech signals comprising a plurality of samples as a unit of frame operation;

storing said vector as a speech input vector;

sequentially checking, one frame at a time, an amplitude of each speech input vector, and compressing said amplitude when the absolute value of said amplitude exceeds a predetermined value;

conducting linear prediction analysis and calculating a linear prediction coefficient (LPC) for each checked speech input vector;

converting each calculated LPC coefficient into a line spectrum pair (LSP) parameter;

quantizing said LSP parameter using a vector quantizing process, the quantized LSP parameter being expressed by a weighted mean vector of a plurality of vectors from a current frame operation and at least one previous frame operation;

converting said quantized LSP parameter into a quantized LPC coefficient;

synthesizing a synthetic speech vector based on an external driving vector and said quantized LPC coefficient;

selecting a first pitch period vector from among a plurality of pitch period vectors;

selecting a first noise waveform vector from among a plurality of noise waveform vectors;

calculating a prediction gain for the first noise waveform vector using linear prediction analysis based on the power of the first product multiplied by a gain during processing of said second product for the current frame operation, and the power of the first product multiplied by a gain during the processing of said second product for the at least one previous frame operation;

multiplying said prediction gain by said first noise waveform vector and outputting a first product;

multiplying a gain selected from among a plurality of gains by said first pitch period vector and outputting a second product, wherein said step of multiplying and outputting a second product comprises the steps of:

multiplying a first gain selected from among a plurality of gains stored in a first predetermined gain storing means by half of the selected first pitch period vector and half of said first product thereby obtaining a third product;

multiplying a second gain selected from among a plurality of gains stored in a second predetermined gain storing means by half of the selected first pitch period vector and half of said first product thereby obtaining a fourth product;

summing the third and fourth products, and outputting the sum as the second product; and summing the first product multiplied by the first gain and the first product multiplied by the second gain and outputting the sum as the third product;

multiplying said selected gain by said first product and outputting a third product;

adding the second and third products, and supplying the sum as said driving vector;

calculating distortion data by subtracting said synthetic speech vector from said checked speech input vector;

weighting said calculated distortion data;

calculating a distortion power of said distortion data with regard to the weighted distortion data;

selecting a second pitch period vector that will provide a minimum distortion power from among the plurality of pitch period vectors;

selecting a second noise waveform vector that will provide a minimum distortion power from among the plurality of noise waveform vectors; and encoding the second pitch period vector and second noise waveform vector into bit series, adding as necessary error correctional coding.

40. A speech coding apparatus comprising:

a buffer for forming a vector from speech signals comprising a plurality of samples as a unit of frame operation, and storing said vector as a speech input vector;

amplitude limiting means for sequentially checking, one frame at a time, the amplitude of each speech input vector stored in said buffer, and compressing said amplitude when the absolute value of said amplitude exceeds a predetermined value;

linear prediction coefficient (LPC) analyzing means for conducting linear prediction analysis and calculating an LPC coefficient for each speech input vector outputted by said amplitude limiting means;

LPC parameter converting means for converting each LPC coefficient calculated by said LPC analyzing means into a line spectrum pair (LSP) parameter;

vector quantizing means for quantizing each of said LSP parameters by using a vector quantizing process;

LPC coefficient converting means for converting said quantized LSP parameters into quantized LPC coefficients;

synthesizing means for synthesizing a synthetic speech vector based on a driving vector and said quantized LPC coefficient;

pitch period vector selecting means for storing a plurality of pitch period vectors, and for selecting one pitch period vector from among said plurality of stored pitch period vectors;

noise waveform vector selecting means for storing a plurality of noise waveform vectors, and for selecting one noise waveform vector from among said plurality of stored noise waveform vectors;

gain adapting means for calculating a prediction gain for each noise waveform vector selected by said noise waveform vector selecting means by conducting linear prediction analysis based on a power of an output vector of a prediction gain multiplying means multiplied by a gain during the processing of gain multiplying means for the current frame operation, and the power of an output vector of a prediction gain multiplying means multiplied by a gain during the processing of gain multiplying means for a past frame operation;

prediction gain multiplying means for multiplying said prediction gain calculated by said gain adapting means by said noise waveform vector selected by said noise waveform vector selecting means;

gain multiplying means for storing a plurality of gains, and for respectively multiplying a gain selected from among said plurality of stored gains by said pitch period vector selected by said pitch period vector selecting means and an output vector of said prediction gain multiplying means, wherein said gain multiplying means comprises:

a first subgain multiplying means for multiplying a gain selected from among a plurality of gains stored therein by half of the pitch period vector selected by said pitch period vector selecting means and half of an output vector of said prediction gain multiplying means;

a second subgain multiplying means for multiplying a gain selected from among a plurality of gains stored therein by the remaining half of the pitch period vector selected by said pitch vector selecting means and the remaining half of the output vector of said prediction gain multiplying means;

a first summing means for supplying to said adding means the sum of a pitch period vector multiplied by a gain by said first subgain multiplying means and a pitch period vector multiplied by a gain by said second subgain multiplying means, as a pitch period vector multiplied by a gain by said gain multiplying means; and a second summing means for supplying to said adding means the sum of an output vector of said prediction gain multiplying means multiplied by a gain by said first subgain multiplying means and an output vector of said prediction gain multiplying means multiplied by a gain by said second subgain multiplying means, as an output vector of said prediction gain multiplying means multiplied by a gain by said gain multiplying means;

adding means for adding two multiplication results obtained by said gain multiplying means, and supplying the sum to said synthesizing means as said driving vector;

distortion data calculating means for calculating distortion data by subtracting said synthetic speech vector outputted by said synthesizing means from said speech input vector outputted by said amplitude limiting means;

perceptual weighting means for weighting said distortion data obtained by of said distortion data calculating means;

distortion power calculating means for calculating the distortion power of said distortion data with regard to each distortion data weighted by said perceptual weighting means;

control means for selecting a vector to minimize said distortion power when selecting a pitch period vector by said pitch period vector selecting means and when selecting a noise waveform vector by said noise waveform vector selecting means, and selecting a gain by said gain multiplying means; and code output means for encoding data selected by said control means into a bit series, adding as necessary error correctional coding, and then transmitting said encoded bit series;

wherein said LSP parameter quantized by said vector quantizing means is expressed by a weighted mean vector of a plurality of vectors from the current frame operation and previous frame operations.

* * * * *

UNITED STATES PATENT AND TRADEMARK OFFICE

CERTIFICATE OF CORRECTION

PATENT NO. : 5,787,391
DATED : July 28, 1998
INVENTOR(S) : Takehiro MORIYA et al.

It is certified that error appears in the above-identified patent and that said Letters Patent is hereby corrected as shown below:

Claim 5, column 30, line 39, "(1-g2)" should read --(1-g1)--.

Claim 16, column 34, line 49, "of;" should read --of:--.

Claim 23, column 40, line 52, "comprises;" should read --comprises:--.

Claim 23, column 41, line 45, "mean" should read --means--.

Claim 24, column 42, line 21, "comprises;" should read --comprises:--.

Claim 25, column 45, line 8, after, "gains", insert --,--.

Signed and Sealed this

Ninth Day of November, 1999

*Attest:*

Q. TODD DICKINSON

*Attesting Officer*

*Acting Commissioner of Patents and Trademarks*